US009581329B2

(12) United States Patent
Deng

(10) Patent No.: US 9,581,329 B2
(45) Date of Patent: Feb. 28, 2017

(54) GAS-FUELED HEATER

(71) Applicant: PROCOM HEATING, INC., Brea, CA (US)

(72) Inventor: David Deng, Diamond Bar, CA (US)

( * ) Notice: Subject to any disclaimer, the term of this patent is extended or adjusted under 35 U.S.C. 154(b) by 0 days.

(21) Appl. No.: 14/951,222

(22) Filed: Nov. 24, 2015

(65) Prior Publication Data

US 2016/0215972 A1 Jul. 28, 2016

Related U.S. Application Data

(63) Continuation of application No. 13/572,546, filed on Aug. 10, 2012, now Pat. No. 9,200,801, which is a (Continued)

(51) Int. Cl.
*F23C 1/08* (2006.01)
*F23C 1/00* (2006.01)
(Continued)

(52) U.S. Cl.
CPC ..... *F23C 1/00* (2013.01); *F23D 14/00* (2013.01); *F23D 14/48* (2013.01); *F23D 14/62* (2013.01); *F23N 1/00* (2013.01); *F23N 1/007* (2013.01); *F23D 2207/00* (2013.01); *F23D 2208/00* (2013.01); *F23D 2900/21004* (2013.01); *F23K 2900/05002* (2013.01); *F23N 2035/18* (2013.01); *F23N 2041/02* (2013.01); *Y10T 137/0324* (2015.04); *Y10T 137/2567* (2015.04); *Y10T 137/8376* (2015.04); *Y10T 137/86493* (2015.04); *Y10T 137/86541* (2015.04); *Y10T 137/86815* (2015.04);
(Continued)

(58) Field of Classification Search
CPC .... F23C 1/00; F23C 1/08; F23D 14/48; F23D 14/62; F23D 2900/21004; F23D 2208/00; F23D 2207/00; F23N 1/007; F23N 1/00; F23N 2035/18; F23N 2041/02; F23K 2900/05002
USPC ..... 431/278, 12, 284, 280, 281; 137/637; 251/205, 206
See application file for complete search history.

(56) References Cited

U.S. PATENT DOCUMENTS 668,368 A 2/1901 Barkowsky
743,714 A 11/1903 Guese
(Continued)

FOREIGN PATENT DOCUMENTS

CA 2391757 1/2003
CN 2421550 2/2001
(Continued)

OTHER PUBLICATIONS

Consumer Guide to Vent-Free Gas Supplemental Heating Products, est. 2007.
(Continued)

*Primary Examiner* — Gregory Huson
*Assistant Examiner* — Daniel E Namay
(74) *Attorney, Agent, or Firm* — Middleton Reutlinger

(57) ABSTRACT

A gas-fueled heater can have a housing with pressure regulators, a control valve, a fluid selection valve and a burner positioned therein. The pressure regulators, control valve, fluid selection valve and burner can be configured to combust a fuel to create heat. The housing can include a number of holes passing therethrough to control access to the various components.

11 Claims, 41 Drawing Sheets

Related U.S. Application Data continuation of application No. 12/048,191, filed on Mar. 13, 2008, now Pat. No. 8,241,034.

(60) Provisional application No. 60/894,894, filed on Mar. 14, 2007.

(51) Int. Cl.

| | |
|---|---|
| ***F23D 14/00*** | (2006.01) |
| ***F23N 1/00*** | (2006.01) |
| ***F23D 14/48*** | (2006.01) |
| ***F23D 14/62*** | (2006.01) |
| *F23N 1/02* | (2006.01) |

(52) U.S. Cl.

CPC ..... *Y10T 137/87096* (2015.04); *Y10T 137/87249* (2015.04); *Y10T 137/87611* (2015.04)

(56) References Cited

U.S. PATENT DOCUMENTS

| | | | |
|---|---|---|---|
| 1,051,072 | A | 1/1913 | Bradley |
| 1,216,529 | A | 2/1917 | Wilcox |
| 1,589,386 | A | 6/1926 | Harper |
| 1,639,115 | A | 8/1927 | Smith |
| 1,639,780 | A | 8/1927 | Mulholland |
| 1,860,942 | A | 5/1932 | Morse |
| 1,867,110 | A | 7/1932 | Signore |
| 1,961,086 | A | 5/1934 | Sherman et al. |
| 2,054,588 | A | 9/1936 | Stephens |
| 2,095,064 | A | 10/1937 | Harper |
| 2,108,299 | A | 2/1938 | Steffen |
| 2,120,864 | A | 6/1938 | Kagi |
| 2,160,264 | A | 5/1939 | Furlong |
| 2,161,523 | A | 6/1939 | Moecker, Jr. et al. |
| 2,380,956 | A | 8/1945 | Evarts |
| 2,422,368 | A | 6/1947 | Ray |
| 2,556,337 | A | 6/1951 | Paille |
| 2,630,821 | A | 3/1953 | Arey et al. |
| 2,652,225 | A | 9/1953 | Peterson |
| 2,661,157 | A | 12/1953 | Reichelderfer |
| 2,687,140 | A | 8/1954 | St. Clair et al. |
| 2,747,613 | A | 5/1956 | Reinhart |
| 2,905,361 | A | 9/1959 | Noall |
| 3,001,541 | A | 9/1961 | St. Clair et al. |
| 3,001,547 | A | 9/1961 | Brumbaugh |
| 3,032,096 | A | 5/1962 | Stoui |
| 3,139,879 | A | 7/1964 | Bauer et al. |
| 3,331,392 | A | 7/1967 | Davidson et al. |
| 3,417,779 | A | 12/1968 | Golay |
| 3,430,655 | A | 3/1969 | Forney |
| 3,747,629 | A | 7/1973 | Bauman |
| 3,800,830 | A | 4/1974 | Etter |
| 3,814,570 | A | 6/1974 | Guigues et al. |
| 3,814,573 | A | 6/1974 | Karlovetz |
| 3,829,279 | A | 8/1974 | Qualley et al. |
| 3,843,310 | A | 10/1974 | Massi |
| 3,875,380 | A | 4/1975 | Rankin |
| 3,884,413 | A | 5/1975 | Berquist |
| 3,939,871 | A | 2/1976 | Dickson |
| 3,989,064 | A | 11/1976 | Branson et al. |
| 3,989,188 | A | 11/1976 | Branson |
| 4,007,760 | A | 2/1977 | Branson et al. |
| D243,694 | S | 3/1977 | Faulkner |
| 4,021,190 | A | 5/1977 | Dickson |
| 4,081,235 | A | 3/1978 | Van der Veer |
| 4,101,257 | A | 7/1978 | Straitz, III |
| 4,157,238 | A | 6/1979 | Van Berkum |
| 4,249,886 | A | 2/1981 | Bush |
| 4,290,450 | A | 9/1981 | Swanson |
| 4,301,825 | A | 11/1981 | Simko |
| 4,329,137 | A | 5/1982 | Werne |
| 4,340,362 | A | 7/1982 | Chalupsky et al. |
| 4,348,172 | A | 9/1982 | Miller |
| 4,355,659 | A | 10/1982 | Kelchner |
| 4,359,284 | A | 11/1982 | Kude et al. |
| 4,465,456 | A | 8/1984 | Hynek et al. |
| 4,474,166 | A | 10/1984 | Shaftner et al. |
| 4,509,912 | A | 4/1985 | Van Berkum |
| 4,597,733 | A | 7/1986 | Dean et al. |
| 4,640,680 | A | 2/1987 | Schilling |
| 4,718,448 | A | 1/1988 | Love et al. |
| 4,718,846 | A | 1/1988 | Oguri et al. |
| 4,768,543 | A | 9/1988 | Wienke et al. |
| 4,768,947 | A | 9/1988 | Adachi |
| 4,782,814 | A | 11/1988 | Cherryholmes |
| 4,796,652 | A | 1/1989 | Hafla |
| 4,848,133 | A | 7/1989 | Paulis et al. |
| 4,848,313 | A | 7/1989 | Velie |
| 4,850,530 | A | 7/1989 | Uecker |
| 4,874,006 | A | 10/1989 | Iqbal |
| 4,930,538 | A | 6/1990 | Browne |
| 4,962,749 | A | 10/1990 | Dempsey et al. |
| 4,965,707 | A | 10/1990 | Butterfield |
| 5,000,162 | A | 3/1991 | Shimek et al. |
| 5,025,990 | A | 6/1991 | Ridenour |
| 5,027,854 | A | 7/1991 | Genbauffe |
| 5,090,899 | A | 2/1992 | Kee |
| 5,172,728 | A | 12/1992 | Tsukazaki |
| 5,239,979 | A | 8/1993 | Maurice et al. |
| 5,251,823 | A | 10/1993 | Joshi et al. |
| 5,278,936 | A | 1/1994 | Shao |
| 5,379,794 | A | 1/1995 | Brown |
| 5,413,141 | A | 5/1995 | Dietiker |
| 5,437,304 | A | 8/1995 | Delcroix |
| 5,452,709 | A | 9/1995 | Mealer |
| 5,470,018 | A | 11/1995 | Smith |
| 5,513,798 | A | 5/1996 | Tavor |
| 5,542,609 | A | 8/1996 | Myers et al. |
| 5,567,141 | A | 10/1996 | Joshi et al. |
| 5,584,680 | A | 12/1996 | Kim |
| 5,591,024 | A | 1/1997 | Eavenson et al. |
| 5,603,211 | A | 2/1997 | Graves |
| 5,642,580 | A | 7/1997 | Hess et al. |
| 5,645,043 | A | 7/1997 | Long et al. |
| 5,674,065 | A | 10/1997 | Grando et al. |
| D391,345 | S | 2/1998 | Mandir et al. |
| 5,782,626 | A | 7/1998 | Joos et al. |
| 5,787,874 | A | 8/1998 | Krohn et al. |
| 5,787,928 | A | 8/1998 | Allen et al. |
| 5,795,145 | A | 8/1998 | Manning et al. |
| 5,807,098 | A | 9/1998 | Deng |
| 5,814,121 | A | 9/1998 | Travis |
| 5,838,243 | A | 11/1998 | Gallo |
| 5,890,459 | A | 4/1999 | Hedrick et al. |
| 5,906,197 | A | 5/1999 | French et al. |
| 5,915,952 | A | 6/1999 | Manning et al. |
| 5,931,661 | A | 8/1999 | Kingery |
| 5,941,699 | A | 8/1999 | Abele |
| 5,966,937 | A | 10/1999 | Graves |
| 5,971,746 | A | 10/1999 | Givens et al. |
| 5,975,112 | A | 11/1999 | Ohmi et al. |
| 5,987,889 | A | 11/1999 | Graves et al. |
| 5,988,204 | A | 11/1999 | Reinhardt et al. |
| 6,035,893 | A | 3/2000 | Ohmi et al. |
| 6,045,058 | A | 4/2000 | Dobbeling et al. |
| 6,076,517 | A | 6/2000 | Kahlke et al. |
| 6,135,063 | A | 10/2000 | Welden |
| 6,162,048 | A | 12/2000 | Griffioen et al. |
| 6,227,451 | B1 | 5/2001 | Caruso |
| 6,244,223 | B1 | 6/2001 | Welk |
| 6,244,524 | B1 | 6/2001 | Tackels et al. |
| 6,257,270 | B1 | 7/2001 | Ohmi et al. |
| 6,340,298 | B1 | 1/2002 | Vandrak et al. |
| 6,354,072 | B1 | 3/2002 | Hura |
| 6,354,078 | B1 | 3/2002 | Karlsson et al. |
| 6,543,235 | B1 | 4/2003 | Crocker et al. |
| 6,607,854 | B1 | 8/2003 | Rehg et al. |
| 6,648,635 | B2 | 11/2003 | Vandrak et al. |
| 6,779,333 | B2 | 8/2004 | Gerhold |
| 6,786,194 | B2 | 9/2004 | Koegler et al. |
| 6,845,966 | B1 | 1/2005 | Albizuri |
| 6,884,065 | B2 | 4/2005 | Vandrak et al. |

(56) References Cited

U.S. PATENT DOCUMENTS

| | | | |
|---|---|---|---|
| 6,901,962 | B2 | 6/2005 | Kroupa et al. |
| 6,904,873 | B1 | 6/2005 | Ashton |
| 6,910,496 | B2 | 6/2005 | Strom |
| 6,928,821 | B2 | 8/2005 | Gerhold |
| 6,938,634 | B2 | 9/2005 | Dewey, Jr. |
| 7,013,886 | B2 | 3/2006 | Deng |
| 7,044,729 | B2 | 5/2006 | Ayastuy et al. |
| 7,156,370 | B2 | 1/2007 | Albizuri |
| 7,174,913 | B2 | 2/2007 | Albizuri |
| 7,201,186 | B2 | 4/2007 | Ayastuy |
| 7,251,940 | B2 | 8/2007 | Graves et al. |
| 7,255,100 | B2 | 8/2007 | Repper et al. |
| 7,299,799 | B2 | 11/2007 | Albizuri |
| 7,367,352 | B2 | 5/2008 | Hagen et al. |
| 7,434,447 | B2 | 10/2008 | Deng |
| 7,458,386 | B2 | 12/2008 | Zhang |
| 7,487,888 | B1 | 2/2009 | Pierre, Jr. |
| 7,490,869 | B2 | 2/2009 | Iturralde et al. |
| 7,528,608 | B2 | 5/2009 | Elexpuru et al. |
| 7,533,656 | B2 | 5/2009 | Dingle |
| 7,591,257 | B2 | 9/2009 | Bayer et al. |
| 7,600,529 | B2 | 10/2009 | Querejeta |
| 7,607,325 | B2 | 10/2009 | Elexpuru et al. |
| 7,607,426 | B2 | 10/2009 | Deng |
| 7,634,993 | B2 | 12/2009 | Bellomo |
| 7,637,476 | B2 | 12/2009 | Mugica et al. |
| 7,641,470 | B2 | 1/2010 | Albizuri |
| 7,651,330 | B2 | 1/2010 | Albizuri |
| 7,654,820 | B2 | 2/2010 | Deng |
| 7,677,236 | B2 | 3/2010 | Deng |
| 7,730,765 | B2 | 6/2010 | Deng |
| 7,758,323 | B2 | 7/2010 | Orue |
| 7,766,006 | B1 | 8/2010 | Manning |
| 7,861,706 | B2 | 1/2011 | Bellomo |
| 7,942,164 | B2 | 5/2011 | Hsiao |
| 7,967,005 | B2 | 6/2011 | Parrish |
| 7,967,006 | B2 | 6/2011 | Deng |
| 7,967,007 | B2 | 6/2011 | Deng |
| 8,011,920 | B2 | 9/2011 | Deng |
| 8,057,219 | B1 | 11/2011 | Manning et al. |
| 8,152,515 | B2 | 4/2012 | Deng |
| 8,235,708 | B2 | 8/2012 | Deng |
| 8,241,034 | B2 | 8/2012 | Deng |
| 8,281,781 | B2 | 10/2012 | Deng |
| 8,297,968 | B2 | 10/2012 | Deng |
| 8,317,511 | B2 | 11/2012 | Deng |
| 2002/0058266 | A1 | 5/2002 | Clough et al. |
| 2002/0160325 | A1 | 10/2002 | Deng |
| 2002/0160326 | A1 | 10/2002 | Deng |
| 2003/0010952 | A1 | 1/2003 | Morete |
| 2003/0217555 | A1 | 11/2003 | Gerhold |
| 2004/0226600 | A1 | 11/2004 | Starer et al. |
| 2004/0238030 | A1 | 12/2004 | Dewey, Jr. |
| 2005/0053887 | A1 | 3/2005 | Westergaard |
| 2005/0167530 | A1 | 8/2005 | Ward et al. |
| 2005/0202361 | A1 | 9/2005 | Albizuri |
| 2005/0208443 | A1 | 9/2005 | Bachinski et al. |
| 2006/0096644 | A1 | 5/2006 | Goldfarb et al. |
| 2006/0201496 | A1 | 9/2006 | Shingler |
| 2007/0000254 | A1 | 1/2007 | Laster et al. |
| 2007/0044856 | A1 | 3/2007 | Bonior |
| 2007/0154856 | A1 | 7/2007 | Hallit et al. |
| 2007/0210069 | A1 | 9/2007 | Albizuri |
| 2007/0215223 | A1 | 9/2007 | Morris |
| 2007/0277803 | A1 | 12/2007 | Deng |
| 2007/0277813 | A1 | 12/2007 | Deng |
| 2008/0121116 | A1 | 5/2008 | Albizuri |
| 2008/0149872 | A1 | 6/2008 | Deng |
| 2008/0153045 | A1 | 6/2008 | Deng |
| 2008/0168980 | A1 | 7/2008 | Lyons et al. |
| 2008/0223465 | A1 | 9/2008 | Deng |
| 2008/0227045 | A1 | 9/2008 | Deng |
| 2008/0236688 | A1 | 10/2008 | Albizuri |
| 2008/0236689 | A1 | 10/2008 | Albizuri |
| 2008/0314090 | A1 | 12/2008 | Orue Orue et al. |
| 2009/0039072 | A1 | 2/2009 | Llona |
| 2009/0140193 | A1 | 6/2009 | Albizuri Landa |
| 2009/0159068 | A1 | 6/2009 | Querejeta et al. |
| 2009/0173075 | A1 | 7/2009 | Miura et al. |
| 2009/0280448 | A1 | 11/2009 | Antxia Uribetxebarria et al. |
| 2010/0035195 | A1 | 2/2010 | Querejeta Andueza et al. |
| 2010/0086884 | A1 | 4/2010 | Querejeta Andueza et al. |
| 2010/0086885 | A1 | 4/2010 | Querejeta Andueza et al. |
| 2010/0089385 | A1 | 4/2010 | Albizuri |
| 2010/0089386 | A1 | 4/2010 | Albizuri |
| 2010/0095945 | A1 | 4/2010 | Manning |
| 2010/0154777 | A1 | 6/2010 | Carvalho et al. |
| 2010/0170503 | A1 | 7/2010 | Deng |
| 2010/0255433 | A1 | 10/2010 | Querejeta Andueza et al. |
| 2010/0275953 | A1 | 11/2010 | Orue Orue et al. |
| 2010/0304317 | A1 | 12/2010 | Deng |
| 2010/0310997 | A1 | 12/2010 | Mugica Odriozola et al. |
| 2010/0326430 | A1 | 12/2010 | Deng |
| 2010/0330513 | A1 | 12/2010 | Deng |
| 2010/0330519 | A1 | 12/2010 | Deng |
| 2011/0081620 | A1 | 4/2011 | Deng |
| 2011/0143294 | A1 | 6/2011 | Deng |
| 2013/0122439 | A1 | 5/2013 | Deng |

FOREIGN PATENT DOCUMENTS

| | | | |
|---|---|---|---|
| CN | 2430629 | Y | 5/2001 |
| CN | 1873268 | | 12/2006 |
| CN | 1873268 | A | 12/2006 |
| CN | 2901068 | | 5/2007 |
| DE | 720 854 | C | 5/1942 |
| EP | 1970625 | | 9/2008 |
| GB | 2210155 | | 6/1989 |
| JP | 58 219320 | A | 12/1983 |
| JP | 59009425 | | 1/1984 |
| JP | 62169926 | | 7/1987 |
| JP | 03 230015 | A | 10/1991 |
| JP | 05-256422 | | 5/1993 |
| JP | 10141656 | | 5/1998 |
| JP | 11192166 | | 7/1999 |
| JP | 11193929 | | 7/1999 |
| JP | 11-344216 | | 12/1999 |
| JP | 2000234738 | | 8/2000 |
| JP | 2003 056845 | A | 2/2003 |
| JP | 2003-65533 | | 3/2003 |
| JP | 2003 074837 | A | 3/2003 |
| JP | 2003 074838 | A | 3/2003 |
| JP | 2003-83537 | | 3/2003 |
| JP | 2003-90498 | | 3/2003 |
| JP | 2003-90517 | | 3/2003 |
| JP | 2005-257169 | | 9/2005 |
| JP | 2006-029763 | | 2/2006 |
| JP | 2007017030 | | 1/2007 |
| JP | 2010071477 | | 4/2010 |
| WO | WO 2008/071970 | | 6/2008 |
| WO | WO 2008/112933 | | 9/2008 |

OTHER PUBLICATIONS

Heat and Glo, Escape Series Gas Fireplaces, Mar. 2005.

Heat and Glo, Escape-42DV Owner's Manual, Rev. i, Dec. 2006.

Napoleon, Park Avenue Installation and Operation Instructions, Jul. 20, 2006.

Napoleon, The Madison Installation and Operation Instructions, May 24, 2005.

International Search Report and Written Opinion for International Application No. PCT/US2010/039668, Notification mailed Oct. 1, 2010.

International Search Report and Written Opinion for International Application No. PCT/US2010/039687, Notification mailed Oct. 5, 2010.

International Search Report and Written Opinion for International Application No. PCT/US2010/039655, Notification mailed Jan. 14, 2011.

International Search Report and Written Opinion for International Application No. PCT/US2010/039681, Notification mailed Jan. 12, 2011.

(56) References Cited

OTHER PUBLICATIONS

Country Flame Technologies Inglenook Fireplace Gas Log Set Model INGLS 24-N or INGLS 24-P Natural Gas or Propane Conversion Kit, Installation, Operation, and Maintenance Manual, 2004.
Desa Heating Products, Technical Service Training Manual, 2004.
Flagro F-400T Dual Fuel Construction Heater, Operating Instructions Manual.
Heat Wagon S1505 Construction Heater, Installation and Maintenance Manual, Jul. 29, 2002.
Jotul GF 3 BVAllagash B-Vent Gas Heater, Installation and Operating Instructions, Dec. 2000.
Vanguard Unvented (Vent-Free) Propane/LP Gas Log Heater Manual, Feb. 2004.
White Mountain Hearth, The Vail Vent-Free Gas Fireplace, Installation Instructions and Owner's Manual, Mar. 2006.
Installation Instructions and Owner's Manuals for Empire Unvented Gas Fireplace Model VFHS-36, Mar. 2001.
Installation Instructions and Owner's Manuals for Empire Unvented Gas Fireplace Model VFHS-33, Apr. 2001.
Installation Instructions and Owner's Manuals for Empire Unvented Gas Fireplace Models VFHD-32 and VFHS-36, Apr. 2003.
Installation Instructions and Owner's Manuals for Empire Unvented Gas Fireplace Models VFHD-32 and VFHS-36, Sep. 2003.
Installation Instructions and Owner's Manuals for Empire Unvented Gas Fireplace Models VFHD-32 and VFHS-36, Feb. 2004.
Installation Instructions and Owner's Manuals for Empire Unvented Gas Fireplace Models VFHD-32 and VFHS-36, Sep. 2004.
Installation Instructions and Owner's Manuals for Empire Unvented Gas Fireplace Models VFHD-32 and VFHS-36, Jun. 2005.
Installation Instructions and Owner's Manuals for Empire Unvented Gas Fireplace Models VFP32FP and VFP36FP, Mar. 2006.
Installation Instructions and Owner's Manuals for Empire Unvented Gas Fireplace Models VFP32FP and VFP36FP, May 2006.
Installation Instructions and Owner's Manuals for Empire Unvented Gas Fireplace Model VFHS-20, Jun. 2002.
Installation Instructions and Owner's Manuals for Empire Unvented Gas Fireplace Model VFHS-20, Sep. 2003.
Installation Instructions and Owner's Manuals for Empire Unvented Gas Fireplace Model VFHS-20, Nov. 2003.
Installation Instructions and Owner's Manuals for Empire Unvented Gas Fireplace Model VFHS-20, Sep. 2004.
Installation Instructions and Owner's Manuals for Empire Unvented Gas Fireplace Model VFHS-20, Jun. 2005.
Installation Instructions and Owner's Manuals for Empire Unvented Gas Fireplace Model VFHS-32, Aug. 2002.
*Procom Heating, Inc.* v. *GHP Group, Inc.* (W.D. KY, Case No. 1:13-cv-00163-GNS-HBB): GHP's Answer to the First Amended Complaint, Aug. 27, 2014.
*Procom Heating, Inc.* v. *GHP Group, Inc.* (W.D. KY, Case No. 1:13-cv-00163-GNS-HBB): Procom Heating's First Amended Complaint, Aug. 13, 2014.
*Procom Heating, Inc.* v. *GHP Group, Inc.* (W.D. KY, Case No. 1:13-cv-00163-GNS-HBB): Claims Construction Memorandum Opinion and Order, Jul. 8, 2015.
*Procom Heating, Inc.* v. *GHP Group, Inc.* (W.D. KY, Case No. 1:13-cv-00163-GNS-HBB): GHP's Initial Invalidity Contentions, Mar. 31, 2014.
*Procom Heating, Inc.* v. *GHP Group, Inc.* (W.D. KY, Case No. 1:13-cv-00163-GNS-HBB): GHP's 2nd Amended Initial Invalidity Contentions, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit A, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit B, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit C, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit D, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit E, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit F, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit G, Sep. 4, 2015.

GAS-FUELED HEATER

CROSS-REFERENCE TO RELATED APPLICATIONS

This application is a continuation of U.S. patent application Ser. No. 13/572,546, filed Aug. 10, 2012, now U.S. Pat. No. 9,200,801, which is a continuation of U.S. patent application Ser. No. 12/048,191, filed Mar. 13, 2008, now U.S. Pat. No. 8,241,034, which claims priority to U.S. Provisional Appl. No. 60/894,894, filed Mar. 14, 2007. The entire contents of the above applications are hereby incorporated by reference herein and made a part of this specification. Any and all priority claims identified in the Application Data Sheet, or any correction thereto, are hereby incorporated by reference under 37 CFR 1.57.

BACKGROUND

Field of the Inventions

Certain embodiments disclosed herein relate generally to valve assemblies, and relate more specifically to valve assemblies for selecting a fuel operating mode.

Description of the Related Art

Many varieties of heaters, fireplaces, log sets, stoves, water heaters, grills, and other flame-producing and/or heat-producing devices utilize combustible fuels. Some such devices operate with liquid propane gas, while others operate with natural gas. However, such devices and certain components thereof have various limitations and disadvantages.

SUMMARY OF THE INVENTIONS

In certain embodiments, an apparatus includes a control valve configured to regulate fuel flow through the apparatus. The apparatus can include a burner configured to produce a flame. The apparatus can further include a valve assembly. In some embodiments, the valve assembly includes a housing, which can define a first fuel input for receiving a first fuel from a first fuel source and a second fuel input for receiving a second fuel from a second fuel source. The housing can define a first fuel output for directing fuel received from either the first fuel input or the second fuel input toward the control valve. The housing also can define a third fuel input for receiving a portion of either said first fuel or said second fuel from the control valve. The housing can further define a first egress flow path for directing the portion of the first fuel received via the third fuel input to the burner. The housing can further define a second egress flow path for directing the portion of the second fuel received via the third fuel input to the burner. In certain embodiments, the valve assembly includes a valve body configured to selectively permit fluid communication between the first fuel input and the first fuel output or between the second fuel input and the first fuel output. The valve body can be configured to selectively permit fluid communication (a) between the third fuel input and the first egress flow path, and (b) between the third fuel input and the second egress flow path, or (c) between the third fuel input and the first and second egress flow paths.

In certain embodiments, an apparatus includes a burner configured to produce a flame. The apparatus can include a valve assembly, which can include a housing that defines a first fuel input for receiving fuel from a first fuel source. The housing can further define a second fuel input for receiving fuel from a second fuel source. The housing can further define a first fuel output for directing fuel received from either the first fuel input or the second fuel input. The housing also can define a third fuel input for receiving fuel from the control valve. The housing also can define a first egress flow path for directing fuel received from a fuel source toward the burner. In some embodiments, the valve assembly includes a valve body configured to selectively permit fluid communication between the first fuel input and the first fuel output or between the second fuel input and the first fuel output. In some embodiments, the apparatus includes a mixing chamber positioned to receive fuel from the first egress flow path and defining one or more adjustable openings through which air can pass to mix with fuel received from the first egress flow path. In some embodiments, the mixing chamber is coupled with the valve body such that the one or more openings change size due to movement of the valve body.

In certain embodiments, an apparatus includes a control valve configured to regulate fuel flow through the apparatus. The apparatus can further include a pilot assembly. The apparatus also can include a burner configured to produce a flame. In certain embodiments, the apparatus includes a valve assembly. In some embodiments, the valve assembly comprises a housing, which can define a first fuel input for receiving a first fuel from a first fuel source. The housing can define a second fuel input for receiving a second fuel from a second fuel source. The housing can further define a third fuel input for receiving a portion of either said first fuel or said second fuel from the control valve. The housing also can define a fourth fuel input for receiving a portion of either said first fuel or said second fuel from the control valve. In some embodiments, the housing further defines a first fuel output for directing fuel received from either the first fuel input or the second fuel input toward the control valve. In some embodiments, the housing further defines a first egress flow path for directing said portion of said first fuel received via the third fuel input to the burner. The housing can further define a second egress flow path for directing said portion of said second fuel received via the third fuel input to the burner. The housing can define a second fuel output for directing said portion of said first fuel received via the fourth fuel input to the pilot assembly, and can define a third fuel output for directing said portion of said second fuel received via the fourth fuel input to the pilot assembly. The valve assembly can include a valve body configured to selectively permit fluid communication between the first fuel input and the first fuel output or between the second fuel input and the first fuel output, between the fourth fuel input and the second fuel output or between the fourth fuel input and the third fuel output, and between the third fuel input and the first egress flow path or between the third fuel input and the second egress flow path.

In certain embodiments, a valve assembly includes a housing. In some embodiments, the housing defines a first fuel input for receiving fuel at a first pressure. The housing defines a second fuel input for receiving fuel at a second pressure. In some embodiments, the housing defines a third fuel input and a fourth fuel input. In some embodiments, the housing defines a first fuel output, a second fuel output, and a third fuel output. The housing can define a first egress flow path and a second egress flow path. In some embodiments, the valve assembly includes a valve body configured to selectively permit fluid communication between the first fuel input and the first fuel output or between the second fuel input and the first fuel output, between the third fuel input and the first egress flow path or between the third fuel input and the second egress flow path, and between the fourth fuel input and the second fuel output or between the fourth fuel input and the third fuel output.

BRIEF DESCRIPTION OF THE DRAWINGS

Various embodiments are depicted in the accompanying drawings for illustrative purposes, and should in no way be interpreted as limiting the scope of the inventions.

DETAILED DESCRIPTION OF THE PREFERRED EMBODIMENTS

Figure 1:
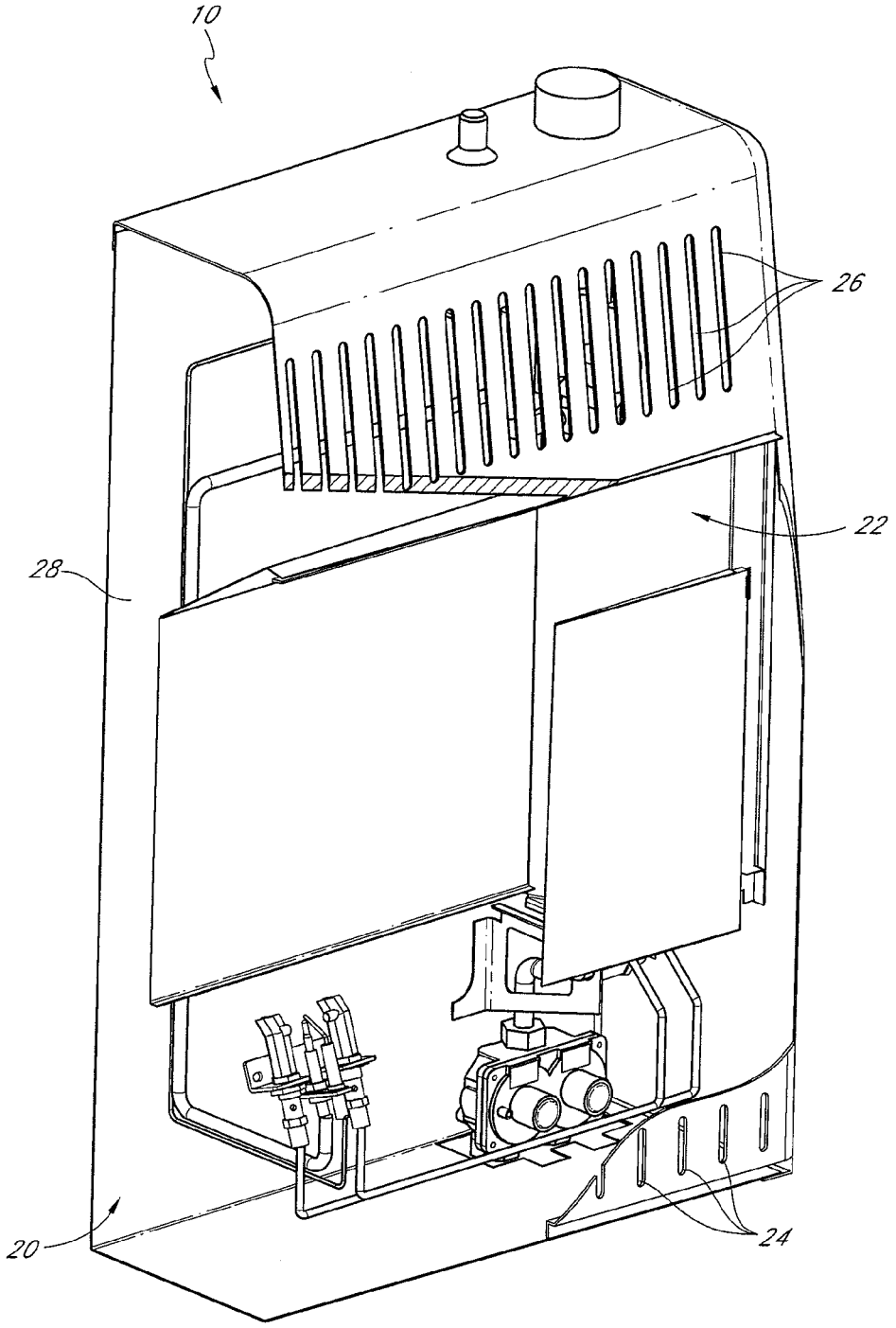
FIG. 1 is a perspective cutaway view of a portion of an embodiment of a heater configured to operate using a first fuel source or a second fuel source.

Many varieties of space heaters, fireplaces, fireplace inserts, gas log sets, heating stoves, cooking stoves, barbecue grills, water heaters, and other flame-producing and/or heat-producing devices employ combustible fluid fuels, such as liquid propane gas and natural gas. The term "fluid," as used herein, is a broad term used in its ordinary sense, and includes materials or substances capable of fluid flow, such as, for example, one or more gases, one or more liquids, or any combination thereof. Fluid-fueled units, such as those listed above, generally are designed to operate with a single fluid fuel type at a specific pressure or within a range of pressures. For example, some fluid-fueled heaters that are configured to be installed on a wall or a floor operate with natural gas at a pressure in a range from about 3 inches of water column to about 6 inches of water column, while others are configured to operate with propane at a pressure in a range from about 8 inches of water column to about 12 inches of water column.

Similarly, many other varieties of fluid-fueled units, such as gas fireplaces, gas fireplace inserts, gas log sets, gas stoves, gas barbecue grills, gas water heaters, and other flame-producing and/or heat-producing devices are configured to operate with natural gas at a first pressure, while others are configured to operate with liquid propane gas at a second pressure that is different from the first pressure. As used herein, the terms "first" and "second" are used for convenience, and do not connote a hierarchical relationship among the items so identified, unless otherwise indicated.

In many instances, the operability of such fluid-fueled units with only a single fuel source is disadvantageous for distributors, retailers, and/or consumers. For example, retail stores often try to predict the demand for natural gas units versus liquid propane units over a given period of time, and consequently stock their shelves and/or warehouses with a percentage of each variety of unit. If such predictions prove incorrect, stores can be left with unsold units when the demand for one type was less than expected. On the other hand, some potential customers can be left waiting through shipping delays or even be turned away empty-handed when the demand for one type of unit was greater than expected. Either case can result in financial and other costs to the stores.

Additionally, consumers can be disappointed to discover that the styles or models of heaters, fireplaces, stoves, or other fluid-fueled units with which they wish to furnish their homes are incompatible with the type of fuel with which their homes are serviced. This situation can result in inconveniences and other costs to the consumers.

Furthermore, in many instances, fluid-fueled units can be relatively expensive, and further, can be relatively difficult and/or expensive to transport and/or install. For example, some fluid-fueled devices can sell for thousands of dollars, not including installation fees. In many instances, such devices include a variety of interconnected components and detailed instructions regarding proper installation techniques. Often, the installed units must be in compliance with various building codes and legal regulations. Accordingly, the units generally must be installed by a qualified professional, and often are installed during construction or remodeling of a home or other structure.

Accordingly, a change in the type of fuel with which a structure is serviced can result in a significant expense and inconvenience to the owner of the structure. Often, the owner must replace one or more units that are configured to operate on the old fuel type with one or more units that are configured to operate on the new fuel type. Such changes in fuel servicing are not uncommon. For example, some new housing subdivisions are completed before natural gas mains can be installed. As a result, the new houses may originally be serviced by localized, refillable liquid propane tanks. As a result, appliances and other fluid-fueled units that are configured to operate on propane may originally be installed in the houses and then might be replaced when natural gas lines become available.

Therefore, there is a need for fluid-fueled devices, and components thereof, that are configured to operate with more than one fuel source (e.g., with either a natural gas or a liquid propane fuel source). Such devices could alleviate and/or resolve at least the foregoing problems. Furthermore, fluid-fueled devices, and components thereof, that can transition among operational states in a simple manner are also desirable.

In addition, in some instances, the appearance of a flame produced by certain embodiments of fluid-fueled units is important to the marketability of the units. For example, some gas fireplaces and gas fireplace inserts are desirable as either replacements for or additions to natural wood-burning fireplaces. Such replacement units can desirably exhibit enhanced efficiency, improved safety, and/or reduced mess. In many instances, a flame produced by such a gas unit desirably resembles that produced by burning wood, and thus preferably has a substantially yellow hue.

Certain embodiments of fluid-fueled units can produce substantially yellow flames. The amount of oxygen present in the fuel at a combustion site of a unit (e.g., at a burner) can affect the color of the flame produced by the unit. Accordingly, in some embodiments, one or more components the unit are adjusted to regulate the amount of air that is mixed with the fuel to create a proper air/fuel mixture at the burner. Such adjustments can be influenced by the pressure at which the fuel is dispensed.

A particular challenge in developing some embodiments of fluid-fueled units that are operable with more than one fuel source (e.g., operable with a natural gas or a liquid propane fuel source) arises from the fact that different fuel sources are generally provided at different pressures. Additionally, in many instances, different fuel types require different amounts of oxygen to create a substantially yellow flame. Certain advantageous embodiments disclosed herein provide structures and methods for configuring a fluid-fueled device to produce a yellow flame using any of a plurality of different fuel sources, and in further embodiments, for doing so with relative ease.

Certain embodiments disclosed herein reduce or eliminate one or more of the foregoing problems associated with existing fluid-fueled devices and/or provide some or all of desirable features detailed above. Although specific embodiments are discussed herein in several contexts, it should be understood that certain features, principles, and/or advantages described are applicable in a much wider variety of contexts, including but not limited to gas logs, fireplaces, fireplace inserts, heaters, heating stoves, cooking stoves, barbecue grills, water heaters, and any flame-producing and/or heat-producing fluid-fueled units, including without limitation units that include a burner of any suitable variety.

FIG. 1 illustrates an embodiment of a heater 10. In various embodiments, the heater 10 is a vent-free infrared heater, a vent-free blue flame heater, or some other variety of heater, such as a direct vent heater. In some embodiments, the heater 10 can comprise any suitable fluid-fuel burning unit, such as, for example, a fireplace, fireplace insert, heating stove, cooking stove, barbecue grill, or water heater. Other configurations are also possible for the heater 10. In many embodiments, the heater 10 is configured to be mounted to a wall or a floor or to otherwise rest in a substantially static position. In other embodiments, the heater 10 is configured to move within a limited range. In still other embodiments, the heater 10 is portable.

In certain embodiments, the heater 10 comprises a housing 20. The housing 20 can include metal or some other suitable material for providing structure to the heater 10 without melting or otherwise deforming in a heated environment. In some embodiments, the housing 20 comprises a window 22 through which heated air and/or radiant energy can pass. In further embodiments, the housing 20 comprises one or more intake vents 24 through which air can flow into the heater 10. In some embodiments, the housing 20 comprises outlet vents 26 through which heated air can flow out of the heater 10. In some embodiments, the housing 20 includes a rear panel 28.

Figure 2:
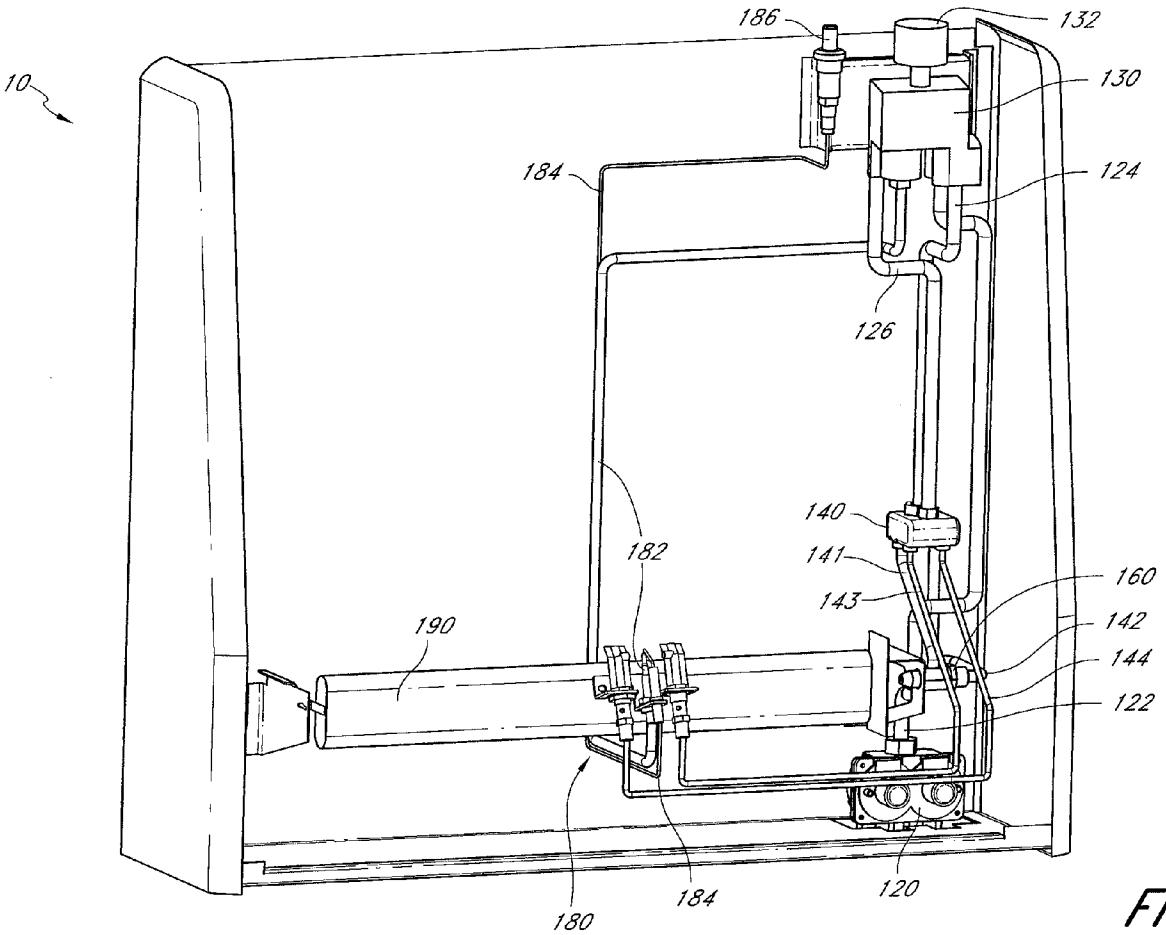
FIG. 2 is a perspective cutaway view of the heater of FIG. 1.

With reference to FIG. 2, in certain embodiments, the heater 10 includes a regulator 120. In some embodiments, the regulator 120 is coupled with an output line or intake line, intake conduit, or intake pipe 122. The intake pipe 122 can be coupled with a fuel consumption regulator, a flow control unit, or a control valve 130, which, in some embodiments, includes a knob 132. In many embodiments, the heater control valve 130 is coupled to a fuel supply pipe 124 and a pilot assembly pipe or an oxygen depletion sensor (ODS) pipe 126, each of which can be coupled with a fluid flow controller 140. In some embodiments, the fluid flow controller 140 is coupled with a first nozzle line 141, a second nozzle line 142, a first ODS line 143, and a second ODS line 144. In some embodiments, the first and the second nozzle lines 141, 142 are coupled with a nozzle 160, and the first and the second ODS lines 143, 144 are coupled with a pilot assembly, such as an oxygen depletion sensor 180. In some embodiments, the ODS comprises a thermocouple 182, which can be coupled with the heater control valve 130, and an igniter line 184, which can be coupled with an igniter switch 186. Each of the lines, conduits, or pipes 122, 124, and 126 and the lines 141-144, or any other pipe, line, conduit, tube, or other such conveyance can define a fluid path, fluid passageway, flow path, or flow channel through which a fluid can move or flow. In various embodiments, the thermocouple 182 and igniter line 184 can include any suitable electrical conductor, such as a metal, and may further be insulated.

In some embodiments, the heater 10 comprises a burner or combustion chamber 190. In some embodiments, the ODS 180 is mounted to the combustion chamber 190, as shown in the illustrated embodiment. In further embodiments, the nozzle 160 is positioned to discharge a fluid fuel into the combustion chamber 190.

In certain embodiments, either a first or a second fluid is introduced into the heater 10 through the regulator 120. In some embodiments, the first or the second fluid proceeds from the regulator 120 through the intake pipe 122 to the heater control valve 130. In some embodiments, the heater control valve 130 can permit a portion of the first or the second fluid to flow into the fuel supply pipe 124 and permit another portion of the first or the second fluid to flow into the ODS pipe 126, as described in further detail below.

In certain embodiments, the first or the second fluid can proceed to the fluid flow controller 140. In many embodiments, the fluid flow controller 140 is configured to channel the respective portions of the first fluid from the fuel supply pipe 124 to the first nozzle line 141 and from the ODS pipe 126 to the first ODS line 143 when the fluid flow controller 140 is in a first state, and is configured to channel the respective portions of the second fluid from the fuel supply pipe 124 to the second nozzle line 142 and from the ODS pipe 126 to the second ODS line 144 when the fluid flow controller 140 is in a second state.

In certain embodiments, when the fluid flow controller 140 is in the first state, a portion of the first fluid proceeds through the first nozzle line 141, through the nozzle 160 and is delivered to the combustion chamber 190, and a portion of the first fluid proceeds through the first ODS line 143 to the ODS 180. Similarly, when the fluid flow controller 140 is in the second state, a portion of the second fluid proceeds through the nozzle 160 and another portion proceeds to the ODS 180. As discussed in more detail below, other configurations are also possible.

Figure 3:
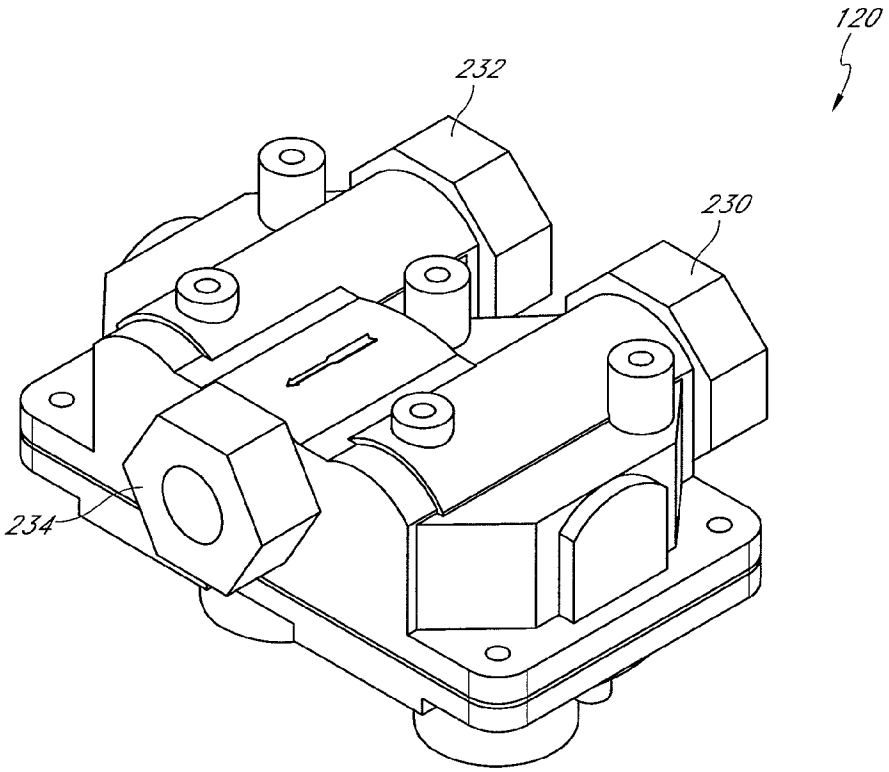
FIG. 3 is a bottom perspective view of an embodiment of a pressure regulator configured to couple with the first fuel source or the second fuel source.

With reference to FIG. 3, in certain embodiments, the regulator 120 can be configured to selectively receive either a first fluid fuel (e.g., natural gas) from a first source at a first pressure or a second fluid fuel (e.g., propane) from a second source at a second pressure. In certain embodiments, the regulator 120 includes a first input port 230 for receiving the first fuel and a second input port 232 for receiving the second fuel. In some embodiments, the second input port 232 is configured to be plugged when the first input port 230 is coupled with the first fuel source, and the first input port 230 is configured to be plugged when the second input port 232 is coupled with a second fuel source.

The regulator 120 can define an output port 234 through which fuel exits the regulator 120. Accordingly, in many embodiments, the regulator 120 is configured to operate in a first state in which fuel is received via the first input port 230 and delivered to the intake pipe 122 via the output port 234, and is configured to operate in a second state in which fuel is received via the second input port 232 and delivered to the intake pipe 122 via the output port 234. In certain embodiments, the regulator 120 is configured to regulate fuel entering the first port 230 such that fuel exiting the output port 234 is at a relatively steady first pressure, and is configured to regulate fuel entering the second port 232 such that fuel exiting the output port 234 is at a relatively steady second pressure. Various embodiments of regulators 120 compatible with certain embodiments of the fuel delivery system 40 described herein are disclosed in U.S. patent application Ser. No. 11/443,484, titled PRESSURE REGULATOR, filed May 30, 2006, the entire contents of which are hereby incorporated by reference herein and made a part of this specification.

As noted above, in certain embodiments, the regulator 120 is configured to allow passage therethrough of either a first or a second fuel. In certain embodiments, the first or the second fuel passes through the intake pipe 122 to the heater control valve 130.

Figure 4:
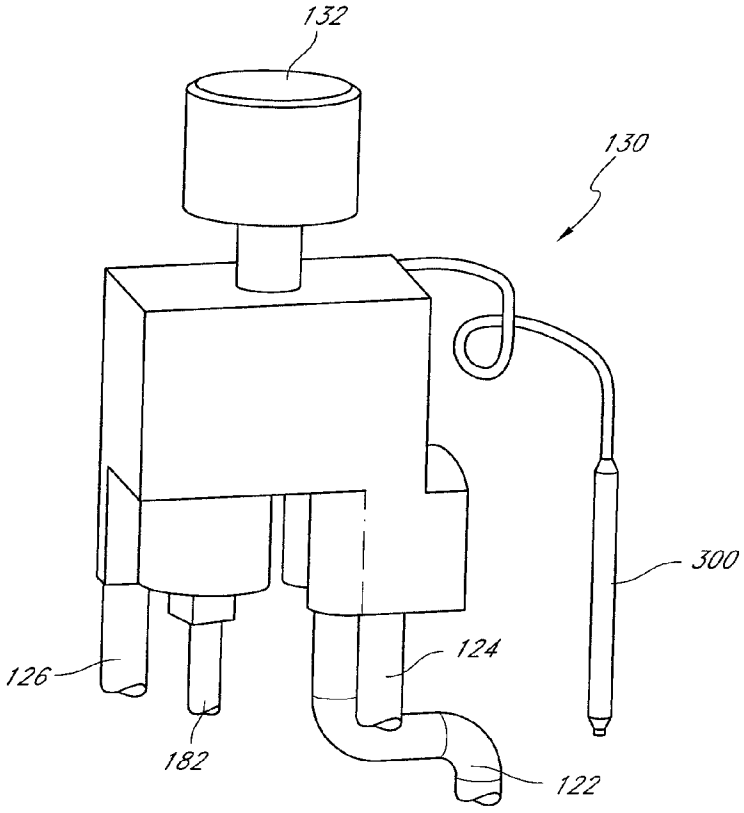
FIG. 4 is a perspective view of an embodiment of a control valve.

With reference to FIG. 4, in certain embodiments, the heater control valve 130 includes the knob 132. The heater control valve 130 can be coupled with the intake pipe 122, the fuel supply pipe 124 and the ODS pipe 126. In certain embodiments, the heater control valve 130 is coupled with the ODS thermocouple 182. In further embodiments, the heater control valve 130 comprises a temperature sensor 300.

In some embodiments, the heater control valve 130 allows a portion of the first or the second fuel to pass from the intake pipe 122 to the fuel supply pipe 124 and another portion to pass to the ODS pipe 126. In certain embodiments, the amount of fuel passing through the heater control valve 130 is influenced by the settings of the knob 132 and/or the functioning of the thermocouple 182. In some embodiments, the knob 132 is rotated by a user to select a desired temperature. Based on the temperature selected by the user and the temperature sensed by the temperature sensor 300, the heater control valve 130 can allow more or less fuel to pass to the fuel supply pipe 124.

Furthermore, as discussed below, when a pilot light of the ODS heats the thermocouple 182, a current is generated in the thermocouple 182. In certain embodiments, this current produces a magnetic field within the heater control valve 130 that maintains the valve 130 in an open position. If the pilot light goes out or is disturbed, and the current flow is reduced or terminated, the magnetic field weakens or is eliminated, and the valve 130 closes, thereby preventing passage therethrough of the first or the second fuel.

Figure 5:
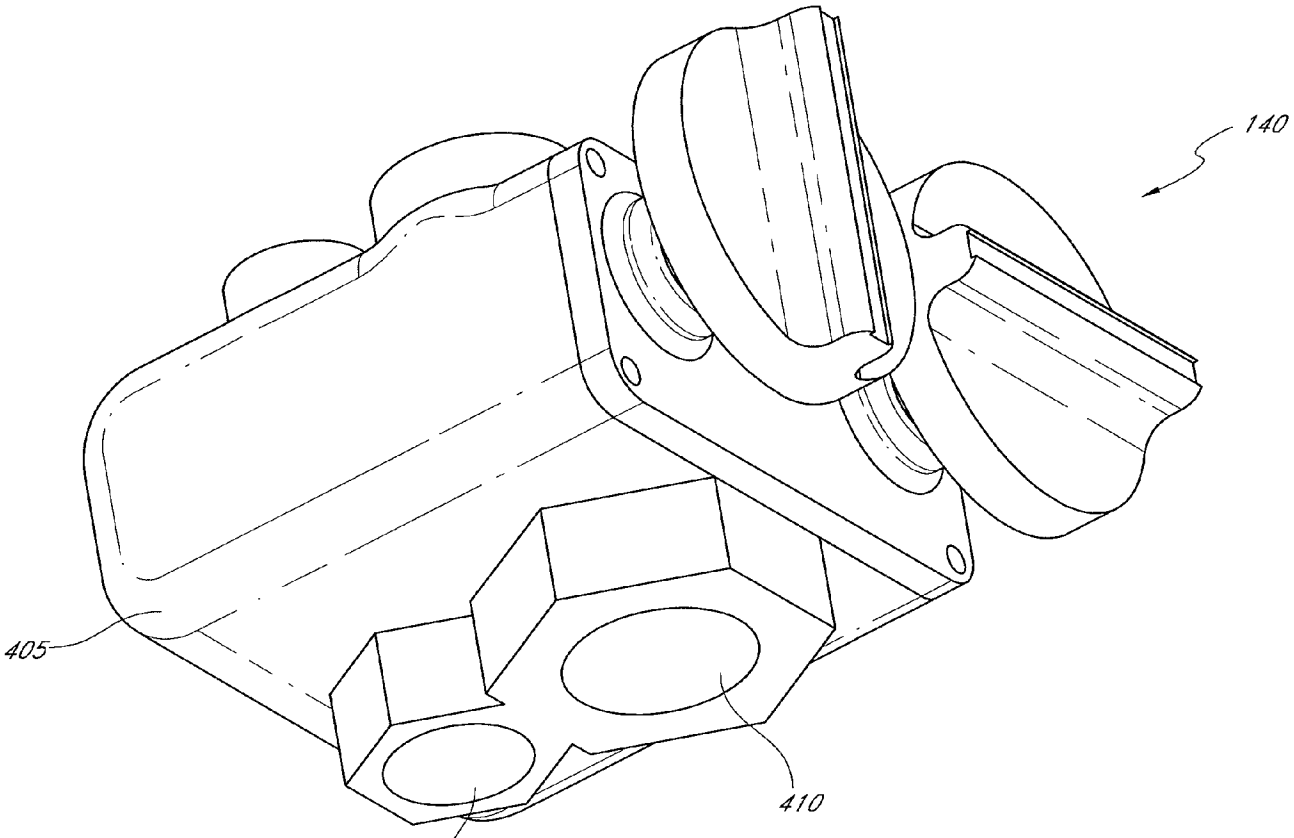
FIG. 5 is a perspective view of an embodiment of a fluid flow controller comprising two valves.

With reference to FIG. 5, in certain embodiments, the first or the second fuel allowed through the heater control valve 130 proceeds to the fluid flow controller 140. In certain embodiments, the controller 140 comprises a housing 405, a first inlet 410, and a second inlet 420. In some embodiments, the first inlet 410 is configured to couple with the fuel supply pipe 124 and the second inlet 420 is configured to couple with the ODS pipe 126.

Figure 6:
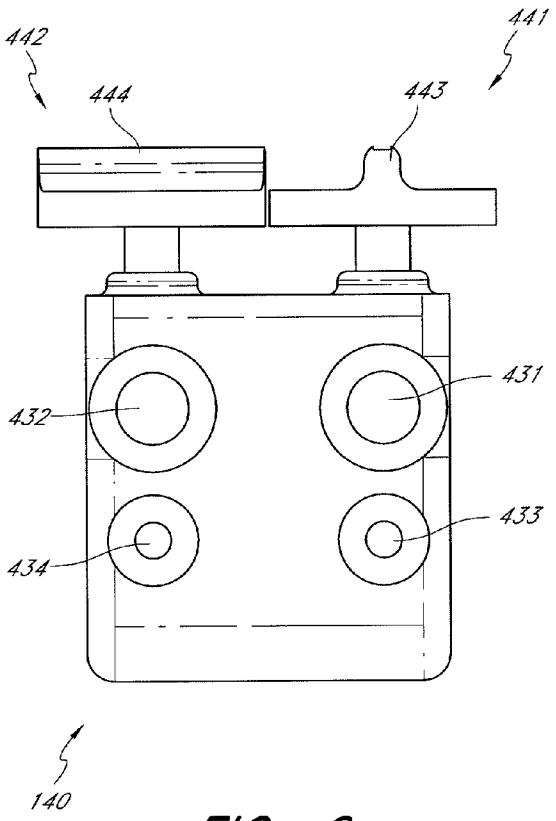
FIG. 6 is a bottom plan view of the fluid flow controller of FIG. 5.

With reference to FIG. 6, in certain embodiments, the fluid flow controller 140 comprises a first fuel supply outlet 431, and a second fuel supply outlet 432, a first ODS outlet 433, a second ODS outlet 434. In some embodiments, the fluid flow controller 140 further comprises a first selector valve 441 and a second selector valve 442. In some embodiments, a first selector control or knob 443 is coupled to the first selector valve 441 and a second selector knob 444 is coupled to the second selector valve 442.

Figure 7:
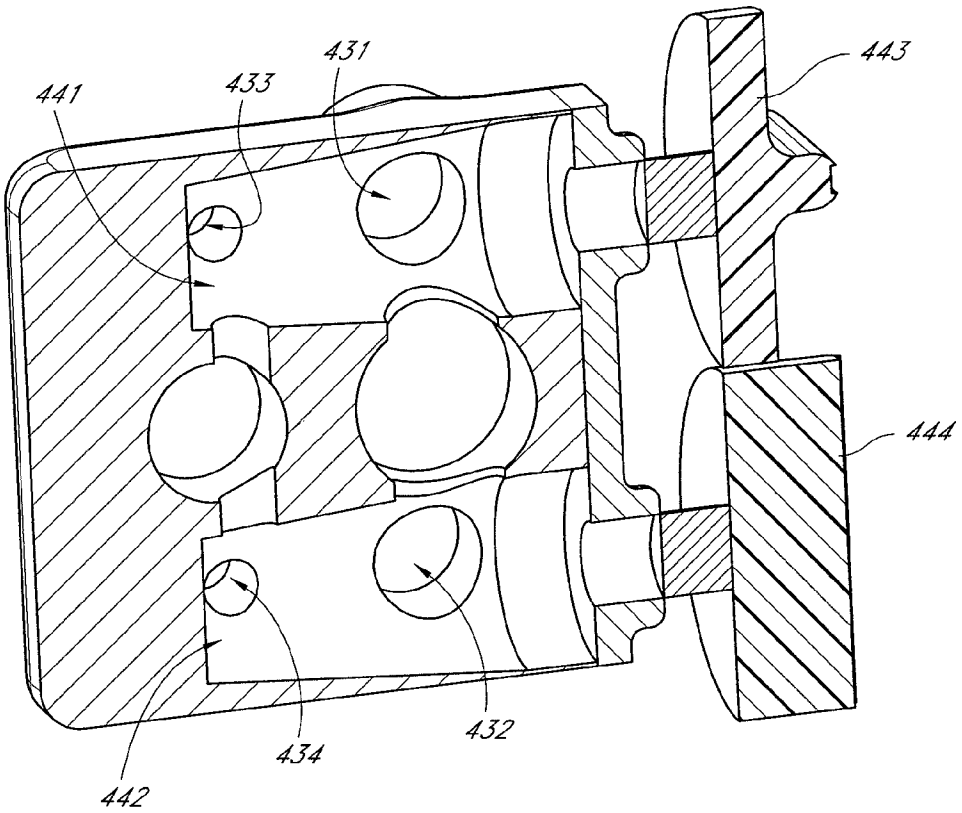
FIG. 7 is a cross-sectional view of the fluid flow controller of FIG. 5.

With reference to FIG. 7, in some embodiments, one of the first and second selector valves 441, 442 can be rotated within the housing via the first or second selector knob 443, 444, respectively. In some embodiments, the second selector valve 442 is closed and the first selector valve 441 is opened such that fluid flowing through the fuel supply pipe 124 proceeds to the first fuel supply outlet 431 and into the first nozzle line 141 and fluid flowing through the ODS pipe 126 proceeds to the first ODS outlet 433 and into the first ODS line 143. In other embodiments, the first selector valve 441 is closed and the second selector valve 442 is opened such that fluid flowing through the fuel supply pipe 124 proceeds to the second fuel supply outlet 432 and into the second nozzle line 142 and fluid flowing through the ODS pipe 126 proceeds to the second ODS outlet 434 and into the second ODS line 144. Accordingly, in certain embodiments, the fluid flow controller 140 can direct a first fluid to a first set of pipes 141, 143 leading to the nozzle 160 and the ODS 180, and can direct a second fluid to a second set of pipes 142, 144 leading to the nozzle 160 and the ODS 180.

Figure 8:
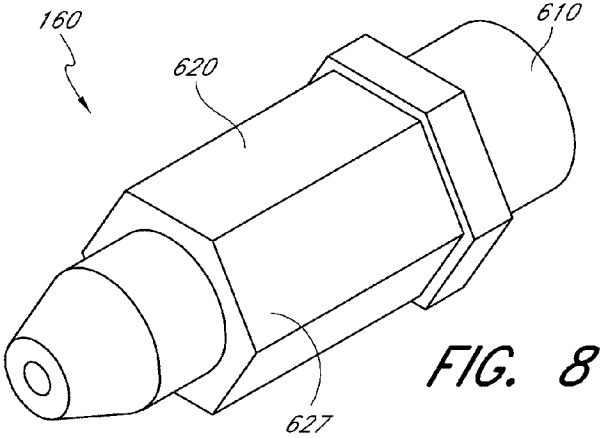
FIG. 8 is a perspective view of an embodiment of a nozzle comprising two inputs and two outputs.

With reference to FIG. 8, in certain embodiments, the nozzle 160 comprises an inner tube 610 and an outer tube 620. The inner tube 610 and the outer tube 620 can cooperate to form a body of the nozzle 160. In some embodiments, the inner tube 610 and the outer tube 620 are separate pieces joined in substantially airtight engagement. For example, the inner tube 610 and the outer tube 620 can be welded, glued, secured in threaded engagement, or otherwise attached or secured to each other. In other embodiments, the inner tube 610 and the outer tube 620 are integrally formed of a unitary piece of material. In some embodiments, the inner tube 610 and/or the outer tube 620 comprises a metal.

Figure 9:
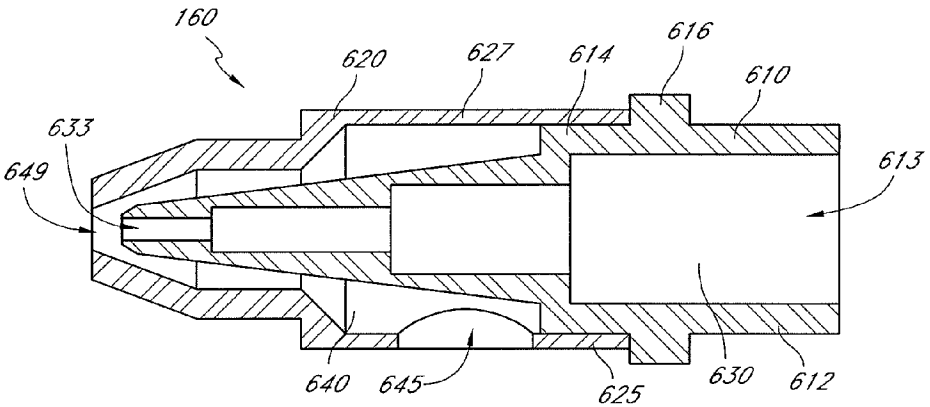
FIG. 9 is a cross-sectional view of the nozzle of FIG. 8 taken along the line 9-9 in FIG. 10.
Figure 10:
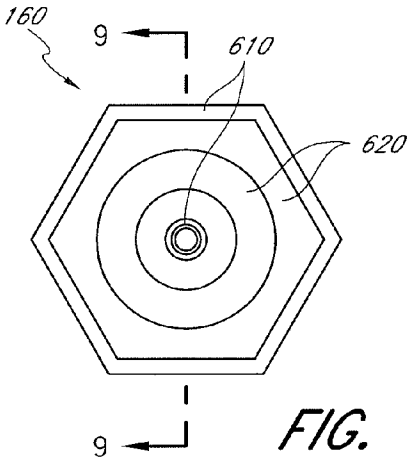
FIG. 10 is a top plan view of the nozzle of FIG. 8.

As illustrated in FIG. 9, in certain embodiments, the inner tube 610 and the outer tube 620 are elongated, substantially hollow structures. In some embodiments, a portion of the inner tube 610 extends inside the outer tube 620. As illustrated in FIGS. 9 and 10, in some embodiments, the inner tube 610 and the outer tube 620 can be substantially coaxial in some embodiments, and can be axially symmetric.

With continued reference to FIG. 9, in some embodiments, the inner tube 610 comprises a connector sheath 612. The connector sheath 612 can comprise an inlet 613 having an area through which a fluid can flow. In some embodiments, the connector sheath 612 is configured to couple with the second nozzle line 142, preferably in substantially airtight engagement. In some embodiments, an inner perimeter of the connector sheath 612 is slightly larger than an outer perimeter of the second nozzle line 142 such that the connector sheath 612 can seat snugly over the second nozzle line 142. In some embodiments, the connector sheath 612 is welded to the second nozzle line 142. In other embodiments, an interior surface of the connector sheath 612 is threaded for coupling with a threaded exterior surface of the second nozzle line 142. In still other embodiments, the second nozzle line 142 is configured to fit over the connector sheath 612.

In certain embodiments, the connector sheath 612 comprises a distal portion 614 that is configured to couple with the outer tube 620. In some preferred embodiments, each of the distal portion 614 of the inner tube 620 and a proximal portion 625 of the outer tube 620 comprises threads. Other attachment configurations are also possible.

In certain embodiments, the nozzle 160 comprises a flange 616 that extends from the connector sheath 612. In some embodiments, the flange 616 is configured to be engaged by a tightening device, such as a wrench, which can aid in securing the inner tube 610 to the outer tube 620 and/or in securing the nozzle 160 to the second nozzle line 142. In some embodiments, the flange 616 comprises two or more substantially flat surfaces, and in other embodiments, is substantially hexagonal (as shown in FIGS. 8 and 10).

In further embodiments, the outer tube 620 comprises a shaped portion 627 that is configured to be engaged by a tightening device, such as a wrench. In some embodiments, the shaped portion 627 is substantially hexagonal. In certain embodiments, the shaped portion 627 of the outer tube 620 and the flange 616 of the inner tube 610 can each be engaged by a tightening device such that the outer tube 620 and the inner tube 610 rotate in opposite directions about an axis of the nozzle 160.

In certain embodiments, the inner tube 610 defines a substantially hollow cavity or pressure chamber 630. The pressure chamber 630 can be in fluid communication with the inlet 613 and an outlet 633. In some embodiments, the outlet 633 defines an outlet area that is smaller than the area defined by the inlet 613. In preferred embodiments, the pressure chamber 630 decreases in cross-sectional area toward a distal end thereof. In some embodiments, the pressure chamber 630 comprises two or more substantially cylindrical surfaces having different radii. In some embodiments, a single straight line is collinear with or runs parallel to the axis of each of the two or more substantially cylindrical surfaces.

In some embodiments, the outer tube 620 substantially surrounds a portion of the inner tube 610. The outer tube 620 can define an outer boundary of a hollow cavity or pressure chamber 640. In some embodiments, an inner boundary of the pressure chamber 640 is defined by an outer surface of the inner tube 610. In some embodiments, an outer surface of the pressure chamber 640 comprises two or more substantially cylindrical surfaces joined by substantially sloped surfaces therebetween. In some embodiments, a single straight line is collinear with or runs parallel to the axis of each of the two or more substantially cylindrical surfaces.

In preferred embodiments, an inlet 645 and an outlet 649 are in fluid communication with the pressure chamber 640. In some embodiments, the inlet 645 extends through a sidewall of the outer tube 620. Accordingly, in some instances, the inlet 645 generally defines an area through which a fluid can flow. In some embodiments, the direction of flow of the fluid through the inlet 645 is nonparallel with the direction of flow of a fluid through the inlet 613 of the inner tube 610. In some embodiments, an axial line through the inlet 645 is at an angle with respect to an axial line through the inlet 613. The inlet 645 can be configured to be coupled with the first nozzle line 141, preferably in substantially airtight engagement. In some embodiments, an inner perimeter of the inlet 645 is slightly larger than an outer perimeter of the first nozzle line 141 such that the inlet 645 can seat snugly over the first nozzle line 141. In some embodiments, the outer tube 620 is welded to the first nozzle line 141.

In certain embodiments, the outlet 649 of the outer sheath 620 defines an area smaller than the area defined by the inlet 645. In some embodiments, the area defined by the outlet 649 is larger than the area defined by the outlet defined by the outlet 613 of the inner tube 610. In some embodiments, the outlet 613 of the inner tube 610 is within the outer tube 620. In other embodiments, the inner tube 610 extends through the outlet 649 such that the outlet 613 of the inner tube 610 is outside the outer tube 620.

In certain embodiments, a fluid exits the second nozzle line 142 and enters the pressure chamber 630 of the inner tube 610 through the inlet 613. The fluid proceeds through the outlet 633 to exit the pressure chamber 630. In some embodiments, the fluid further proceeds through a portion of the pressure chamber 640 of the outer tube 620 before exiting the nozzle 160 through the outlet 649.

In other embodiments, a fluid exits the first nozzle line 142 and enters the pressure chamber 640 of the outer tube 620 through the inlet 645. The fluid proceeds through the outlet 633 to exit the pressure chamber 640 and, in many embodiments, exit the nozzle 160. In certain embodiments, a fluid exiting the second nozzle line 142 and traveling through the pressure chamber 630 is at a higher pressure than a fluid exiting the first nozzle line 141 and traveling through the pressure chamber 640. In some embodiments, liquid propane travels through the pressure chamber 630, and in other embodiments, natural gas travels through the pressure chamber 640.

In some embodiments, the nozzle can be configured such that the fuel is dispensed from the inner tube 610 at a first pressure, and is dispensed through both the inner and outer tubes 610, 620 at a second pressure. In those embodiments, the inner flow channel 610 can be configured to dispense propane at the first pressure, and the inner and outer flow channels 610,620 can be configured to dispense natural gas at the second pressure.

Figure 11:
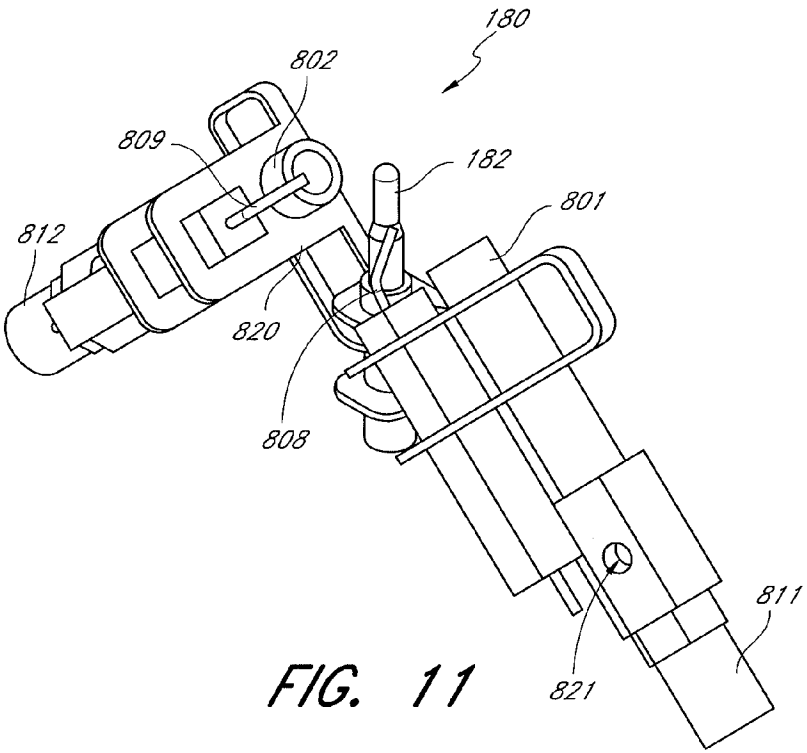
FIG. 11 is a perspective view of an embodiment of an oxygen depletion sensor comprising two injectors and two nozzles.
Figure 12:
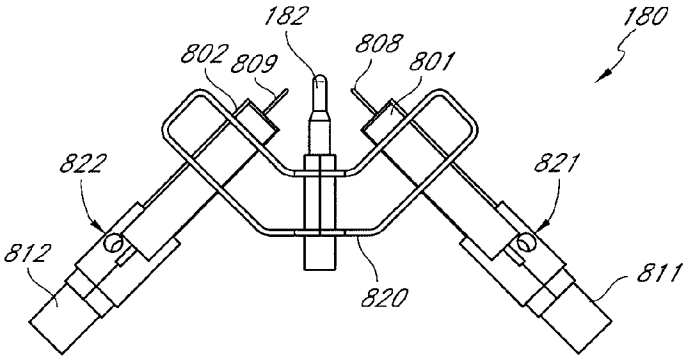
FIG. 12 is a front plan view of the oxygen depletion sensor of FIG. 11.
Figure 13:
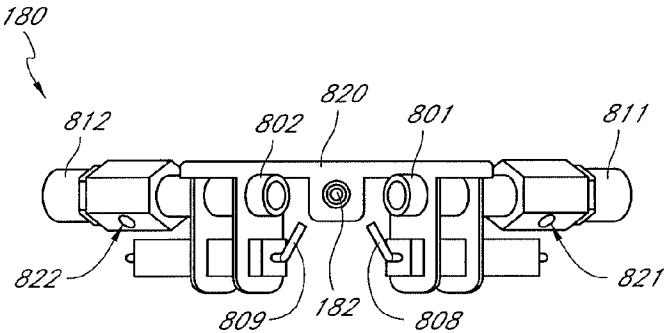
FIG. 13 is a top plan view of the oxygen depletion sensor of FIG. 11.

With reference to FIGS. 11-13, in certain embodiments, the ODS 180 comprises a thermocouple 182, a first nozzle 801, a second nozzle 802, a first electrode 808, and a second electrode 809. In further embodiments, the ODS 180 comprises a first injector 811 coupled with the first ODS line 143 (see FIGS. 1 and 2) and the first nozzle 801 and a second injector 812 coupled with the second ODS line 144 (see FIGS. 1 and 2) and the second nozzle 802. In many embodiments, the first and second injectors 811, 812 are standard injectors as are known in the art, such as injectors that can be utilized with liquid propane or natural gas. In some embodiments, the ODS 180 comprises a frame 820 for positioning the constituent parts of the ODS 180.

In some embodiments, the first nozzle 801 and the second nozzle 802 are directed toward the thermocouple such that a stable flame exiting either of the nozzles 801, 802 will heat the thermocouple 182. In certain embodiments, the first nozzle 801 and the second nozzle 802 are directed to different sides of the thermocouple 182. In some embodiments, the first nozzle 801 and the second nozzle 802 are directed to opposite sides of the thermocouple 182. In some embodiments, the first nozzle 801 is spaced at a greater distance from the thermocouple than is the second nozzle 802.

In some embodiments, the first nozzle 801 comprises a first air inlet 821 at a base thereof and the second nozzle 802 comprises a second air inlet 822 at a base thereof. In various embodiments, the first air inlet 821 is larger or smaller than the second air inlet 822. In many embodiments, the first and second injectors 811, 812 are also located at a base of the nozzles 801, 802. In certain embodiments, a gas or a liquid flows from the first ODS line 143 through the first injector 811, through the first nozzle 801, and toward the thermocouple 182. In other embodiments, a gas or a liquid flows from the second ODS line 144 through the second injector 812, through the second nozzle 802, and toward the thermocouple 182. In either case, the fluid flows near the first or second air inlets 821, 822, thus drawing in air for mixing with the fluid. In certain embodiments, the first injector 811 introduces a fluid into the first nozzle 801 at a first flow rate, and the second injector 812 introduces a fluid into the second nozzle 802 at a second flow rate. In various embodiments, the first flow rate is greater than or less than the second flow rate.

In some embodiments, the first electrode 808 is positioned at an approximately equal distance from an output end of the first nozzle 801 and an output end of the second nozzle 802. In some embodiments, a single electrode is used to ignite fuel exiting either the first nozzle 801 or the second nozzle 802. In other embodiments, a first electrode 808 is positioned closer to the first nozzle 801 than to the second nozzle 802 and the second electrode 809 is positioned nearer to the second nozzle 802 than to the first nozzle 801.

In some embodiments, a user can activate the electrode by depressing the igniter switch 186 (see FIG. 2). The electrode can comprise any suitable device for creating a spark to ignite a combustible fuel. In some embodiments, the electrode is a piezoelectric igniter.

In certain embodiments, igniting the fluid flowing through one of the first or second nozzles 801, 802 creates a pilot flame. In preferred embodiments, the first or the second nozzle 801, 802 directs the pilot flame toward the thermocouple such that the thermocouple is heated by the flame, which, as discussed above, permits fuel to flow through the heat control valve 130.

Figure 14:
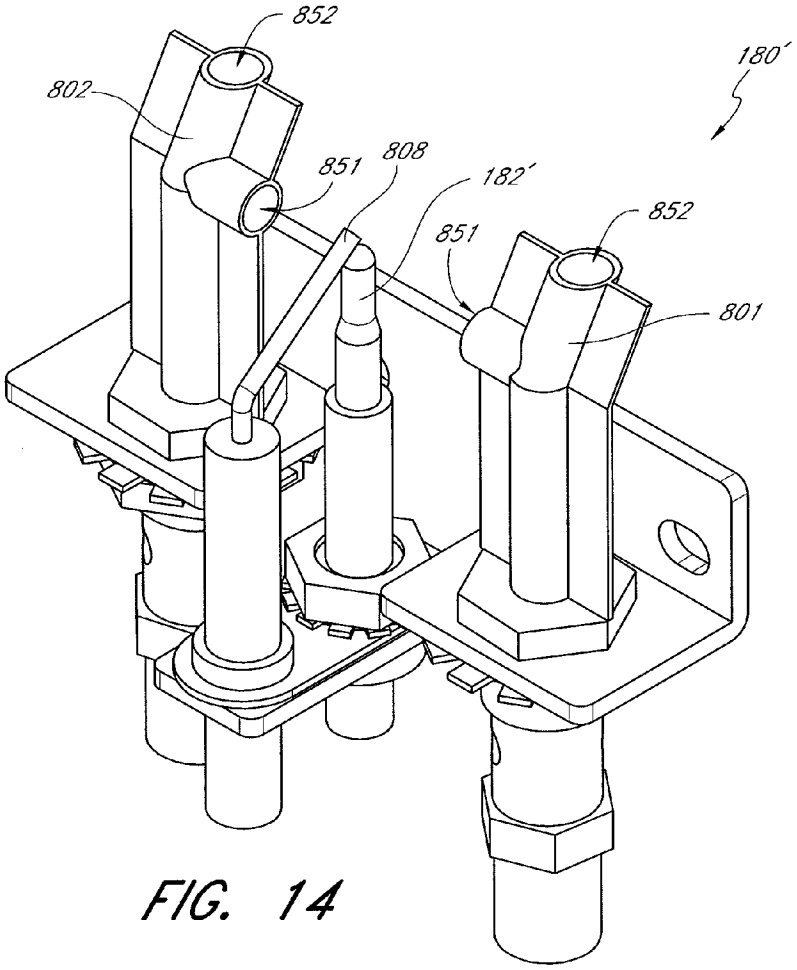
FIG. 14 is a perspective view of another embodiment of an oxygen depletion sensor comprising two injectors and two nozzles.

FIG. 14 illustrates another embodiment of the ODS 180'. In the illustrated embodiment, the ODS 180' comprises a single electrode 808. In the illustrated embodiment, each nozzle 801, 802 comprises an first opening 851 and a second opening 852. In certain embodiments, the first opening 851 is directed toward a thermocouple 182', and the second opening 852 is directed substantially away from the thermocouple 182'.

In various embodiments, the ODS 180, 180' provides a steady pilot flame that heats the thermocouple 182 unless the oxygen level in the ambient air drops below a threshold level. In certain embodiments, the threshold oxygen level is between about 18.0 percent and about 18.5 percent. In some embodiments, when the oxygen level drops below the threshold level, the pilot flame moves away from the thermocouple, the thermocouple cools, and the heater control valve 130 closes, thereby cutting off the fuel supply to the heater 10.

Figure 15A:
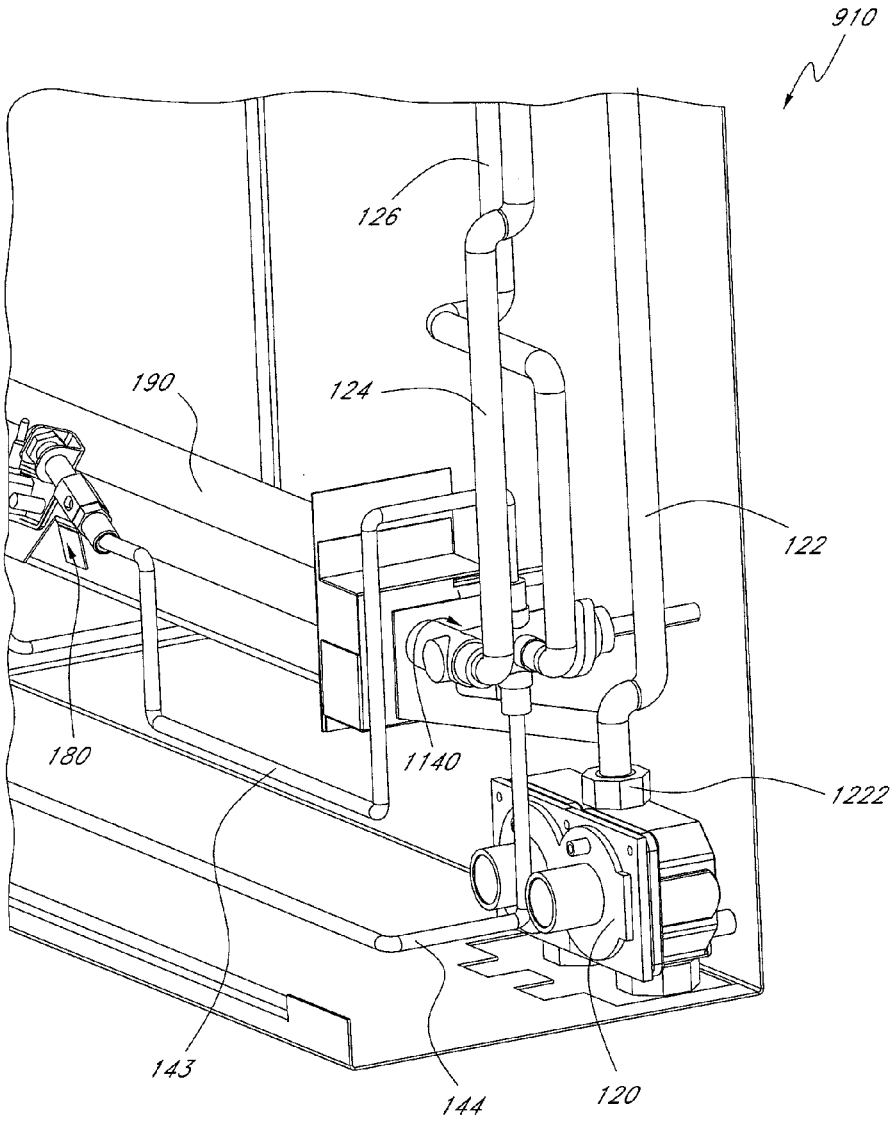
FIG. 15A is a perspective cutaway view of a portion of another embodiment of a heater configured to operate using a first fuel source or a second fuel source.
Figure 15B:
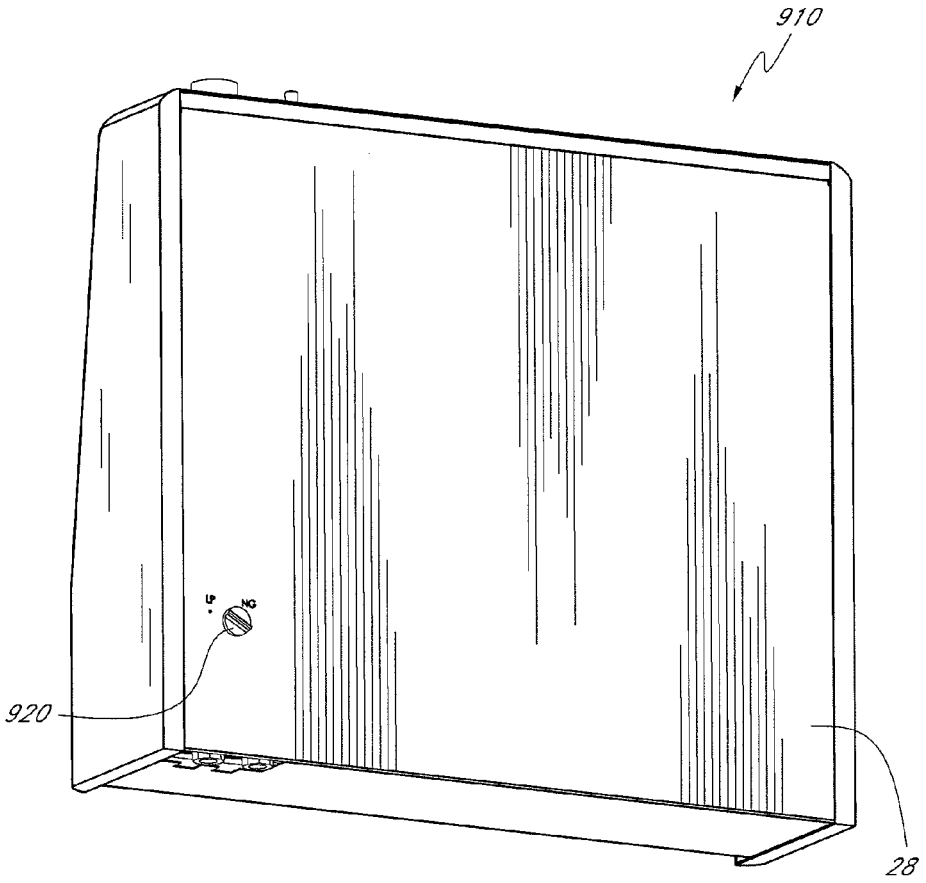
FIG. 15B is a rear perspective view of the heater of FIG. 15A.

FIGS. 15A and 15B illustrate an embodiment of a heater 910. The heater 910 can resemble the heater 10 in many respects, thus like features are identified with like numerals. In various embodiments, the heater 910 can differ from the heater 10 in other respects, such as those described hereafter.

With reference to FIG. 15A, in certain embodiments, the heater 910 includes a regulator 120, an intake pipe 122, a fuel supply pipe 124, an ODS pipe 126, a first ODS line 143, a second ODS line 144, an ODS 180, and/or a burner 190. The heater 910 can include a control valve, such as the control valve 130. In certain embodiments, the heater 910 includes a fluid flow controller or valve assembly 1140, which can include any suitable feature of and/or replace the fluid flow controller 140 of the heater 10. In certain embodiments, the valve assembly 1140 includes one or more fuel directors, fuel dispensers, or nozzle elements 1320, 1322 (see, e.g., FIG. 17), which can include any suitable feature of and/or replace the nozzle 160 of the heater 10.

In certain embodiments, the valve assembly 1140 is coupled with the fuel supply pipe 124 and the ODS pipe 126. As described below, in some embodiments, the valve assembly 1140 can be configured to direct fuel received from the ODS pipe 126 to either the first ODS line 143 or the second ODS line 144, and can be configured to direct fuel received from the fuel supply pipe 124 along different flow paths through one or more of the nozzle elements 1320, 1322 into the burner 190.

In some embodiments, the valve assembly 1140 eliminates the first nozzle line 141 and the second nozzle line 142 of the heater 10. Accordingly, in certain embodiments, the valve assembly 1140 can reduce the amount of material used to manufacture the heater 910, and thus can reduce manufacturing costs. As can readily be appreciated, modest savings in material costs for a single heater unit can amount to significant overall savings when such units are produced on a large scale.

In certain embodiments, either a first or a second fuel source is coupled with the regulator 120. In some embodiments, a first or a second fuel can proceed from the first or the second fuel source through the regulator 120. In some embodiments, the regulator 120 channels the first or the second fuel through the intake pipe 122 to the control valve 130. In some embodiments, the control valve 130 can permit a portion of the first or the second fuel to flow into the fuel supply pipe 124, and can permit another portion of the first or the second fuel to flow into the ODS pipe 126.

In some embodiments, the first or the second fuel can proceed to the valve assembly 1140. In many embodiments, the valve assembly 1140 is configured to operate in a first state or a second state. In some embodiments, the valve assembly 1140 directs fuel from the fuel supply pipe 124 along a first flow path through the nozzle 1320 into the burner 190 and directs fuel from the ODS pipe 126 to the first ODS line 143 when the valve assembly 1140 is in the first state. In further embodiments, the valve assembly 1140 is configured to channel fuel from the fuel supply pipe 124 along a second flow path through the nozzle 1320 into the burner 190 and from the ODS pipe 126 to the second ODS line 144 when the valve assembly 1140 is in the second state.

In some embodiments, when the valve assembly 1140 is in the first state, fuel flows through the first ODS line 143 to the ODS 180, where it is combusted. When the valve assembly 1140 is in the second state, fuel flows through the second ODS line 144 to the ODS 180, where it is combusted. In some embodiments, when the valve assembly 1140 is in either the first or second state fuel flows to the burner 190, where it is combusted.

With reference to FIG. 15B, in certain embodiments, the valve assembly 1140 is coupled with an actuator, selector, switch, or knob 920. In some embodiments, the knob 920 is positioned exterior the heater 910. In certain embodiments, the knob 920 can be moved, manipulated, rotated, or otherwise actuated to transition the valve assembly 1140 between the first and second operational states. In some embodiments, the knob 920 is rotated through an angle of no less than about 15 degrees, no less than about 30 degrees, no less than about 45 degrees, no less than about 60 degrees, no less than about 90 degrees, no less than about 120 degrees, no less than about 150 degrees, no less than about 180 degrees, or no less than about 270 degrees to transition the valve assembly 1140 between the first and second operational states. In some embodiments, the angle through which the knob 920 is rotated is about 90 degrees. Other rotational amounts are also possible.

Some embodiments described hereafter illustrate configurations of the valve assembly 1140 in which the knob 920 can be rotated through an angle of about 90 degrees to transition the valve assembly 1140 between the first and second operational states. It will be appreciated that various alterations to certain of such embodiments can be made, as appropriate, to achieve an amount of rotation between operational states that corresponds with any of the angle values identified above and/or any other suitable angle value.

Figure 16:
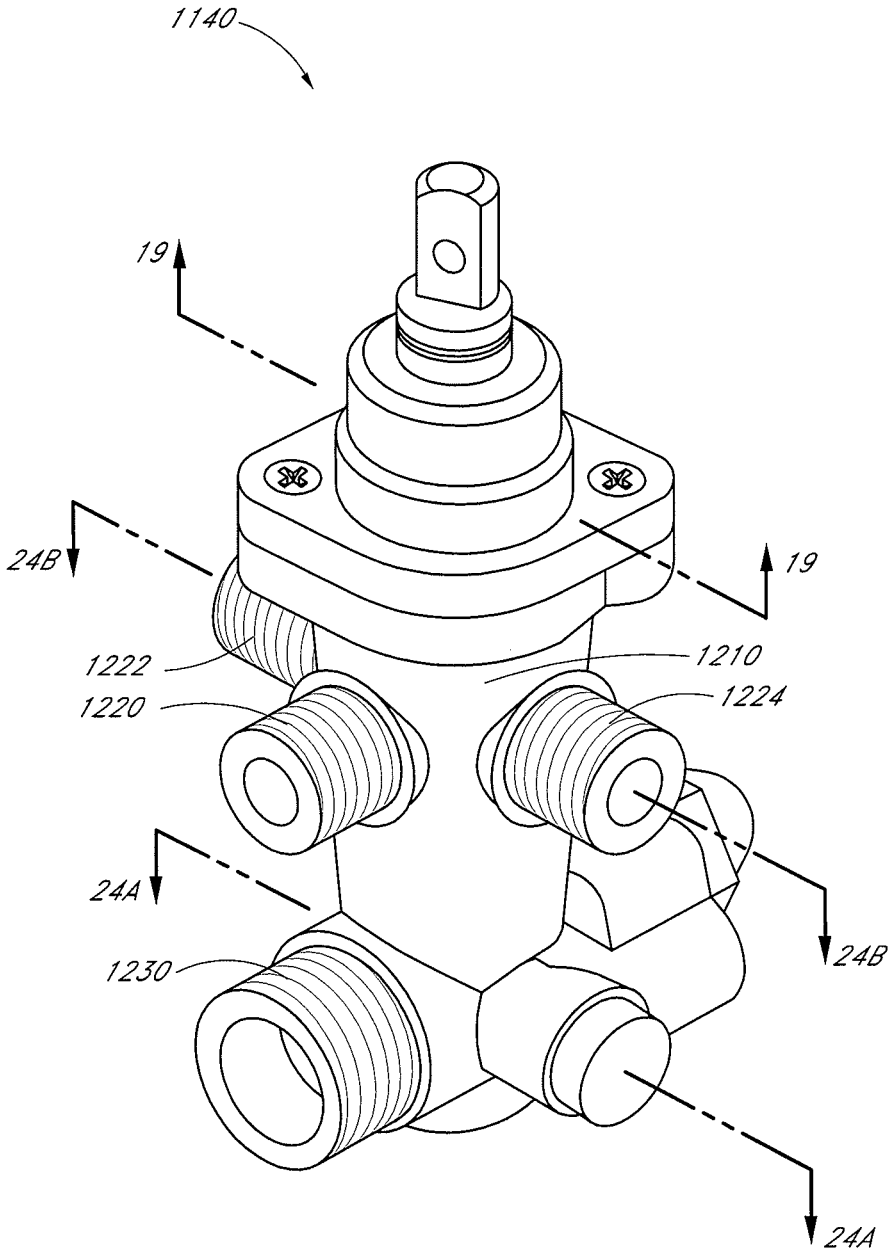
FIG. 16 is a perspective view of an embodiment of a valve assembly compatible with, for example, the heater of FIG. 15A.

With reference to FIG. 16, in certain embodiments, the valve assembly 1140 includes a housing 1210. The housing 1210 can comprise a unitary piece of material, or can comprise multiple pieces joined in any suitable manner. In certain embodiments, the housing 1210 defines one or more inlets, inputs, receiving ports, outlets, outputs, delivery ports, flow paths, pathways, or passageways through which fuel can enter, flow through, and/or exit the valve assembly 1140. In some embodiments, the housing 1210 defines an ODS input 1220 configured to couple with the ODS pipe 126 and to receive fuel therefrom. The housing 1210 can define a first ODS output 1222 configured to couple with first ODS line 143 and to deliver fuel thereto, and can define a second ODS output 1224 configured to couple with the second ODS line 144 and to deliver fuel thereto.

Each of the ODS input 1220 and the first and second ODS outputs 1222, 1224 can define a substantially cylindrical protrusion, and can include threading or some other suitable connection interface. In some embodiments, the ODS input 1220 and the first and second ODS outputs 1222, 1224 are substantially coplanar. The first ODS output 1222 can define a first longitudinal axis that is substantially collinear with a second longitudinal axis defined by the second ODS output 1224, and in some embodiments, the ODS input 1220 defines a longitudinal axis that intersects a line through the first and second longitudinal axes at an angle. In some embodiments, the angle is about 90 degrees. Other configurations of the ODS input 1220 and outputs 1222, 1224 are possible.

In some embodiments, the housing 1210 defines a burner input 1230 configured to couple with the fuel supply pipe 124 and to receive fuel therefrom. In some embodiments, the burner input 1230 defines a substantially cylindrical protrusion, which can include threading or any other suitable connection interface. In some embodiments, the burner input 1230 is larger than the ODS input 1220, and can thus be configured to receive relatively more fuel. In some embodiments, the burner input 1230 defines a longitudinal axis that is substantially parallel to a longitudinal axis defined by ODS input 1220. Other configurations of the burner input 1230 are also possible.

Figure 17:
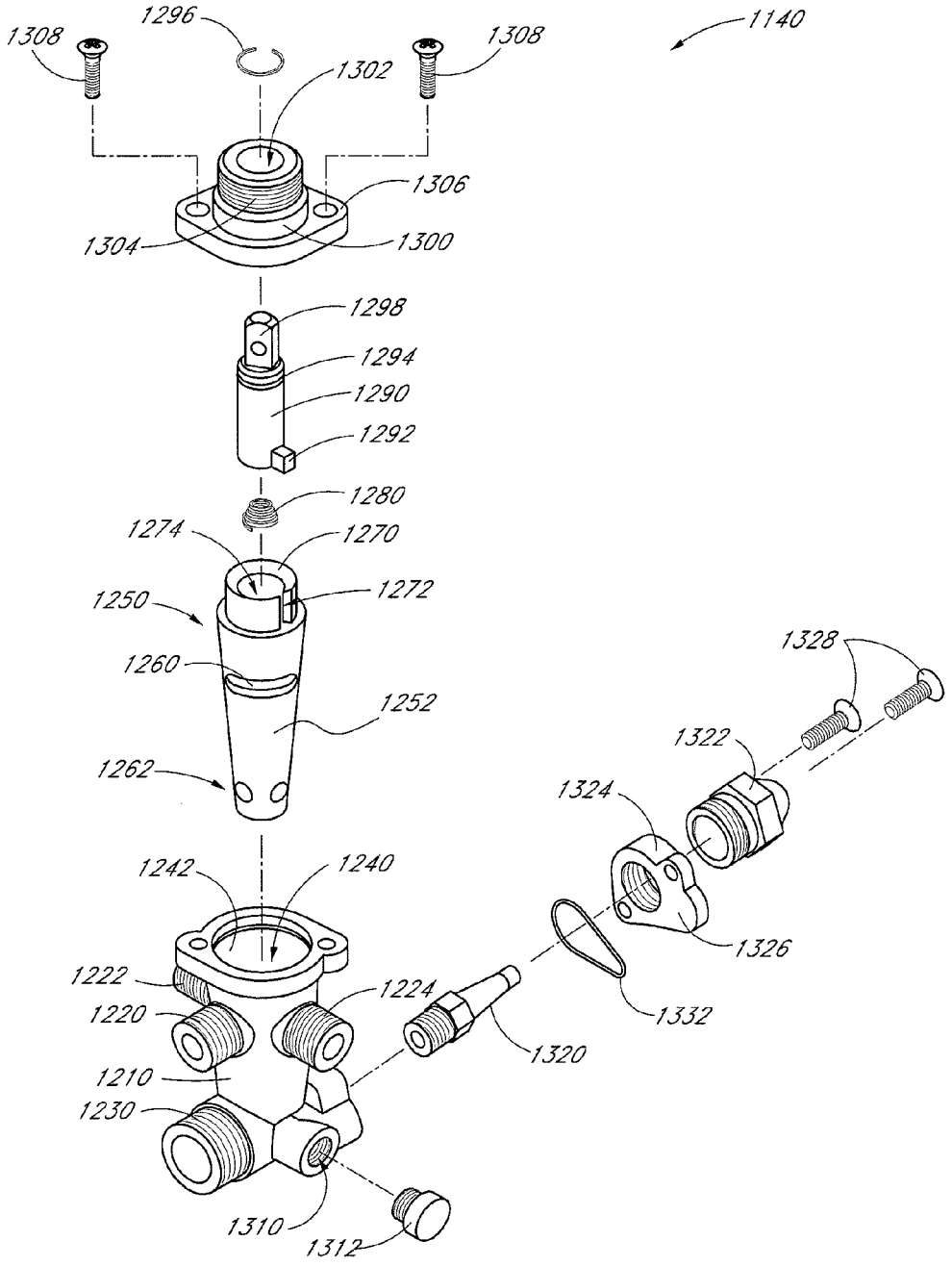
FIG. 17 is an exploded perspective view of the valve assembly of FIG. 16.
Figure 18A:
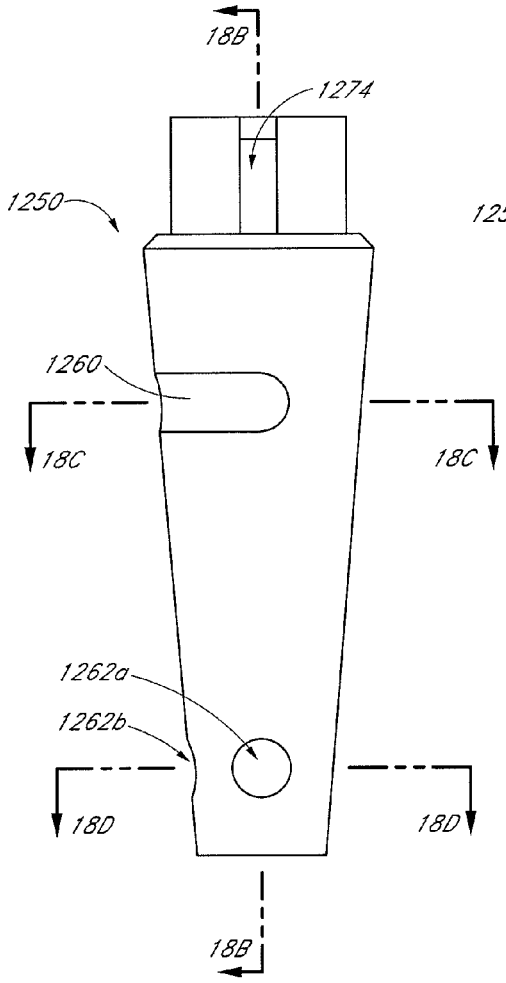
FIG. 18A is a front elevation view of an embodiment of a valve body compatible with the valve assembly of FIG. 16.
Figure 18B:
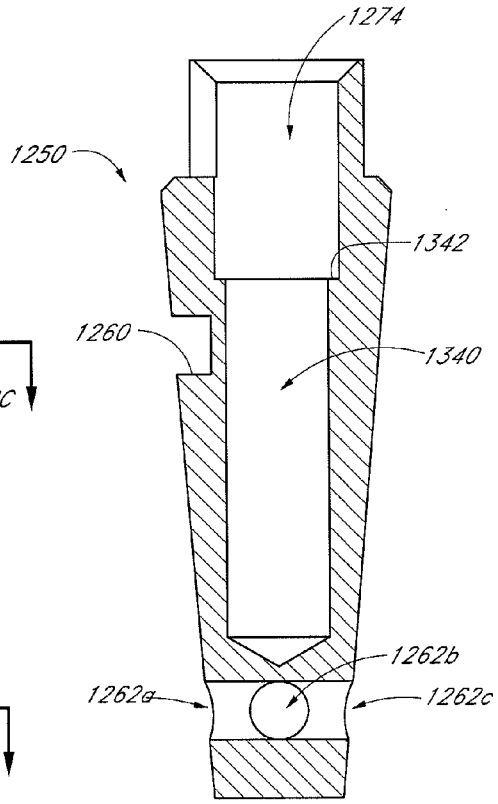
FIG. 18B is a cross-sectional view of the valve body of FIG. 18A taken along the view line 18B-18B.
Figure 18C:
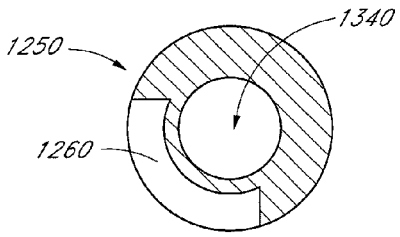
FIG. 18C is a cross-sectional view of the valve body of FIG. 18A taken along the view line 18C-18C.
Figure 18D:
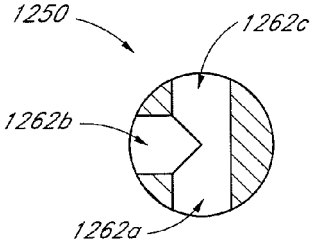
FIG. 18D is a cross-sectional view of the valve body of FIG. 18A taken along the view line 18D-18D.

With reference to FIG. 17, in certain embodiments, the housing 1210 defines a chamber 1240. In some embodiments, each of the burner input 1230, the ODS input 1220, and the ODS outputs 1222, 1224 defines a passageway leading into the chamber 1240 such that the chamber 1240 can be in fluid communication with any of the inputs 1220, 1230 and outputs 1222, 1224. In some embodiments, chamber 1240 is defined by a substantially smooth inner sidewall 1242 of the housing 1210. The inner sidewall 1242 can define any suitable shape, and in some embodiments, is rotationally symmetric. In various embodiments, the inner sidewall is substantially frustoconical or substantially cylindrical. The chamber 1240 can thus be sized and shaped to receive a valve member, core, channel member, fluid flow controller, or valve body 1250.

In some embodiments, the valve body 1250 includes a lower portion 1252 that defines an outer surface which is substantially complementary to the inner sidewall 1242 of the housing 1210. Accordingly, in some embodiments, the valve body 1250 can form a substantially fluid-tight seal with the housing 1210 when seated therein. In some embodiments, the valve body 1250 is configured to rotate within the chamber 1240. A suitable lubricant can be included between the valve body 1250 and the inner sidewall 1242 of the housing 1210 in order to permit relatively smooth movement of the valve body 1250 relative to the housing 1210. The valve body 1250 can define a channel 1260 configured to direct fuel from the ODS input 1220 to either the first or second ODS output 1222, 1224, and can include a series of apertures, openings, or ports 1262 configured to direct fuel from the burner input 1230 along either of two separate flow paths toward the burner 190, as further described below.

In some embodiments, the valve body 1250 includes an upper portion 1270, which can be substantially collar-shaped, and which can include a chamfered upper surface. In some embodiments, the upper portion 1270 defines a longitudinal slot 1272 and/or can define at least a portion of an upper cavity 1274.

In some embodiments, a biasing member 1280 is configured to be received by the upper cavity 1274 defined by the valve body 1250. The biasing member 1280 can comprise, for example, a spring or any other suitable resilient element. In some embodiments, the biasing member 1280 defines a substantially frustoconical shape and can be oriented such that a relatively larger base thereof is nearer the lower portion of the valve body 1250 than is a smaller top thereof. References to spatial relationships, such as upper, lower, top, etc., are made herein merely for convenience in describing embodiments depicted in the figures, and should not be construed as limiting. For example, such references are not intended to denote a preferred gravitational orientation of the valve assembly 1140.

In some embodiments, a rod, column, or shaft 1290 is configured to be received by the upper cavity 1274 defined by the valve body 1250. In some embodiments, the biasing member 1280 is retained between a ledge defined by the valve body (shown in FIG. 5B) and the shaft 1290, thus providing a bias that urges the shaft 1290 upward, or away from the valve body 1290, in the assembled valve assembly 1140. In certain embodiments, the shaft 1290 defines a protrusion 1292 sized and shaped be received by the slot 1272 defined by the valve body 1250. In some embodiments, the protrusion 1292 is sized to fit within the slot 1272 with relatively little clearance or, in other embodiments, snugly, such that an amount of rotational movement by the protrusion 1292 closely correlates with an amount of rotation of the valve body 1250. In some embodiments, the protrusion 1292 is substantially block-shaped, and projects at a substantially orthogonally with respect to a longitudinal length of a substantially columnar body of the shaft 1290. In some embodiments, the protrusion 1292 is capable of longitudinal movement within the slot 1272, and can be capable of rotating the valve body 1250 at any point within the range of longitudinal movement.

In some embodiments, the shaft 1290 defines a channel 1294 sized and shaped to receive a split washer 1296. The shaft 1290 can define an extension 1298. In some embodiments, the extension 1298 defines two substantially flat and substantially parallel sides configured to be engaged by a clamping device, such as a pair of pliers, such that the shaft 1290 can be rotated. In other embodiments, the extension 1298 is configured to couple with a knob or some other suitable grippable device, and in some embodiments, defines only one flat surface. Other configurations of the shaft 1290 are also possible.

In some embodiments, the shaft 1290 extends through a cap 1300 in the assembled valve assembly 1140. The cap 1300 can define an opening 1302 sized and shaped to receive the shaft 1290 and to permit rotational movement of the shaft 1290 therein. In some embodiments, the split washer 1296 prevents the shaft 1290 from being forced downward and completely through the opening 1302 in the assembled valve assembly 1140.

The cap 1300 can include a neck 1304, which can be threaded to engage a collar or cover. In some embodiments, the cap 1300 defines a flange 1306 through which fasteners 1308, such as, for example, screws, can be inserted to connect the cap 1300 with the housing 1210.

In some embodiments, the housing 1210 defines an opening 1310, which in some embodiments, results from the drilling or boring of a flow channel within the housing 1210, as described below. In some embodiments, the opening 1310 is sealed with a plug 1312, which in some embodiments, includes a threaded portion configured to interface with an inner surface of the housing 1210 that defines the flow channel. In some embodiments, glue, epoxy, or some other suitable bonding agent is included between the plug 1312 and the housing 1210 in order to ensure that a substantially fluid-tight seal is created.

In certain embodiments, the housing 1210 is configured to be coupled with a first nozzle member 1320 and a second nozzle member 1322. In some embodiments, the housing 1210 and one or more of the nozzle members 1320, 1322 are coupled via a cover 1324, as further described below. In some embodiments, the cover 1324 defines a flange 1326 through which fasteners 1328, such as, for example, screws, can be inserted to connect the cover 1324 with the housing 1210. In further embodiments, a sealing member or gasket 1332 is coupled with the housing 1210 in order to create a substantially fluid-tight seal, as further described below.

With reference to FIGS. 18A-18D, in certain embodiments, the valve body 1250 defines three burner ports 1262*a, b, c* configured to permit the passage of fuel. In some embodiments, the ports 1262*a, b, c* are formed by drilling or boring two flow channels into a solid portion of the valve body 1250. In some embodiments, one of the flow channels extends from one side of the valve body 1250 to an opposite side thereof, and the other flow channel extends from another side of the valve body 1250 and intersects the first flow channel within the valve body 1250. In some embodiments, the ports 1262*a, b, c* are substantially coplanar, and in further embodiments, are coplanar along a plane that is substantially orthogonal to a longitudinal axis of the valve body 1250.

In some embodiments, the valve body 1250 is substantially hollow, and can define a lower cavity 1340 which can reduce the material costs of producing the valve body 1250. The lower cavity 1340 can have a perimeter (e.g. circumference) smaller than a perimeter of the upper cavity 1274. Accordingly, in some embodiments, the valve body 1250 defines a ledge 1342 against which the biasing member 1280 can rest.

As described above, the valve body 1250 can define a groove or a channel 1260 configured to direct fuel flow. In some embodiments, the channel 1260 is milled or otherwise machined into a side of the valve body 1250. In some embodiments, a first end of the channel 1260 is substantially aligned with the port 1262*a* along a plane through a first longitudinal axis of the valve body 1250, and a second end of the channel 1260 is substantially aligned with the port 1262*b* along a second plane through a longitudinal axis of the valve body 1250. In some embodiments, the first plane and the second plane are substantially orthogonal to each other.

In other embodiments, the valve body 1250 does not include a lower cavity 1340 such that the valve body 1250 is substantially solid. Ports similar to the ports 1262*a, b, c* can thus be created in the valve body 1250 in place of the channel 1260. Other configurations of the valve body 1250 are also possible.

Figure 19:
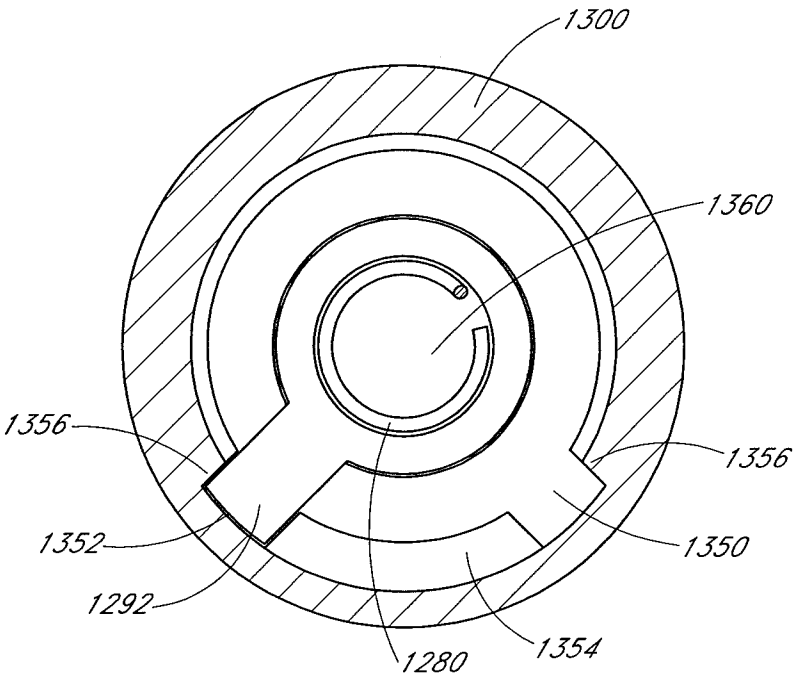
FIG. 19 is a cross-sectional view of the valve assembly of FIG. 16 taken along the view line 19-19.

With reference to FIG. 19, in certain embodiments, the cap 1300 defines a channel, slot, or first depression 1350 and a second depression 1352. In some embodiments, the first and second depressions 1350, 1352 are sized and shaped to receive a portion of the protrusion 1292 defined by the shaft 1290. The first and second depressions 1350, 1352 can define an angle relative to a center of the cap 1300. In some embodiments, the angle is about 90 degrees. Other angles are also possible, including, for example, between about 30 degrees and about 270 degrees, between about 45 and about 180 degrees, and between about 60 and about 120 degrees; no less than about 30 degrees, about 45 degrees, about 60 degrees, and about 90 degrees; and no greater than about 270 degrees, about 180 degrees, about 120 degrees, and about 90 degrees. The first and second depressions 1350, 1352 can be separated by a relatively short shelf or ledge 1354. In some embodiments, the first and second depressions 1350, 1352 are also separated by a stop 1356, which can be defined by an extension of the cap 1300.

In some embodiments, the shaft 1290 defines a receptacle 1360 configured to receive a portion of the biasing member 1280. In some embodiments, the receptacle 1360 contacts the top end of the biasing member 1280, and the biasing member 1280 urges the shaft 1290 upward toward the cap 1300. Accordingly, in some embodiments, the protrusion 1292 of the shaft 1290 is naturally retained within one of the depressions 1350, 1352 by the bias provided by the biasing member 1280, and the shaft 1290 is displaced downward or depressed in order to rotate the shaft 1290 such that the protrusion 1292 moves to the other depression 1350, 1352. Movement past either of the depressions 1350, 1352 can be prevented by the stop 1356. As noted above, in many embodiments, movement of the protrusion 1292 can result in correlated movement of the valve body 1250. Accordingly, rotation of the shaft 1290 between the first and second depressions 1350, 1352 can rotate the valve body 1250 between a first and a second operational state, as described further below.

Figure 20C:
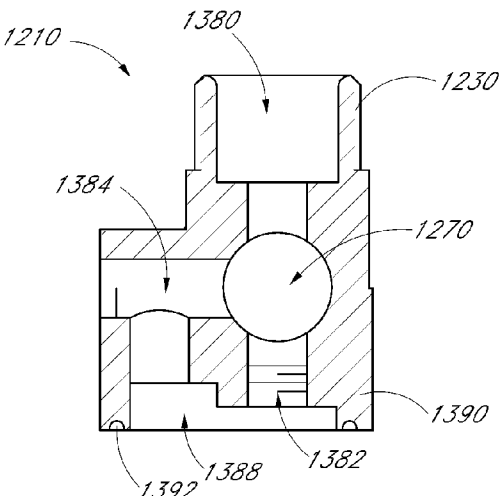
FIG. 20C is a cross-sectional view of the housing of FIG. 20A taken along the view line 20C-20C.
Figure 20B:
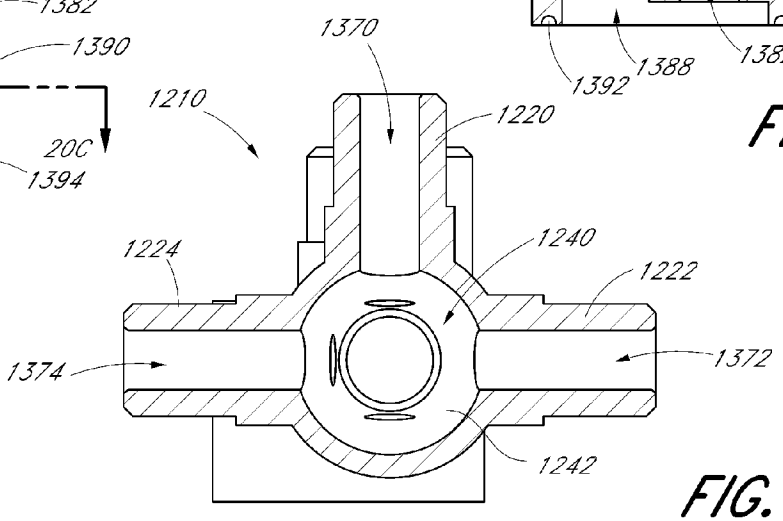
FIG. 20B is a cross-sectional view of the housing of FIG. 20A taken along the view line 20B-20B.
Figure 20A:
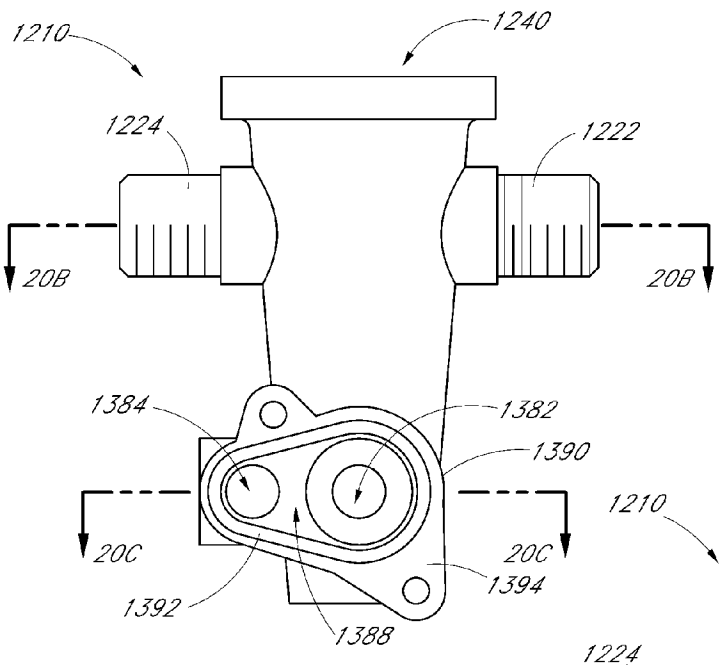
FIG. 20A is a front elevation view of an embodiment of a housing compatible with the valve assembly of FIG. 16.

FIGS. 20A-20C illustrate an embodiment of the housing 1210. With reference to FIGS. 20A and 20B, in certain embodiments, the ODS input 1220 defines at least a portion of a channel, conduit, passageway, or flow path 1370 along which fuel can flow toward the chamber 1240. The ODS output 1222 can define at least a portion of a flow path 1372, and the ODS output 1224 can define at least a portion of a flow path 1374, along which fuel can flow away from the chamber 1240 and out of the housing 1210. In some embodiments, the flow paths 1372, 1374 define longitudinal axes that are substantially collinear. In some embodiments, a longitudinal axis of the flow path 1370 is substantially orthogonal to one or more of the flow paths 1372, 1374. Other arrangements are also possible.

With reference to FIGS. 20A and 20C, in some embodiments, the burner input 1230 of the housing 1210 defines at least a portion of a flow path 1380 along which fuel can flow toward the chamber 1240. The housing 1210 can define a first egress flow path 1382 along which fuel can flow away from the chamber 1240 and out of the housing 1210. In some embodiments, an inner surface of the portion of the housing 1210 that defines the egress flow path 1382 can be threaded or include any other suitable connection interface for coupling with the first nozzle member 1320, as further described below. The housing 1210 can define a second egress flow path 1384 along which fuel can flow away from the chamber 1240 and out of the housing 1240. In certain embodiments, the housing 1210 defines an indentation, cavity, or recess 1388. In some embodiments, the recess 1388 defines a portion of the second egress flow path 1384.

In some embodiments, the recess 1388 is defined by a projection 1390 of the housing 1210. The projection 1390 can further define a channel 1392 for receiving the gasket 1332 to thereby form a substantially fluid-tight seal with the cover 1324. In some embodiments, a face 1394 of the projection 1390 is substantially flat, and can be configured to abut the cover 1324. The face 1394 can define apertures through which fasteners can be advanced for coupling the cover 1324 with the housing 1210. In some embodiments, the face 1394 defines a plane that is substantially parallel to a longitudinal axis defined by the inner sidewall 1242 of the housing 1210.

Figure 21:
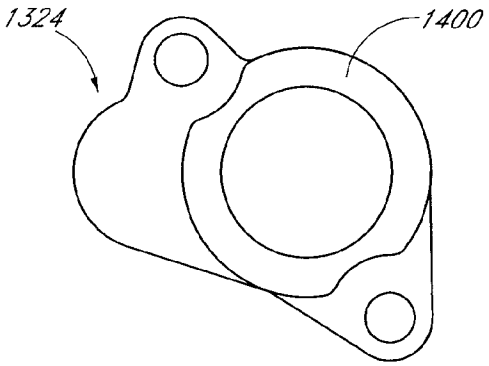
FIG. 21 is a top plan view of an embodiment of a cover compatible with the valve assembly of FIG. 16.

With reference to FIG. 21, in certain embodiments, the cover 1324 is sized and shaped such that a periphery thereof substantially conforms to a periphery of the face 1394 of the housing 1210. Accordingly, an edge around the cover 1324 and the face 1394 can be substantially smooth when the cover 1324 is coupled with the housing 1210. In some embodiments, an underside of the cover 1324 is substantially flat (see FIG. 17), and can thus be in relatively close proximity to the flat face 1394 of the housing when coupled therewith. In some embodiments, the cover 1324 defines a collar 1400 configured to receive a portion of the second nozzle member 1322. The collar 1400 can include threading or any other suitable connection interface, which can be disposed along an interior surface thereof.

Figure 22:
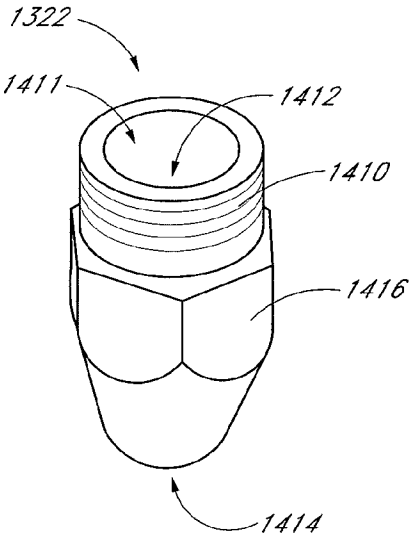
FIG. 22 is a perspective view of an embodiment of a nozzle member compatible with the valve assembly of FIG. 16.

With reference to FIG. 22, in certain embodiments, the second nozzle member 1322 can include a rim 1410 configured to couple with the collar 1400 of the cover 1324. In some embodiments, the rim 1410 defines an inlet 1411 of the second nozzle member 1322 through which fuel can be accepted into the nozzle member 1322. The rim 1410 can comprise threading or any other suitable connection interface along an interior or exterior surface thereof. The rim 1410 can define at least a portion of a cavity 1412, which in some embodiments, is sufficiently large to receive at least a portion of the first nozzle member 1320. In some embodiments, the cavity 1412 extends through the full length of the second nozzle member 1322, and can define an outlet 1414 (see also FIG. 24A) at an end opposite the rim 1410. In some embodiments, the second nozzle member 1322 defines a tightening interface 1416 configured to be engaged by a tightening device in order to securely couple the second nozzle member 1322 with the cover 1324.

Figure 23:
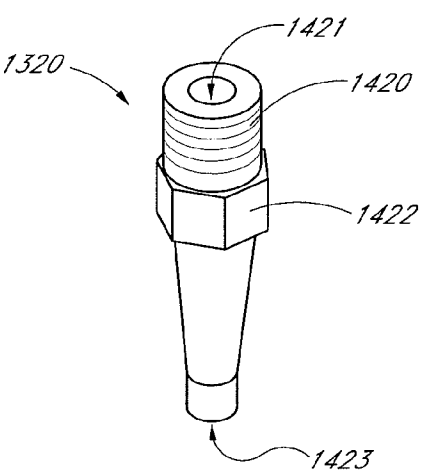
FIG. 23 is a perspective view of an embodiment of a nozzle member compatible with the valve assembly of FIG. 16.

With reference to FIG. 23, in certain embodiments, the first nozzle member 1320 can comprise a distal portion 1420, which can be configured to couple with the housing 1210. The distal portion 1420 can define an inlet 1421 of the first nozzle member 1320 configured to receive fuel into the first nozzle member 1320. In some embodiments, an outer surface of the distal portion 1420 is threaded, and is capable of engaging an inner surface of the housing 1210 that at least partially defines the first egress flow path 1382. The first nozzle member 1320 can define a tightening interface 1422 configured to be engaged by a tightening device in order to securely couple the first nozzle member 1320 with the housing 1210. The tightening interface 1422 can comprise a substantially hexagonal flange, which can be engaged by a wrench or other suitable tightening device. In some embodiments, the first nozzle member 1320 defines an outlet 1423, which can be substantially opposite the distal portion 1420.

Figure 24A:
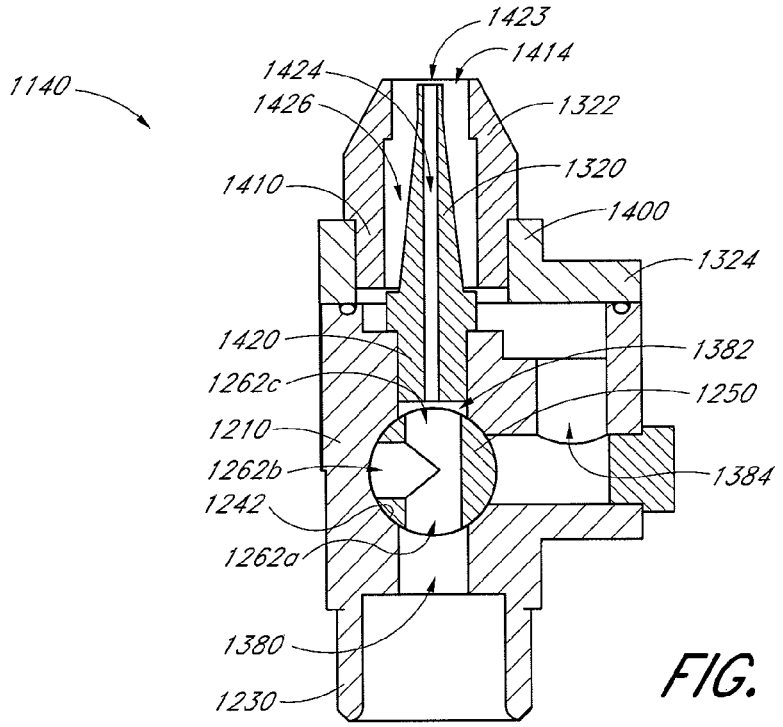
FIG. 24A is a cross-sectional view the valve assembly of FIG. 16 taken along the view line 24A-24A showing the valve assembly in a first operational configuration.

With reference to FIG. 24A, in certain embodiments, a substantial portion of the first nozzle member 1320 is within the second nozzle member 1322 in the assembled valve assembly 1140. In some embodiments, each of the first nozzle member 1320 and the second nozzle member 1322 comprise a common longitudinal axis. In further embodiments, the longitudinal axis defined by the first and second nozzle members 1320, 1322 is substantially perpendicular to a longitudinal axis defined by the inner sidewall 1242 of the housing 1210. In some embodiments, one or more of the first and second nozzle members 1320, 1322 defines a longitudinal axis that is substantially perpendicular to an axis about which the valve body 1250 is configured to rotate.

The outlet 1423 of the first nozzle member 1320 can extend beyond, be substantially flush with, or be interior to the outlet 1414 of the second nozzle member 1322. Accordingly, in some embodiments, the first nozzle member 1320 is configured to direct fuel through the outlet 1414 of the second nozzle member 1320. Various embodiments of first and second nozzle members compatible with certain embodiments of the valve assembly 1140 described herein are disclosed in U.S. patent application Ser. No. 11/443,446, titled NOZZLE, filed May 30, 2006; U.S. patent application Ser. No. 11/443,492, titled OXYGEN DEPLETION SENSOR, filed May 30, 2006; U.S. patent application Ser. No. 11/443,473, titled HEATER, filed May 30, 2006; U.S. patent application Ser. No. 11/649,976, titled VALVE ASSEMBLIES FOR HEATING DEVICES, filed Jan. 5, 2007; and U.S. patent application Ser. No. 11/649,976, titled VALVE ASSEMBLIES FOR HEATING DEVICES, filed Jan. 5, 2007, the entire contents of each of which are hereby incorporated by reference herein and made a part of this specification.

In some embodiments, the distal portion 1420 of the first nozzle member 1320 is coupled with the housing 1210 in substantially fluid-tight engagement. The first nozzle member 1320 can thus define an inner flow channel 1424 through which fuel can be directed and dispensed. In some embodiments, fuel is dispensed from the inner flow channel 1424 via the outlet 1423 at a first pressure.

In some embodiments, the rim 1410 of the second nozzle member 1322 is coupled with the collar 1400 of the cover 1324 in substantially fluid-tight engagement, and can provide an outer flow channel 1426 through which fuel can be directed and dispensed. In some embodiments, at least a portion of an outer boundary of the outer flow channel 1426 is defined by an inner surface of the second nozzle member 1322, and at least a portion of an inner boundary of the outer flow channel 1426 is defined by an outer surface of the first nozzle member 1320. Thus, in some embodiments, at least a portion of the inner flow channel 1424 is within the outer flow channel 1426. In some embodiments, fuel is dispensed from the outer flow channel 1426 via the outlet 1414 at a second pressure. In some embodiments, the second pressure is less than the first pressure at which fuel is dispensed from the inner flow channel 1424. In further embodiments, the inner flow 1424 channel is configured to dispense liquid propane at the first pressure and the outer flow channel 1426 is configured to dispense natural gas at a second pressure.

In some embodiments, the nozzle can be configured such that the fuel is dispensed from the inner flow channel 1424 at a first pressure, and is dispensed through both the inner and outer flow channels 1424, 1426 at a second pressure. In those embodiments, the inner flow channel 1424 can be configured to dispense propane at the first pressure, and the inner and outer flow channels 1424, 1426 can be configured to dispense natural gas at the second pressure.

Other configurations of the nozzle members 1320, 1322 and/or the inner and outer flow channels 1424, 1426 are also possible. For example, in some embodiments the first nozzle member 1320 is not located within the second nozzle member 1322. The first and second nozzle members 1320, 1322 can be situated proximate or adjacent one another, can be oriented to dispense fuel in a substantially common direction, or can be oriented to dispense fuel in different directions, for example.

With continued reference to FIG. 24A, the illustrated embodiment of the valve assembly 1140 is shown in a first operational configuration. In the first configuration, the valve body 1250 is oriented in a first position such that the ports 1262*a*, 1262*c* provide fluid communication between the flow path 1380 defined by the input 1230 and the first egress flow path 1382 defined by the housing 1210. In some embodiments, the port 1262*b* is directed toward the inner sidewall 1242 of the housing 1210, which can substantially prevent fluid flow out of the port 1262*b*. Additionally, the valve body 1250 can substantially block the second egress flow path 1384, thereby substantially preventing fluid flow through the second egress flow path 1384.

Accordingly, in certain embodiments, in the first operational configuration, the valve assembly 1140 can accept fuel via the burner input 1230, can direct the fuel along the flow path 1380, through the valve body 1250, through the first egress flow path 1382 and through the inner flow channel 1424, and can dispense the fuel at a proximal end of the inner flow channel 1424 via the outlet 1423. In certain embodiments, fuel thus dispensed is directed to enter the burner 190 for purposes of combustion.

Figure 24B:
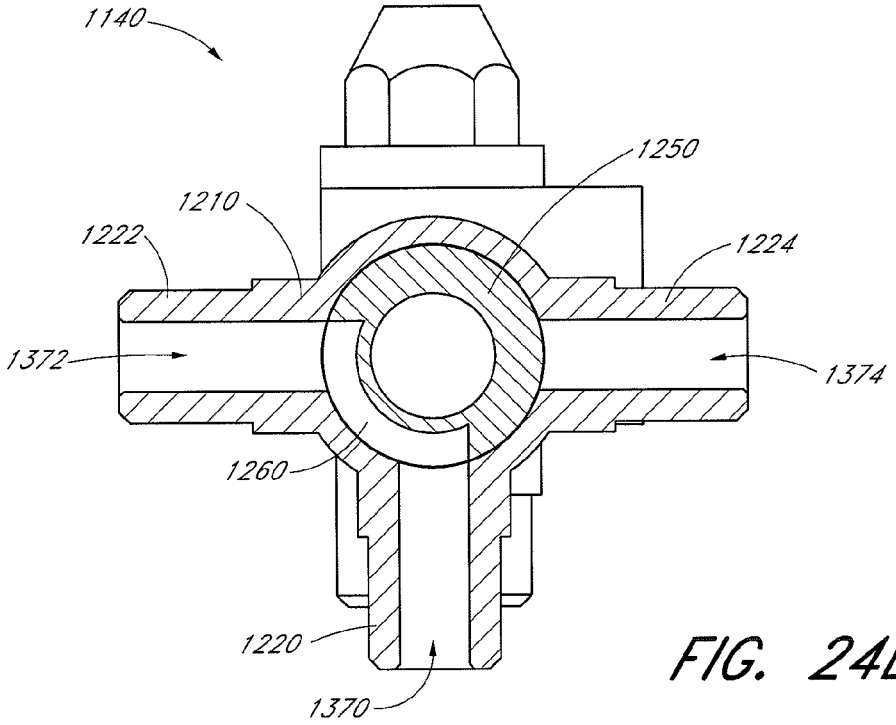
FIG. 24B is a cross-sectional view the valve assembly of FIG. 16 taken along the view line 24B-24B showing the valve assembly in the first operational configuration.

With reference to FIG. 24B, in certain embodiments, when the valve body 1250 is oriented in the first position, the channel 1260 can provide fluid communication between the flow path 1370 and the flow path 1372 defined by the housing 1210. Accordingly, fuel entering the ODS input 1220 can flow through the flow path 1370, through the channel 1260, through the flow path 1372, and out of the first ODS output 1222. In some embodiments, the valve body 1250 can substantially block the flow path 1374 such that fuel is substantially prevented from flowing through the second ODS output 1224.

Figure 25A:
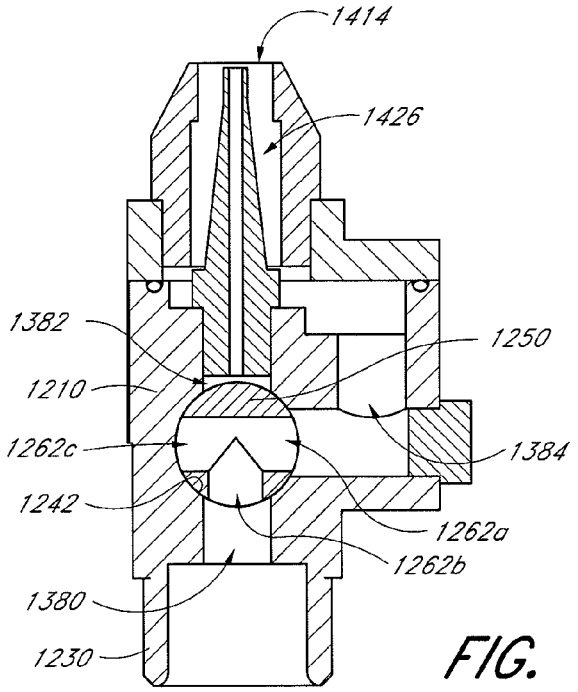
FIG. 25A is a cross-sectional view the valve assembly of FIG. 16 similar to the view depicted in FIG. 24A showing the valve assembly in a second operational configuration.

With reference to FIG. 25A, the illustrated embodiment of the valve assembly 1140 is shown in a second operational configuration. In the second configuration, the valve body 1250 is oriented in a second position such that the ports 1262*a*, 1262*b* provide fluid communication between the flow path 1380 defined by the input 1230 and the second egress flow path 1384 defined by the housing 1210. In some embodiments, the port 1262*c* is directed toward the inner sidewall 1242 of the housing 1210, which can substantially prevent fluid flow out of the port 1262*c*. Additionally, the valve body 1250 can substantially block the first egress flow path 1382, thereby substantially preventing fluid flow through the second egress flow path 1382.

Accordingly, in certain embodiments, in the second operational configuration, the valve assembly 1140 can accept fuel via the burner input 1230, can direct the fuel along the flow path 1380, through the valve body 1250, through the second egress flow path 1384 and through the outer flow channel 1426, and can dispense the fuel at a proximal end of the outer flow channel 1426 via the outlet 1414. In certain embodiments, fuel thus dispensed is directed to enter the burner 190 for purposes of combustion.

Figure 25B:
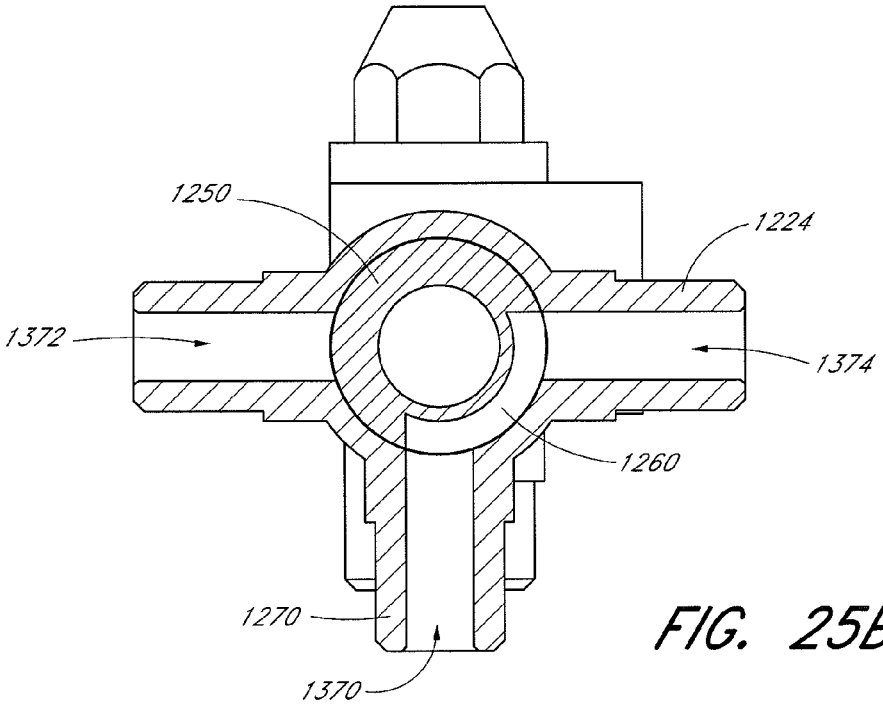
FIG. 25B is a cross-sectional view the valve assembly of FIG. 16 similar to the view depicted in FIG. 24B showing the valve assembly in the second operational configuration.

With reference to FIG. 25B, in certain embodiments, when the valve body 1250 is oriented in the second position, the channel 1260 can provide fluid communication between the flow path 1370 and the flow path 1374 defined by the housing 1210. Accordingly, fuel entering the ODS input 1220 can flow through the flow path 1370, through the channel 1260, through the flow path 1374, and out of the second ODS output 1224. In some embodiments, the valve body 1250 can substantially block the flow path 1372 such that fuel is substantially prevented from flowing through the second ODS output 1224.

In certain embodiments, the valve assembly 1140 is configured to accept and channel liquid propane gas when in the first operational configuration and to accept and channel natural gas when in the second operational configuration. In other embodiments, the valve assembly 1140 is configured to channel one or more different fuels when in either the first or the second operational configuration.

Figure 26:
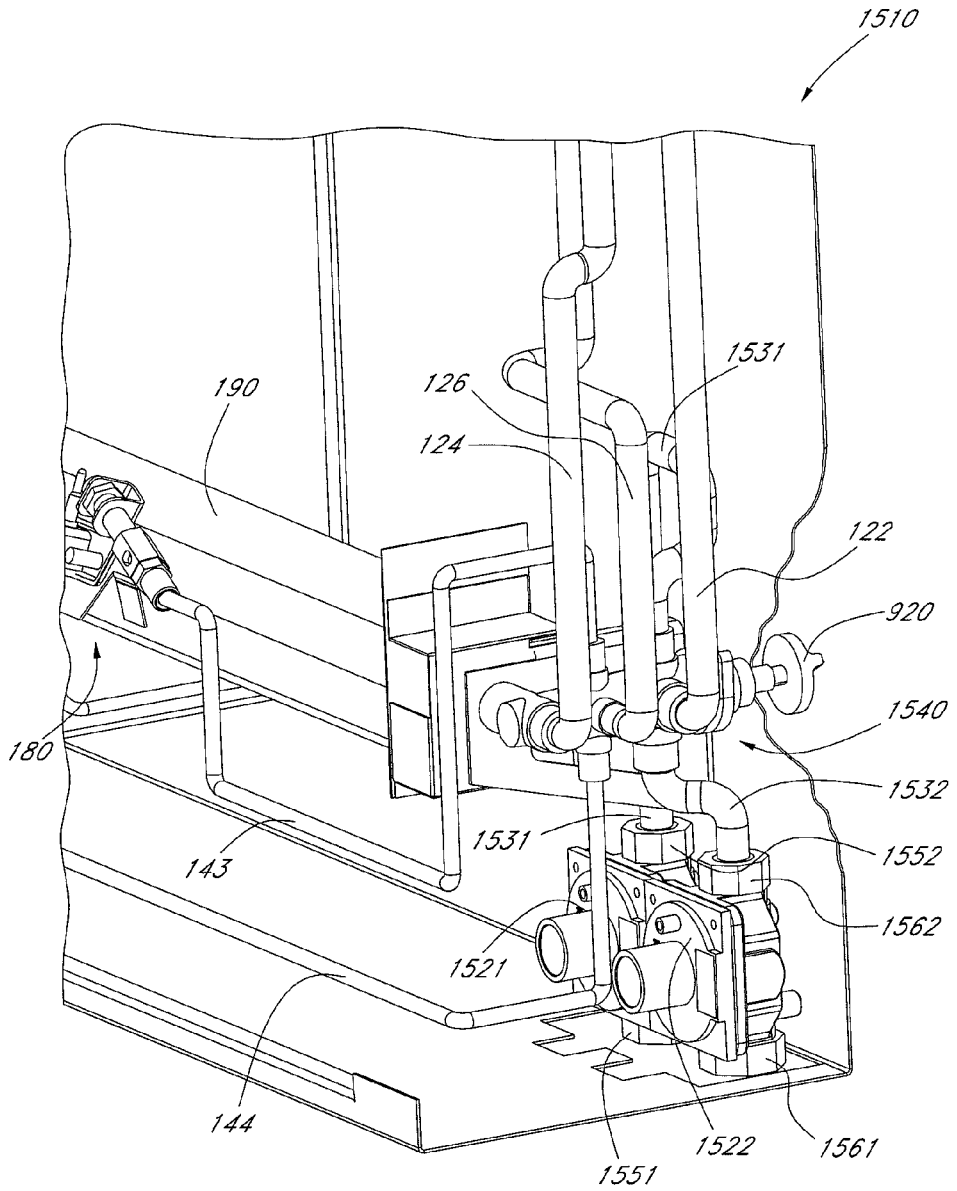
FIG. 26 is a perspective cutaway view of a portion of another embodiment of a heater configured to operate using a first fuel source or a second fuel source.
Figure 26A:
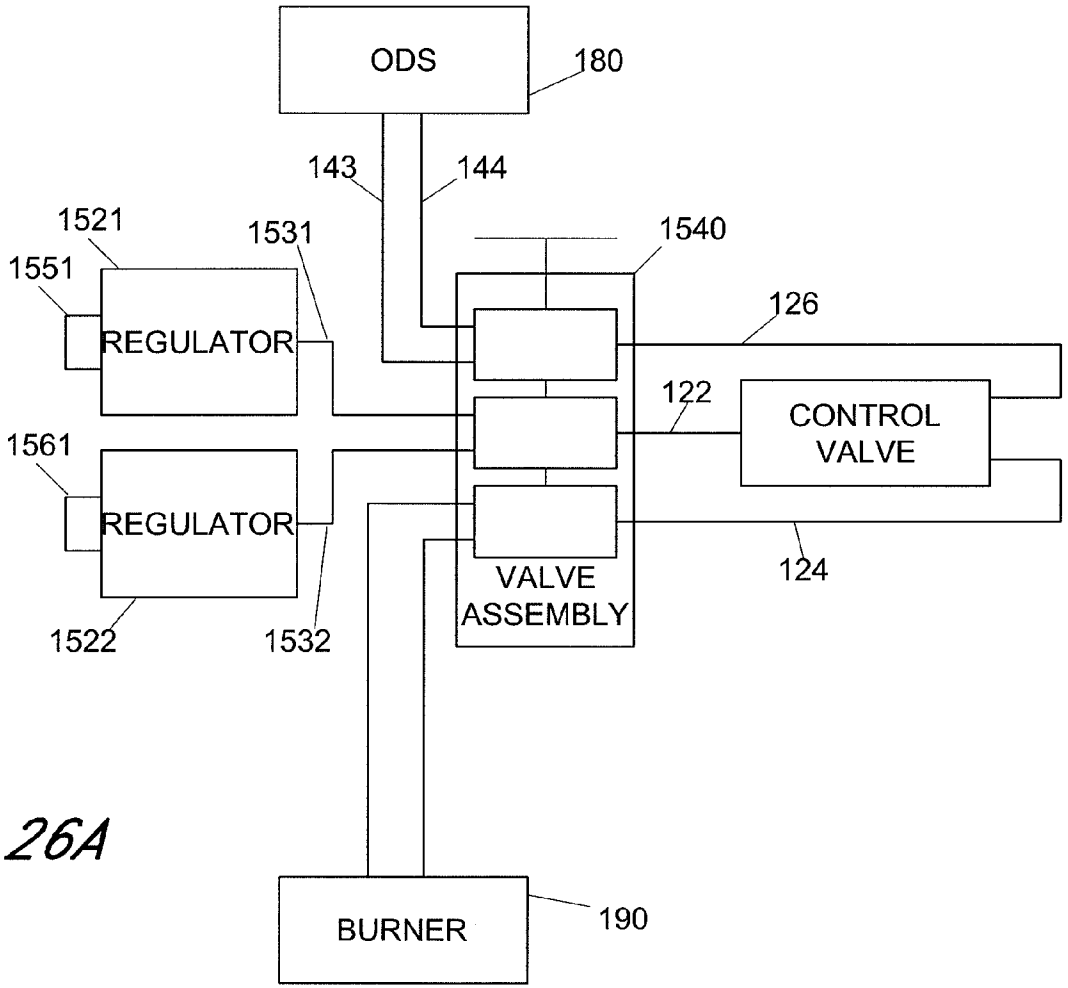
FIG. 26A is a schematic view illustrating the heater of FIG. 26.

FIGS. 26 and 26A illustrate an embodiment of a heater 1510. The heater 1510 can resemble the heaters 10, 910 in many respects, thus like features are identified with like numerals. In various embodiments, the heater 1510 can differ from the heaters 10, 1510 in other respects, such as those described hereafter.

In certain embodiments, the heater 1510 includes a first pressure regulator 1521 and a second pressure regulator 1522. In some embodiments, the first pressure regulator 1521 is coupled with a first preliminary conduit 1531 and the second pressure regulator is coupled with a second preliminary conduit 1532. In some embodiments, the heater 1510 further includes an intake pipe 122, a fuel supply pipe 124, an ODS pipe 126, a first ODS line 143, a second ODS line 144, an ODS 180, and/or a burner 190. The heater 1510 can include any suitable control valve, such as the control valve 130, to regulate fuel flow from the intake pipe 122 to the fuel supply pipe 124 and/or the ODS pipe 126. In certain embodiments, the heater 1510 includes a fluid flow controller or valve assembly 1540, which can resemble the valve assembly 1140 in many respects and differ in other respects, such as those described hereafter. Accordingly, like features of the valve assembly 1540 and the valve assembly 1140 may be identified with like numerals.

In certain embodiments, the valve assembly 1540 is coupled with the first and second preliminary conduits 1531, 1532, the intake pipe 122, the fuel supply pipe 124, the ODS pipe 126, the first ODS line 143, and the second ODS line 144. As further described below, in some embodiments, the valve assembly 1540 can be configured to direct fuel received from either the first preliminary conduit 1531 or the second preliminary conduit 1532 to the intake pipe 122, to direct fuel received from the ODS pipe 126 to either the first ODS line 143 or the second ODS line 144, and to direct fuel received from the fuel supply pipe 124 along different flow paths into the burner 190. In some embodiments, the valve assembly 1540 is coupled with a knob 920, which can transition the valve assembly 1540 between a first and a second operational state.

In various embodiments, the first and second regulators 1521, 1522 can comprise any suitable pressure regulator known in the art or yet to be devised. In some embodiments, the first regulator 1521 includes a first input port 1551 and a first output port 1552, and the second regulator 1522 includes a second input port 1561 and a second output port 1562. In some embodiments, the first output port 1552 is coupled with the first preliminary conduit 1531 and the second output port 1562 is coupled with the second preliminary conduit 1532.

In certain embodiments, the first regulator 1521 can be coupled with a first fluid fuel source via the first input port 1551 and to receive a first fuel from the first fuel source. In some embodiments, the first regulator 1521 is configured to regulate fuel entering the first input port 1551 such that fuel exiting the first output port 1552 and entering the first preliminary conduit 1531 is at a relatively steady first pressure.

In certain embodiments, the second regulator 1522 can be coupled with a second fluid fuel source via the second input port 1561 and to receive a second fuel from the second fuel source. In some embodiments, the second regulator 1522 is configured to regulate fuel entering the second input port 1561 such that fuel exiting the second output port 1562 and entering the second preliminary conduit 1532 is at a relatively steady second pressure.

In some embodiments, the first input port 1551 may be plugged or capped when the second input port 1561 is in use and/or the second input port 1561 may be plugged or capped when the first input port 1551 is in use. In some embodiments, plugging or capping in this manner can advantageously prevent dust or other airborne debris from gathering within whichever of the regulators 1521, 1522 is not in use.

As with the valve assembly 1140, in certain embodiments, the valve assembly 1540 is configured to operate in a first operational state or in a second operational state. In certain embodiments, when the valve assembly 1540 is in the first operational state, fuel can be delivered from the first pressure regulator 1521 to the control valve. In certain embodiments, the first pressure regulator 1521 delivers fuel to the valve assembly 1540 via the first preliminary conduit 1531. As further described below, in certain embodiments, the valve assembly 1540 directs fuel flow from the first preliminary conduit 1531 to the intake pipe 1522 and toward the control valve. In some embodiments, when in the first operational state, the valve assembly 1540 further directs fuel received from the control valve via the fuel supply pipe 124 along a first flow path into the burner 190, and directs fuel received from the control valve via the ODS pipe 126 to the ODS 180 via the first ODS line 143.

In certain embodiments, when the valve assembly 1540 is in the second operational state, fuel can be delivered from the second pressure regulator 1522 to the control valve. In certain embodiments, the second pressure regulator 1522 delivers fuel to the valve assembly 1540 via the second preliminary conduit 1532. As further described below, in certain embodiments, the valve assembly 1540 directs fuel flow from the second preliminary conduit 1532 to the intake pipe 122 and toward the control valve. In some embodiments, when in the second operational state, the valve assembly 1540 further directs fuel received from the control valve via the fuel supply pipe 124 along a second flow path into the burner 190, and directs fuel received from the control valve via the ODS pipe 126 to the ODS 180 via the second ODS line 144.

Figure 27A:
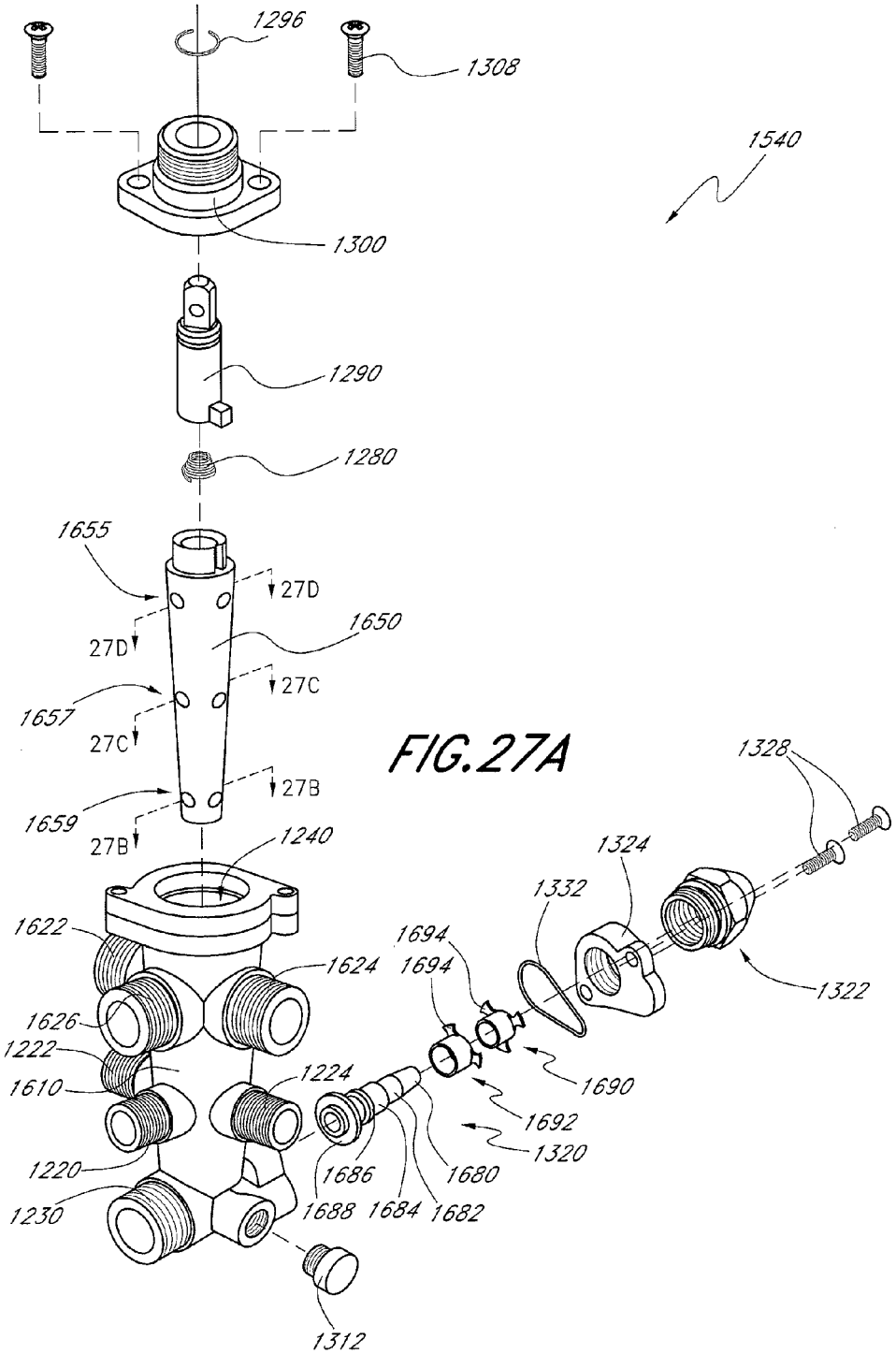
FIG. 27A is an exploded perspective view of an embodiment of a valve assembly compatible with, for example, the heater of FIG. 26.

With reference to FIG. 27A, in certain embodiments, the valve assembly 1540 includes a housing 1610. The housing 1610 can comprise a unitary piece of material, or can comprise multiple pieces joined in any suitable manner. In some embodiments, the housing 1610 defines a first system supply input 1622 configured to couple with the first preliminary conduit 1531 and to receive fuel therefrom, and defines a second system supply input 1624 configured to couple with the second preliminary conduit 1532 and to receive fuel therefrom. The housing 1610 can define a system supply output 1626 configured to couple with the intake pipe 122 and to deliver fuel thereto.

In some embodiments, the housing 1610 defines an ODS input 1220 configured to couple with the ODS pipe 126 and to receive fuel therefrom. The housing 1610 can define a first ODS output 1222 configured to couple with the first ODS line 143 and to deliver fuel thereto, and can define a second ODS output 1224 configured to couple with the second ODS line 144 and to deliver fuel thereto. In certain embodiments, the housing 1610 defines a burner input 1230 configured to couple with the fuel supply pipe 124 and to receive fuel therefrom. As with the housing 1210, the housing 1610 can further define and/or partially define a first fuel path and a second fuel path via which fuel received via the burner input 1230 can be directed to the burner 190.

In certain embodiments, the housing 1610 defines a chamber or cavity 1240 configured to receive a valve body 1650. The housing 1610 and/or the valve body 1650 can be coupled with a biasing member 1280, a shaft 1290, and a cap 1300 via one or more fasteners 1308 and a split washer 1296, as described above. In some embodiments, the housing 1610 is coupled with a plug 1312.

The valve body 1650 can resemble the valve body 1250 in certain respects and/or can include different features. In some embodiments, the valve body 1650 defines a set of top apertures 1655, a set of intermediate apertures 1657, and a set of bottom apertures 1659, which are described more fully below.

In certain embodiments, the housing 1610 is configured to be coupled with a first nozzle member 1320 and/or a second nozzle member 1322. In some embodiments, the housing 1610 is further coupled with a cover 1324, a gasket 1332, and/or fasteners 1328 in a manner such as described above.

In some embodiments, the first nozzle member 1320 includes a tapered distal end 1680, a distal cylindrical portion 1682, a proximal cylindrical portion 1684, a flange 1686, and a shelf 1688. In some embodiments, the proximal cylindrical portion 1684 defines a larger outer diameter than does the distal cylindrical portion 1682. In some embodiments, the first nozzle member 1320 is received within one or more of a distal spacer, support, or collar 1690 and a proximal collar 1692. In certain advantageous embodiments, the collars 1690, 1692 are configured to maintain an axial alignment of the first and second nozzle members 1320, 1322.

In some embodiments, the distal collar 1690 defines a smaller inner diameter than does the proximal collar 1692. In some embodiments, an inner diameter of the distal collar 1690 can be slightly larger than an outer diameter of the distal cylindrical portion 1682 and thus the distal collar 1690 can receive the distal cylindrical portion 1682 in relatively snug engagement. Similarly, in some embodiments, an inner diameter of the proximal collar 1692 can be slightly larger than an outer diameter of the proximal cylindrical portion 1684 and thus the proximal collar 1692 can receive the proximal cylindrical portion 1684 in relatively snug engagement.

In some embodiments, the collars 1690, 1692 are configured to be received within a threaded portion of the second nozzle member 1322. For example in some embodiments, the collars 1690, 1692 include protrusions 1694 that are configured to engage an inner threading of the second nozzle member 1322. In some embodiments, a cross sectional area defined by a set of protrusions 1694 is relatively small with respect to a cross-sectional area between an inner surface of the second nozzle member 1322 and an outer surface of the collar 1690 or the collar 1692. Accordingly, in some embodiments, the protrusions 1694 do not significantly impede fluid flow through a volume of space between an inner surface of the second nozzle member 1322 and an outer surface of the collars 1690, 1692.

In some embodiments, as further discussed below with respect to FIGS. 47A-D, the valve member 1650 can be configured such that the fuel is dispensed from the first nozzle member 1320 at a first pressure when the valve 1540 is in a first state, and is dispensed through both the first and second nozzle members 1320, 1322 at a second pressure when the valve 1540 is in a second state. In those embodiments, the valve member can be configured such that the first nozzle member 1320 can dispense propane at the first pressure, and first and second nozzle members 1320, 1322 can be dispense natural gas at the second pressure. In other embodiments, the valve body 1650 can be configured such that the fuel is dispensed from the first nozzle member 1320 at a first pressure when the valve 1540 is in a first state, and is dispensed through the second nozzle member 1322 at a second pressure when the valve 1540 is in a second state.

Figure 27B:
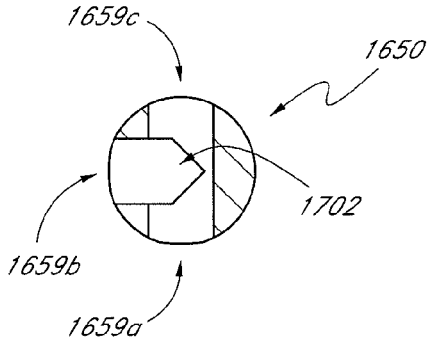
FIG. 27B is a cross-sectional view of an embodiment of a valve body compatible with the valve assembly of FIG. 27A taken along the view line 27B-27B.
Figure 27C:
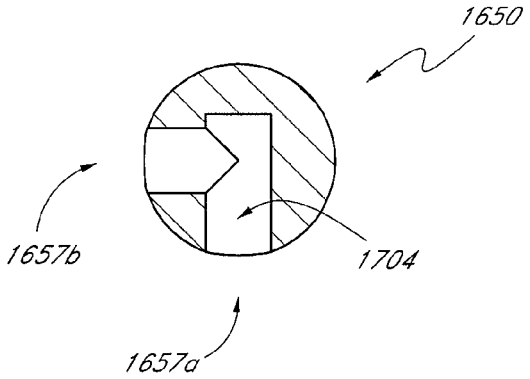
FIG. 27C is a cross-sectional view of the valve body of FIG. 27B taken along the view line 27C-27C in FIG. 27A.
Figure 27D:
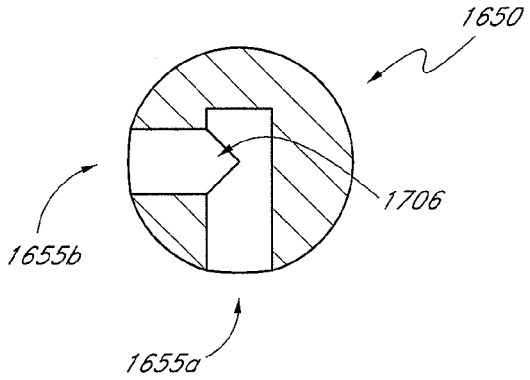
FIG. 27D is a cross-sectional view of the valve body of FIG. 27B taken along the view line 27D-27D in FIG. 27A.

With reference to FIGS. 27B-27D, in certain embodiments, the valve member 1650 defines a series of bottom apertures 1659*a, b, c*, intermediate apertures 1657*a, b*, and top apertures 1655*a, b*. In some embodiments, the apertures 1659*a, b, c*, 1657*a, b*, and 1655*a, b* are formed by drilling or boring a bottom flow channel 1702, an intermediate flow channel 1704, and a top flow channel 1706 into a solid portion of the valve body 1650. Other configurations are also possible.

In certain embodiments, the apertures 1659*a, b, c* and the bottom flow channel 1702 operate in a manner similar to the ports 1262*a, b, c* and associated flow channel of the valve body 1250, as described above with respect to FIGS. 24A and 25A. Accordingly, in some embodiments, when the valve body 1650 is in the first state, the apertures 1659*a, c* and flow channel 1702 are configured to direct fuel flow from the fuel supply pipe 124 along a first flow path through the first nozzle member 1320 to the burner 190. In some embodiments, fuel enters the aperture 1659*a* and exits the aperture 1659*c*, and thus propagates in a substantially linear direction through the valve body 1650, as viewed from the perspective shown in FIG. 27B. In some embodiments, when in the first state, the valve body 1650 substantially prevents fluid communication between the fuel supply pipe 124 and a second flow path through a volume of space between the first nozzle member 1320 and the second nozzle member 1322.

In some embodiments, when the valve body 1650 is in the second state, the apertures 1659*a, b* and the bottom flow channel 1702 are configured to direct fuel flow from the fuel supply pipe 124 along the second flow path between the first nozzle member 1320 and the second nozzle member 1322 to the burner 190. In some embodiments, fuel enters the aperture 1659*b* and exits the aperture 1659*a*, and thus propagates in a substantially clockwise direction through the valve body 1650, as viewed from the perspective shown in FIG. 27B. In some embodiments, when in the second state, the valve body 1650 substantially prevents fluid communication between the fuel supply pipe 124 and the first flow path through the first nozzle member 1320.

In certain embodiments, the apertures 1657*a, b* and the intermediate flow channel 1704 operate in a manner similar to the channel 1260 of the valve body 1250, as described above with respect to FIGS. 24B and 25B. Accordingly, in some embodiments, when the valve body 1650 is in the first state, the apertures 1657*a, b* are configured to direct fuel flow from the ODS pipe 126 to the first ODS line 143. In some embodiments, fuel enters the aperture 1657*a* and exits the aperture 1657*b*, and thus propagates in a substantially counterclockwise direction through the valve body 1650, as viewed from the perspective shown in FIG. 27C. In some embodiments, when in the first state, the valve body 1650 substantially prevents fluid communication between the ODS pipe 126 and the second ODS line 144.

In some embodiments, when the valve body 1650 is in the second state, the apertures 1657*a, b* and the intermediate flow channel 1704 are configured to direct fuel flow from the ODS pipe 126 to the second ODS line 144. In some embodiments, fuel enters the aperture 1657*b* and exits the aperture 1657*a*, and thus propagates in a substantially clockwise direction through the valve body 1650, as viewed from the perspective shown in FIG. 27C. In some embodiments, when in the second state, the valve body 1650 substantially prevents fluid communication between the ODS pipe 126 and the first ODS line 143.

In certain embodiments, the apertures 1655*a, b* and the top flow channel 1706 operate in a manner similar to the apertures 1657*a, b* and the intermediate flow channel 1704, but conduct fuel in an opposite direction. Accordingly, in some embodiments, when the valve body 1650 is in the first state, the apertures 1655*a, b* and the top channel 1706 direct fuel flow from the first preliminary conduit 1531 to the intake pipe 122. In some embodiments, fuel enters the aperture 1655*b* and exits the aperture 1655*a*, and thus propagates in a substantially clockwise direction through the valve body 1650, as viewed from the perspective shown in FIG. 27D. In some embodiments, when in the first state, the valve body 1650 substantially prevents fluid communication between the second preliminary conduit 1532 and the intake pipe 122. For example, in some embodiments, the valve body 1650 cooperates with the housing 1610 to prevent fuel from entering the cavity 1240 via the second preliminary conduit 1532.

In some embodiments, when the valve body 1650 is in the second state, the apertures 1655*a, b* and the top channel 1706 are configured to direct fuel flow from the second preliminary conduit 1532 to the intake pipe 122. In some embodiments, fuel enters the aperture 1655*a* and exits the aperture 1655*b*, and thus propagates in a substantially counterclockwise direction through the valve body 1650, as viewed from the perspective shown in FIG. 27D. In some embodiments, when in the second state, the valve body 1650 substantially prevents fluid communication between the first preliminary conduit 1530 and the intake pipe 122. For example, in some embodiments, the valve body 1650 cooperates with the housing 1610 to prevent fuel from entering the cavity 1240 via the first preliminary conduit 1530.

As can be appreciated from the foregoing discussion, in certain advantageous embodiments, the valve assembly 1540 is configured to transition the mode of the heater 1510 via a single actuator (e.g., the knob 920). Transition from one mode to another can thus be accomplished with relative ease. In some embodiments, the heater 1510 can be transitioned from a functional mode in which the heater 1510 is operable with a first fuel source (e.g., natural gas) to a mode in which the heater 1510 is operable with a second fuel source (e.g., propane), or vice versa.

Further, in some embodiments, the valve assembly 1540 can prevent a first variety of fuel from entering the heater 1510 and/or various components thereof when the heater 1510 is configured to be used with a second variety of fuel. For example, in certain embodiments, the first regulator 1521 is configured for use with propane gas and the second regulator 1522 is configured for use with natural gas. In some embodiments, if the first regulator 1521 is coupled with a propane gas source, but the valve assembly 1540 is oriented in a state for accepting natural gas via the regulator 1522, the valve assembly 1540 will substantially prevent any propane gas from entering the heater 1510 and/or various components thereof.

Figure 28:
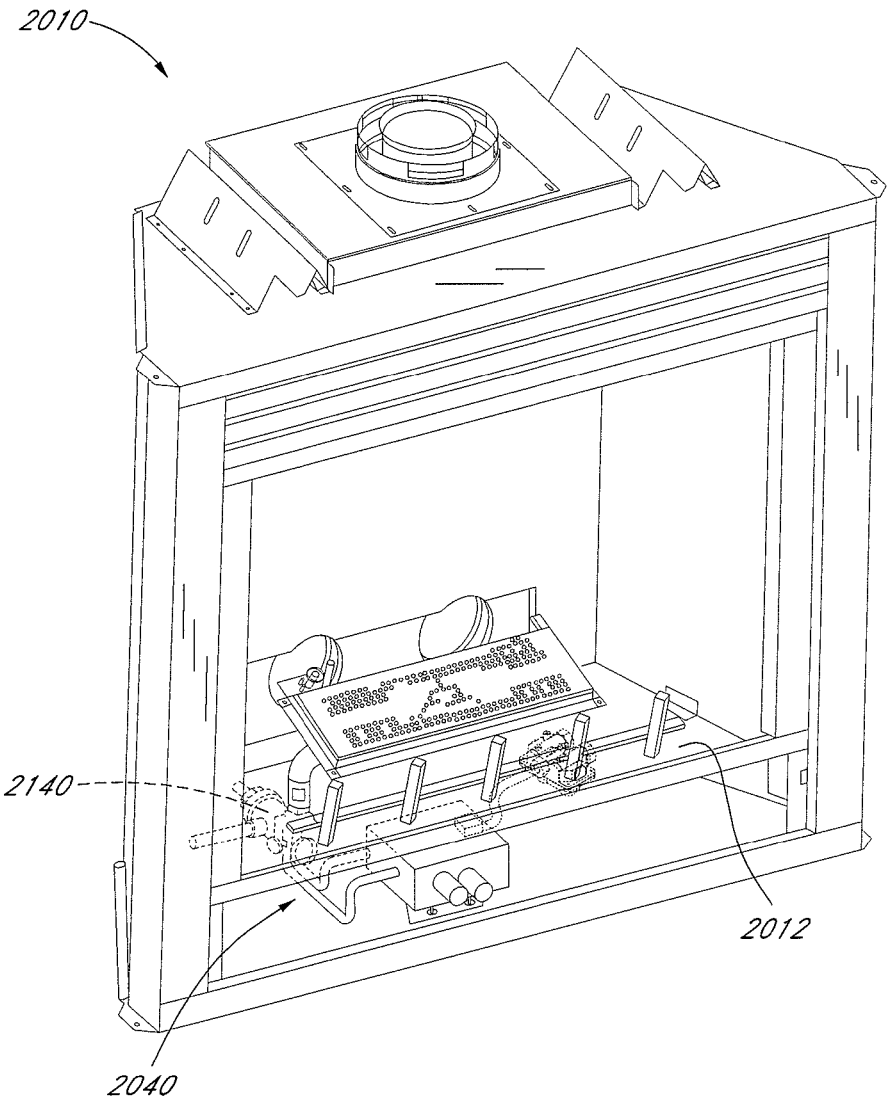
FIG. 28 is a perspective view of an embodiment of a heating device compatible with certain embodiments of the valve assembly of FIGS. 16 and 27A.

FIG. 28 illustrates an embodiment of a fireplace, heat-generating unit, or heating device 2010 configured to operate with one or more sources of combustible fuel. In various embodiments, the device 2010 includes a valve assembly 2140 such as the valve assembly 1140.

In certain embodiments, the heating device 2010 includes a fuel delivery system 2040, which can have portions for accepting fuel from a fuel source, for directing flow of fuel within the heating device 2010, and for combusting fuel. In the embodiment illustrated in FIG. 28, portions of an embodiment of the fuel delivery system 2040 that would be obscured by the heating device 2010 are shown in phantom. Specifically, the illustrated heating device 2010 includes a floor 2012 which forms the bottom of the combustion chamber and the components shown in phantom are positioned beneath the floor 2012 in the illustrated embodiment.

Figure 29:
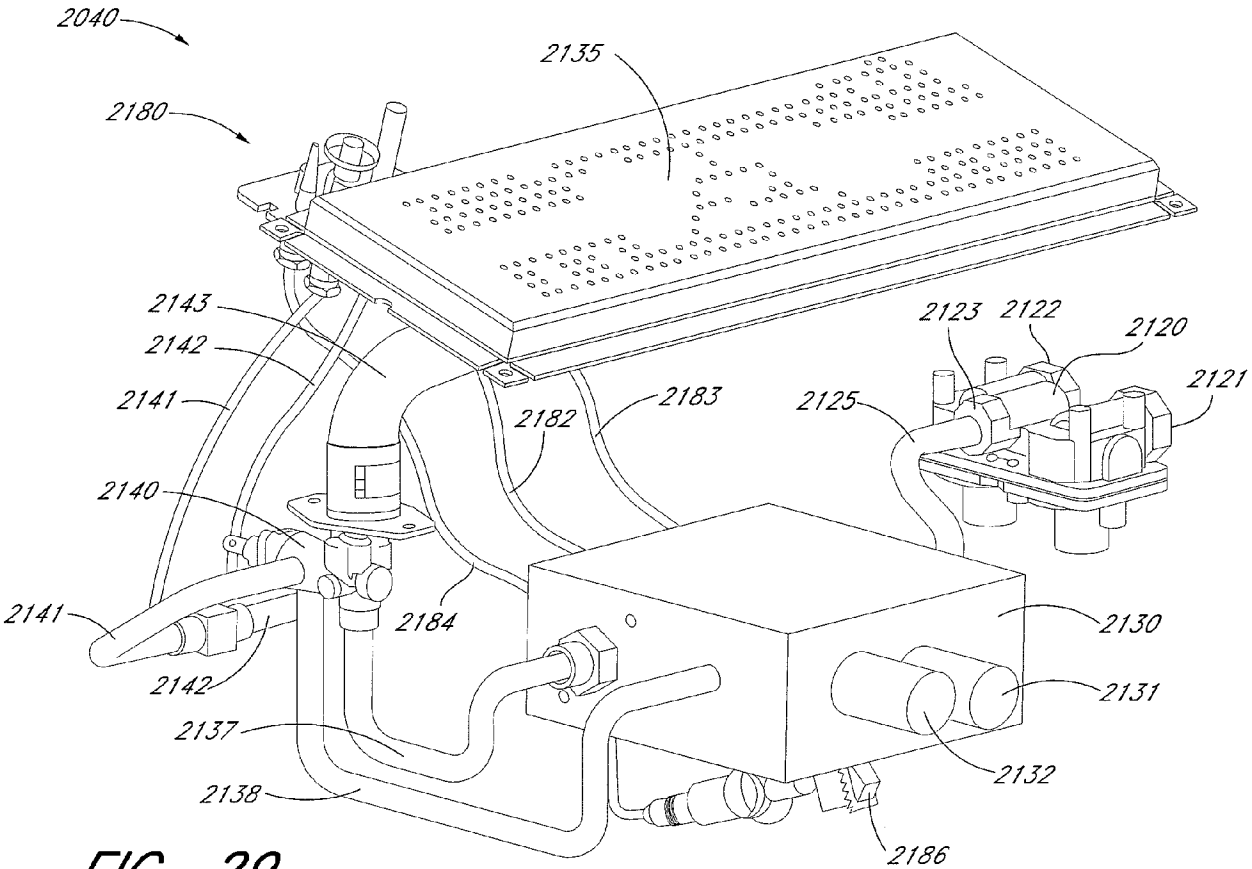
FIG. 29 is a perspective view of an embodiment of a fuel delivery system compatible with the heating device of FIG. 28 that includes an embodiment of the valve assembly of FIG. 16.

With reference to FIG. 29, in certain embodiments, the fuel delivery system 2040 includes a regulator 2120. The regulator 2120 can be configured to selectively receive either a first fluid fuel (e.g., natural gas) from a first source at a first pressure or a second fluid fuel (e.g., propane) from a second source at a second pressure. In certain embodiments, the regulator 2120 includes a first input port 2121 for receiving the first fuel and a second input port 2122 for receiving the second fuel. In some embodiments, the second input port 2122 is configured to be plugged when the first input port 2121 is coupled with the first fuel source, and the first input port 2121 is configured to be plugged when the second input port 2122 is coupled with a second fuel source.

The regulator 2120 can define an output port 2123 through which fuel exits the regulator 2120. In certain embodiments, the regulator 2120 is configured to regulate fuel entering the first port 2121 such that fuel exiting the output port 2123 is at a relatively steady first pressure, and is configured to regulate fuel entering the second port 2122 such that fuel exiting the output port 2123 is at a relatively steady second pressure.

In certain embodiments, the output port 2123 of the regulator 2120 is coupled with a source line 2125. The source line 2125, and any other fluid line described herein, can comprise piping, tubing, conduit, or any other suitable structure adapted to direct or channel fuel along a flow path. In some embodiments, the source line 2125 is coupled with the output port 2123 at one end and is coupled with a control valve 2130 at another end. The source line 2125 can thus provide fluid communication between the regulator 2120 and the control valve 2130.

In certain embodiments, the control valve 2130 is configured to regulate the amount of fuel delivered to portions of the fuel delivery system 2040. The control valve 2130 can assume a variety of configurations, including those known in the art as well as those yet to be devised. The control valve 2130 can comprise a first knob or dial 2131 and a second dial 2132. In some embodiments, the first dial 2131 can be rotated to adjust the amount of fuel delivered to a burner 2135, and the second dial 2132 can be rotated to adjust a setting of a thermostat. In other embodiments, the control valve 2130 comprises a single dial 2131.

In many embodiments, the control valve 2130 is coupled with a burner transport line 2137 and a pilot transport line 2138, each of which can be coupled with a valve assembly 2140. In some embodiments, the valve assembly 2140 is further coupled with a first pilot delivery line 2141, a second pilot delivery line 2142, and a burner delivery line 2143. The valve assembly 2140 can be configured to direct fuel received from the pilot transport line 2138 to either the first pilot delivery line 2141 or the second pilot delivery line 2142, and can be configured to direct fuel received from the burner transport line 2132 along different flow paths toward the burner delivery line 2143.

In certain embodiments, the first and second pilot delivery lines 2141, 2142 are coupled with separate portions of a safety pilot, pilot assembly, or pilot 2180. The pilot 2180 can comprise any suitable pilot assembly or oxygen depletion sensor assembly known in the art or yet to be devised. In some embodiments, the pilot 2180 comprises the oxygen depletion sensor 180 described above. Fuel delivered to the pilot 2180 can be combusted to form a pilot flame, which can serve to ignite fuel delivered to the burner 2135 and/or serve as a safety control feedback mechanism that can cause the control valve 2130 to shut off delivery of fuel to the fuel delivery system 2040. Additionally, in some embodiments, the pilot 2180 is configured to provide power to the thermostat of the control valve 2130. Accordingly, in some embodiments, the pilot 2180 is coupled with the control valve 2130 by one or more of a feedback line 2182 and a power line 2183.

In further embodiments, the pilot 2180 comprises an electrode configured to ignite fuel delivered to the pilot 2180 via one or more of the pilot delivery lines 2141, 2142. Accordingly, the pilot 2180 can be coupled with an igniter line 2184, which can be connected to an igniter switch 2186. In some embodiments, the igniter switch 2186 is mounted to the control valve 2130. In other embodiments, the igniter switch 2186 is mounted to the housing 2020 of the heating device 2010. Any of the lines 2182, 2183, 2184 can comprise any suitable medium for communicating an electrical quantity, such as a voltage or an electrical current. For example, in some embodiments, one or more of the lines 2182, 2183, 2184 comprise a metal wire.

In certain embodiments, the burner delivery line 2143 is situated to receive fuel from the valve assembly 2140, and can be connected the burner 2135. The burner 2135 can comprise any suitable burner, such as, for example, a ceramic tile burner or a blue flame burner, and is preferably configured to continuously combust fuel delivered via the burner delivery line 2143.

In certain embodiments, either a first or a second fuel is introduced into the fuel delivery system 2040 through the regulator 2120. In some embodiments, the first or the second fuel proceeds from the regulator 2120 through the source line 2125 to the control valve 2130. In some embodiments, the control valve 2130 can permit a portion of the first or the second fuel to flow into the burner transport line 2137, and can permit another portion of the first or the second fuel to flow into the pilot transport line 2138.

In some embodiments, the first or the second fuel can proceed to the valve assembly 2140. In many embodiments, the valve assembly 2140 is configured to operate in either a first state or a second state. In some embodiments, the valve assembly 2140 directs fuel from the burner transport line 2132 along a first flow path into the burner delivery line 2143 and directs fuel from the pilot transport line 2138 to the first pilot delivery line 2141 when the valve assembly 2140 is in the first state. In further embodiments, the valve assembly 2140 is configured to channel fuel from the burner transport line 2132 along a second flow path into the burner delivery line 2143 and from the pilot transport line 2138 to the second pilot delivery line 2142 when the valve assembly 2140 is in the second state.

In some embodiments, when the valve assembly 2140 is in the first state, fuel flows through the first pilot delivery line 2141 to the pilot 2180, where it is combusted. When the valve assembly 2140 is in the second state, fuel flows through the second pilot delivery line 2142 to the pilot 2180, where it is combusted. In some embodiments, when the valve assembly 2140 is in either the first or second state, fuel flows through the burner delivery line 2143 to the burner 2135, where it is combusted.

Figure 30B:
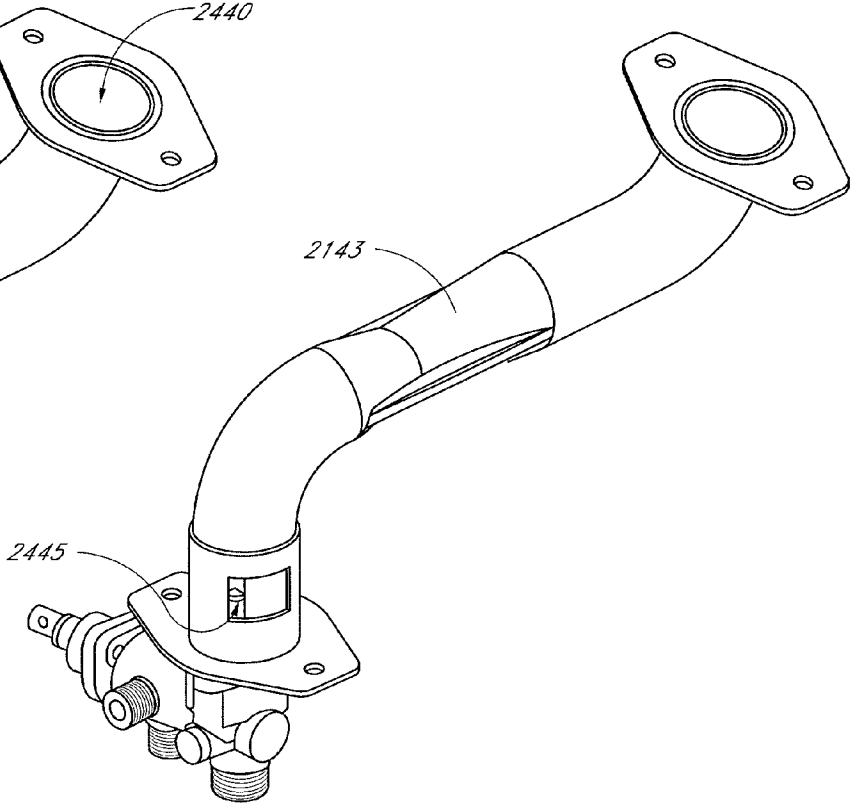
FIG. 30B is a perspective view the portion of the fuel delivery system shown in FIG. 30A in a second operational state.
Figure 30A:
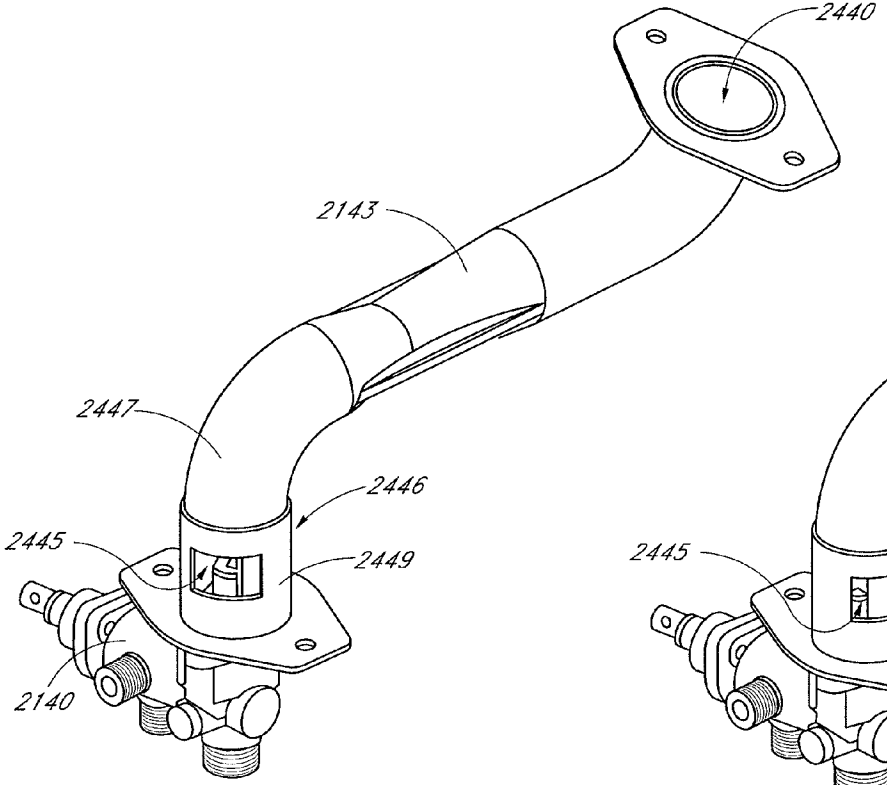
FIG. 30A is a perspective view of a portion of the fuel delivery system of FIG. 29 in a first operational state.

With reference to FIG. 30A, in certain embodiments, the valve assembly 2140 is positioned to be in fluid communication with the burner delivery line 2143. The valve assembly 2140 can be coupled with the burner delivery line 2143 in any suitable manner and/or can be positioned in relatively fixed relation with respect to the burner delivery line 2143. In some embodiments, the burner delivery line defines an opening (not shown) at a first end thereof through which one or more of the nozzle elements (such as, e.g., nozzle elements 1320, 1322) can extend. In other embodiments, the nozzle elements are not located within the burner delivery line 2143 but are positioned to direct fuel into the burner delivery line 2143. The burner delivery line 2143 can define an opening 2440 at a second end thereof through which fuel can flow to the burner 2135.

In some embodiments, the burner delivery line 2143 defines an air intake, aperture, opening, flow area, space, flow path, or window 2445 through which air can flow to mix with fuel dispensed by the valve assembly 2140. In some embodiments, the window 2445 is adjustably sized. For example, in some embodiments, the burner delivery line 2143 defines a mixing section, passageway, chamber, corridor, or compartment 2446, which can include a primary conduit 2447 and a sleeve 2449. As used herein, the term "compartment" is a broad term used in its ordinary sense and can include, without limitation, structures that define a volume of space through which fluid can flow.

Each of the primary conduit 2447 and the sleeve 2449 can define an opening. In some embodiments, the openings can be relatively aligned with each other such that the window 2445 is relatively large, and the sleeve 2449 can be rotated such that less of the openings are aligned, thereby making the window 2445 relatively smaller. In some embodiments, a wrench or other suitable device is used to adjust the size of the window 2445. In other embodiments, the size of the window 2445 can be adjusted by hand.

With continued reference to FIG. 30A, in some embodiments, the window 2445 is relatively large, thus allowing a relatively large amount of air to be drawn into the burner delivery line 2143 as fuel is dispensed from the valve assembly 2140. In some embodiments, the valve assembly 2140 is configured to operate in the first configuration such that fuel is dispensed via the outlet defined by the first nozzle member when the window 2445 is relatively large.

With reference to FIG. 30B, in some embodiments, the window 2445 is relatively small, thus allowing a relatively small amount of air to be drawn into the burner delivery line 2143 as fuel is dispensed from the valve assembly 2140. In some embodiments, the valve assembly 2140 is configured to operate in the second configuration such that fuel is dispensed via the outlet defined by the second nozzle member when the window 2445 is relatively small.

In certain embodiments, the valve assembly 2140 and the window 2445 are configured to create an air-fuel mixture that produces a blue flame at the burner 2135. In further embodiments one or more of the valve assembly 2140 and the window 2445 can be adjusted to alter the air-fuel mixture, and as a result, certain properties of the flame produced at the burner. Such properties can include, for example, the color, shape, height, and/or burn quality (e.g., number and/or type of by-products) of the flame.

Figure 31:
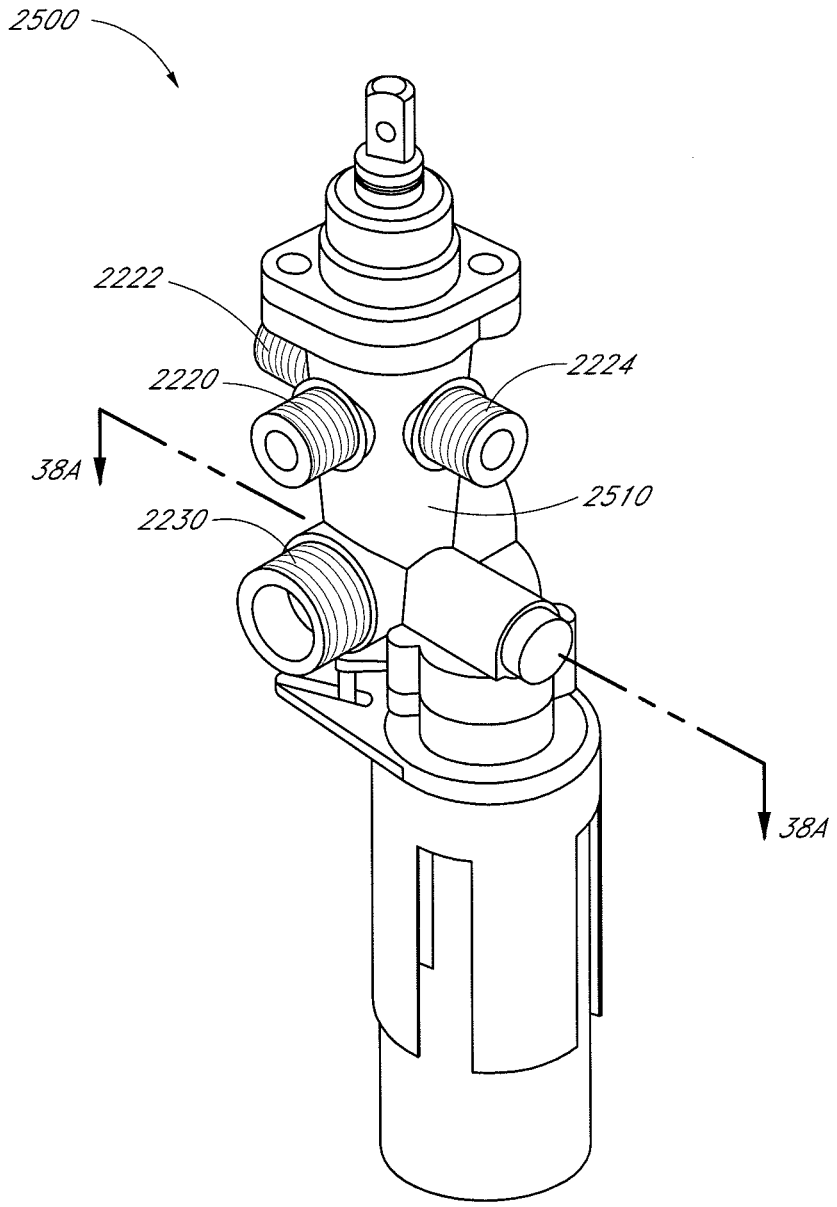
FIG. 31 is a perspective view of another embodiment of a valve assembly compatible with, for example, certain embodiments of the heating device of FIG. 28.

FIG. 31 illustrates an embodiment of a valve assembly 2500, which can resemble the valve assembly 2140 in many respects. Accordingly, like features are identified with like reference numerals. The valve assembly 2500 can also include features different from those discussed with respect to the valve assembly 2140, such as those described hereafter. In various embodiments, the valve assembly 2500 is configured for use with the heating device 2010, and can be configured for use with other suitable heating devices. In certain preferred embodiments, the valve assembly 2500 is configured for use with gas logs, gas fireplaces, gas fireplace inserts, and/or other heating devices for which the color of the flame produced by the devices may desirably be a preferred color, such as, for example, yellow.

In certain embodiments, the valve assembly 2500 includes a housing 2510. The housing 2510 can comprise a unitary piece of material, or can comprise multiple pieces joined in any suitable manner. In certain embodiments, the housing 2510 defines a pilot input 2220 configured to couple with the pilot transport line 2138 and to receive fuel therefrom. The housing 2510 can define a first pilot output 2222 configured to couple with first pilot delivery line 2141 and to deliver fuel thereto, and can define a second pilot output 2224 configured to couple with the second pilot delivery line 2142 and to deliver fuel thereto. In some embodiments, the housing 2510 defines a burner input 2230 configured to couple with the burner transport line 2137 and to receive fuel therefrom.

Figure 32:
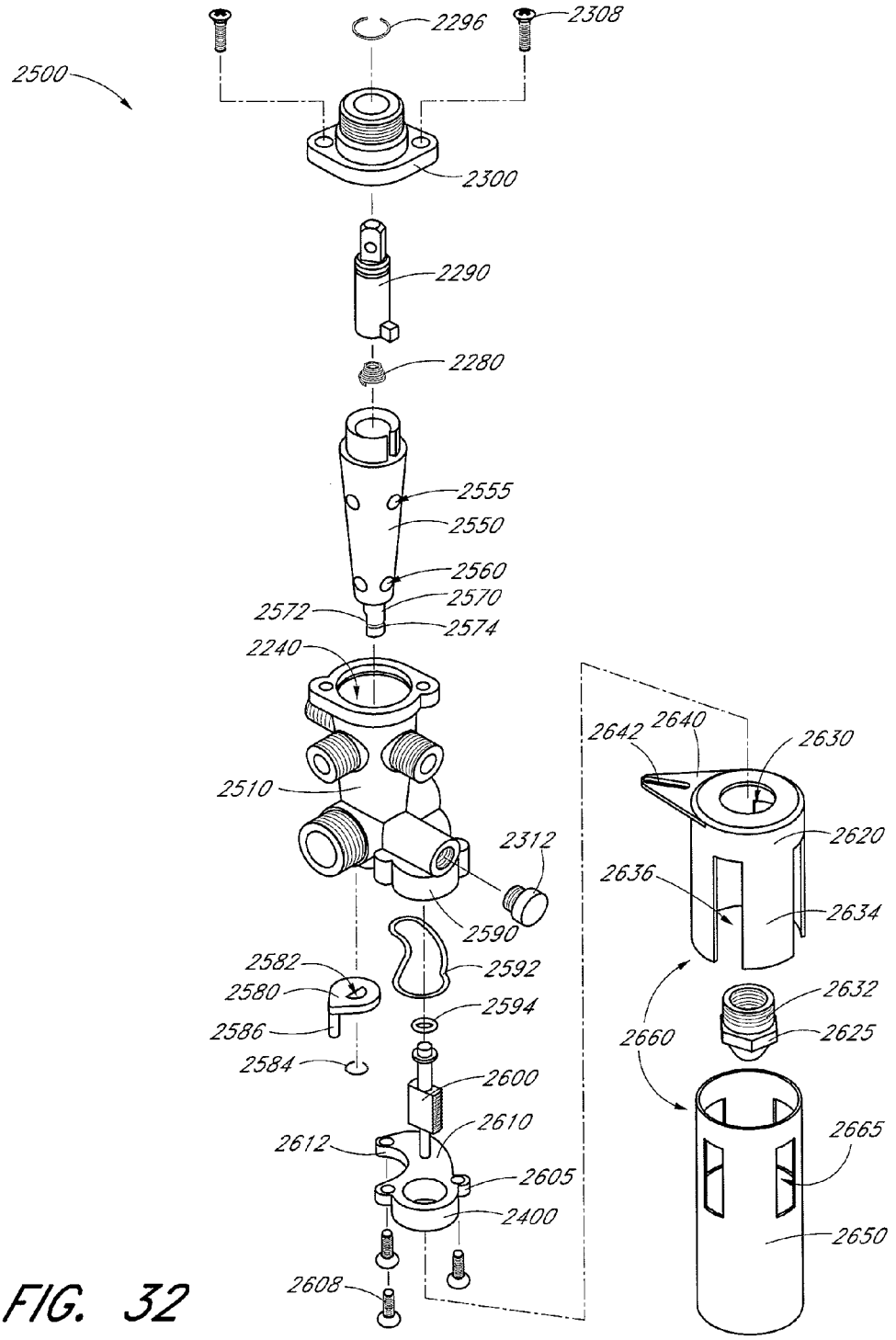
FIG. 32 is an exploded perspective view of the valve assembly of FIG. 31.
Figure 33A:
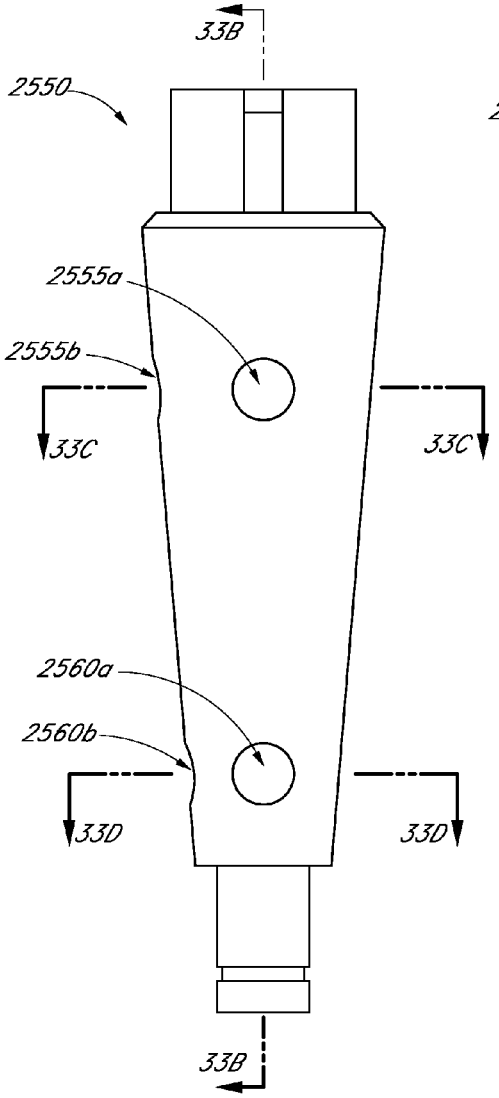
FIG. 33A is a front elevation view of an embodiment of a valve body compatible with the valve assembly of FIG. 31.
Figure 33B:
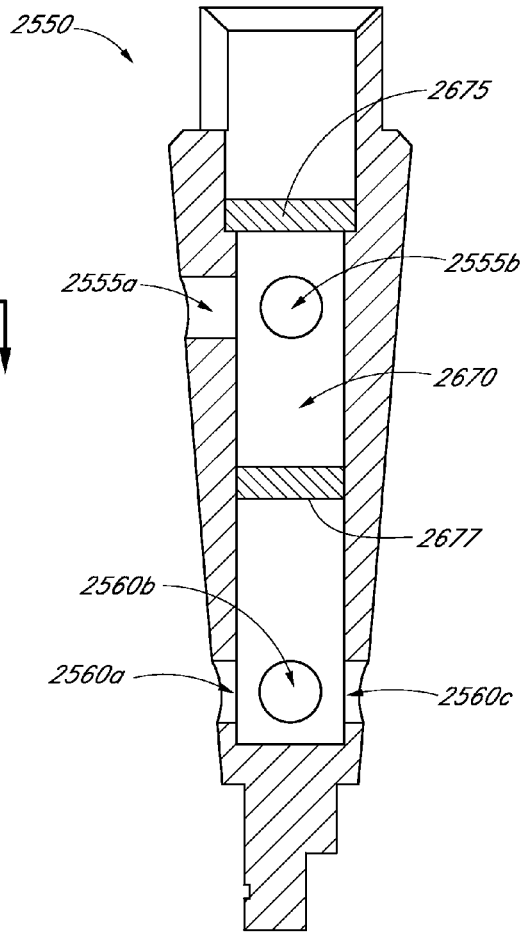
FIG. 33B is a cross-sectional view of the valve body of FIG. 33A taken along the view line 33B-33B.
Figure 33C:
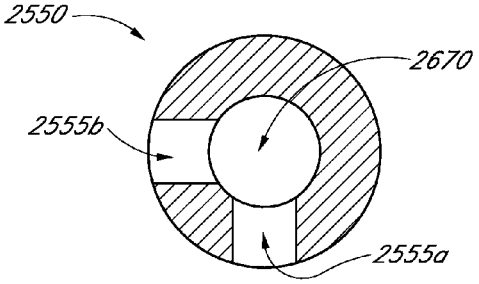
FIG. 33C is a cross-sectional view of the valve body of FIG. 33A taken along the view line 33C-33C.
Figure 33D:
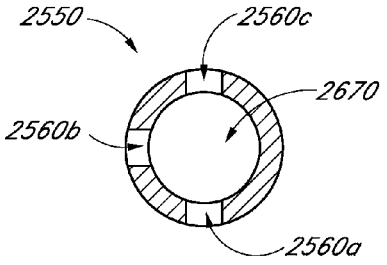
FIG. 33D is a cross-sectional view of the valve body of FIG. 33A taken along the view line 33D-33D.

With reference to FIG. 32, in certain embodiments, the housing 2510 defines a cavity 2240 configured to receive a valve body 2550. The housing 2510 and/or the valve body 2550 can be coupled with a biasing member 2280, a shaft 2290, and a cap 2300 via one or more fasteners 2308 and a split washer 2296, such as similarly numbered features described above. In some embodiments, the housing 2510 is coupled with a plug 2312.

The valve body 2550 can resemble the valve body 1250 in certain respects and/or can include different features. In some embodiments, the valve body 2550 defines an upper set of apertures 2555 and a lower set of apertures 2560, which are described more fully below. In some embodiments, the valve body 2550 defines a protrusion 2570 that can extend from a lower end of the valve body 2550. The protrusion 2570 can define a substantially flat face 2572 and a channel 2574. In certain embodiments, the protrusion 2570 extends through a lower end of the housing 2510 in the assembled valve assembly 2500.

In some embodiments, the valve assembly 2500 includes a cam 2580 configured to couple with the protrusion 2570 of the valve body 2550. The cam 2580 can define an aperture 2582 through which a portion of the protrusion 2570 can extend. In some embodiments, the aperture 2582 is sized such that the protrusion 2570 fits snugly therein. In some embodiments, the aperture 2582 is shaped substantially as a semicircle, and can comprise a flat face which, in further embodiments, extends through an axial or rotational center of the cam 2580. The flat face of the aperture 2582 can abut the flat face 2572 of the protrusion 2570, and can cause the cam 2580 to rotate about the axial center when the valve body 2550 is rotated within the housing 2510. In certain embodiments, the cam 2580 is retained on the protrusion 2570 via a split washer 2584. In some embodiments, a rod 2586 extends from a lower surface of the cam 2580. The rod 2586 can be substantially cylindrical, thus comprising a substantially smooth and rotationally symmetric outer surface.

In some embodiments, the housing 2510 defines a projection 2590 at a lower end thereof. The projection 2590 can be configured to couple with a gasket 2592, an O-ring or sealing member 2594, a first nozzle member 2600 and a cover 2605, as further described below. In some embodiments, the cover 2605 is coupled with the projection 2590 via fasteners 2608.

As with the cover 1324, the cover 2605 can define a substantially flat surface 2610 configured to abut a flat surface defined by the projection 2590, and in some embodiments, the cover 2605 defines a collar 2400. The cover 2605 can also define a rounded side surface 2612. A radius of the side surface 2612 can be slightly larger than the radius of a rounded portion of the cam 2580, and can thus permit the rounded portion of the cam 2580 to rotate proximate the cover 2605 in the assembled valve assembly 2500.

In certain embodiments, the cover 2605 is configured to be coupled with a shroud, sleeve, occlusion member, or cover 2620 and a second nozzle member 2625. In some embodiments, the cover 2620 is substantially cylindrical. An upper surface of the cover 2620 can be substantially flat, and can define an opening 2630. The opening 2630 can be sized to receive a rim 2632 of the second nozzle member 2625. The opening 2630 can be substantially circular, and can define a diameter slightly larger than an outer diameter of the rim 2632 of the second nozzle member 2625. Accordingly, in some embodiments, the cover 2620 can rotate about the rim 2632 of the second nozzle member 2625 with relative ease in the assembled valve assembly 2500.

The cover 2620 can define one or more screens 2634 separated by one or more gaps 2636. In some embodiments, each screen 6234 extends about a greater portion of a circumference of the cover 2620 than does one or more neighboring gaps. In some embodiments, each screen 2634 is substantially the same size and shape, and is spaced adjacent screens 2634 by an equal amount. Other arrangements are also possible.

The cover 2620 can define an extension 2640 that projects from a top end of the cover 2620. In some embodiments, the extension 2640 is substantially coplanar with a top surface of the cover 2620, and in other embodiments, a plane defined by the extension 2640 is substantially parallel to the plane of the top surface. In some embodiments, the extension 2640 defines a slot 2642 configured to receive the rod 2586 of the cam 2580. As further discussed below, the cam 2580 can cooperate with the extension 2640 to rotate the cover 2620 as the valve body 2550 is rotated.

In some embodiments, the cover 2620 is configured to receive a fuel directing member, tube, pipe, or conduit 2650, which in some embodiments, comprises or is coupled with the burner delivery line 2143. In other embodiments, the cover 620 is received within the conduit 2650. In some embodiments, the cover 2620 and conduit 2650 cooperate to form a mixing section, passageway, chamber, corridor, or compartment 2660. As further described below, the mixing compartment 2660 can define one or more adjustably sized air intakes, channels, apertures, openings, flow areas, spaces, flow paths, or windows 2665 through which air can flow to mix with fuel delivered to the conduit 2650 via the valve assembly 2500. For example, a flow area of the windows 2665 can vary between a first operational configuration and a second operational configuration of the valve assembly 2500.

With reference to FIGS. 33A-33D, in certain embodiments, the valve member 2550 defines a series of upper apertures 2555*a, b* and a series of lower apertures 2560*a, b, c*. Each of the apertures 2555*a, b* and 2560*a, b, c* can be in fluid communication with a cavity 2670 defined by the valve body 2550. In some embodiments, the valve body 2550 includes a cap 2675 configured to seal the cavity 2670. Accordingly, in some embodiments, fuel can enter the cavity 2670 via one or more of the apertures 2555*a, b* and 2560*a, b, c*, can substantially fill the cavity 2670, and can exit the cavity 2670 via one or more of the apertures 2555*a, b* and 2560*a, b, c*, depending on the orientation of the valve body 2550. In other configurations, a separator 2677, such as a plate or an insert, is positioned between the upper and lower apertures 2555*a, b*, 2560*a, b, c*, substantially preventing fluid communication between the upper and lower apertures. Such configurations can be desirable for applications in which fuel entering the upper apertures 2555*a, b* is preferably maintained separate from fuel entering the lower apertures 2560*a, b, c*. Any suitable combination of the features of the valve member 2550 is possible.

Figure 34:
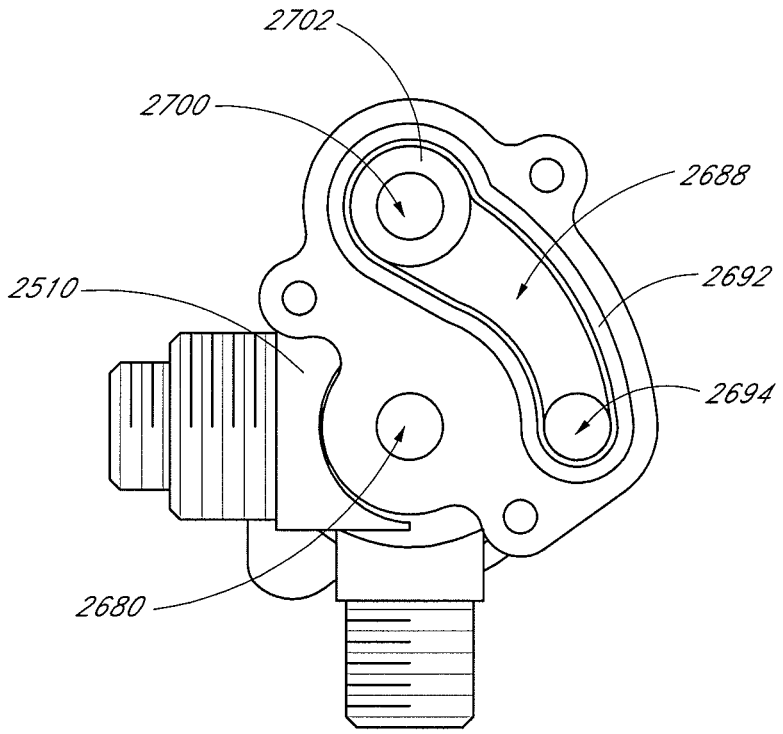
FIG. 34 is a bottom plan view of the valve assembly of FIG. 31.

With reference to FIG. 34, in certain embodiments, the housing 2510 defines an opening 2680 through which the protrusion 2570 of the valve body 2550 can extend. The housing can define a recess 2688, similar to the recess 1388. The recess 2688 can cooperate with the cover 2605 to define a passage through which fuel can flow. In some embodiments, the housing 2510 defines a channel 2692, similar to the channel 1392, which can be configured to receive the gasket 2592 in order to create a substantially fluid-tight seal between the housing 2510 and the cover 2605. In some embodiments, fuel can flow from a first egress aperture 2694 defined by the housing 2510 and into the passage defined by the recess 2688 and the cover 2605 when the valve assembly 2500 is in a first operational configuration, as further described below.

In some embodiments, the housing 2510 defines a second egress aperture 2700. As further described below, in some embodiments, fuel can flow from the second egress aperture 2700 into the first nozzle member 2600 when the valve assembly 2500 is in a second operational configuration. In some embodiments, the housing 2510 defines a recess 2702 about the second egress aperture 2700 which can be sized and shaped to receive the sealing member 2594, and can be configured to form a substantially fluid-tight seal therewith.

Figure 35:
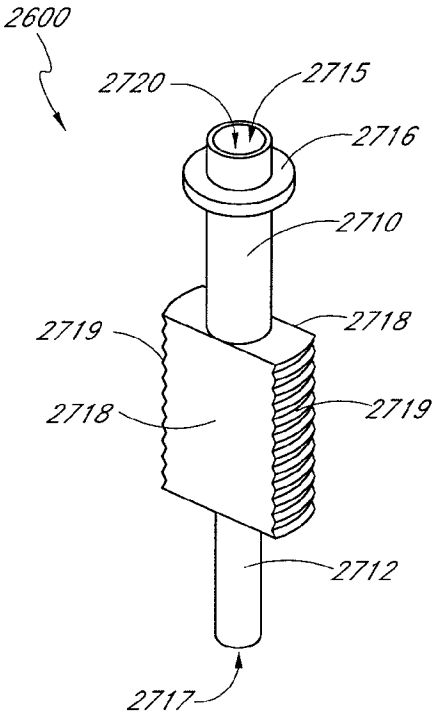
FIG. 35 is a perspective view of an embodiment of a nozzle member compatible with the valve assembly of FIG. 31.

With reference to FIG. 35, in certain embodiments, a first nozzle member 2600 includes an upper stem 2710, a lower stem 2712, and a body 2714. In some embodiments, the upper stem 2710 is substantially cylindrical. The upper stem can define an input 2715 configured to receive fuel into the first nozzle member 2600, and can include shelf 2716 configured to contact the sealing member 2594 in the assembled valve assembly 2500. The lower stem 2712 can also be substantially cylindrical, and can define an outer diameter smaller than an outer diameter of the upper stem 2710. The lower stem 2712 can define an output 2717 configured to dispense fuel. In some embodiments, an inner diameter defined by the lower stem 2712 is smaller than an inner diameter defined by the upper stem 2710.

In some embodiments, the body 2714 includes two substantially flat faces 2718, which can be oriented substantially parallel to each other. The faces 2718 can extend outward from the upper and lower stems 2710, 2712, and can thus define wings. In some embodiments, the nozzle member 2600 includes one or more connection interfaces 2719 configured to engage the second nozzle member 2600. In some embodiments, the connection interfaces 2719 comprise curved, threaded surfaces that extend from one face 2718 to another.

The first nozzle member 2600 can define an inner flow path 2720 that extends through the upper and lower stems 2710, 2712 and the body 2714. In some embodiments, fuel can flow through the inner flow path 2720 when the valve assembly 2500 is in the second operational configuration.

Figure 36:
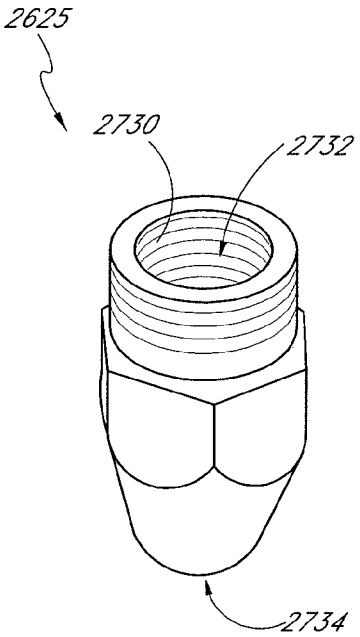
FIG. 36 is a perspective view of an embodiment of a nozzle member compatible with the valve assembly of FIG. 31.

With reference to FIG. 36, in certain embodiments, an inner surface 2730 of a second nozzle member 2625 is threaded or includes any other suitable connection interface for coupling with the connection interface or interfaces 2719 of the first nozzle member 2600. In some embodiments, the threading extends through a substantial portion of the second nozzle member 2625, and extends downward to an inwardly projecting ridge or shelf that can serve as a stop against which a lower edge of the body 2714 of the first nozzle member 2600 can abut. The second nozzle member 2625 can define an input 2732 configured to receive fuel, and an output 2734 configured to dispense fuel.

Figure 37:
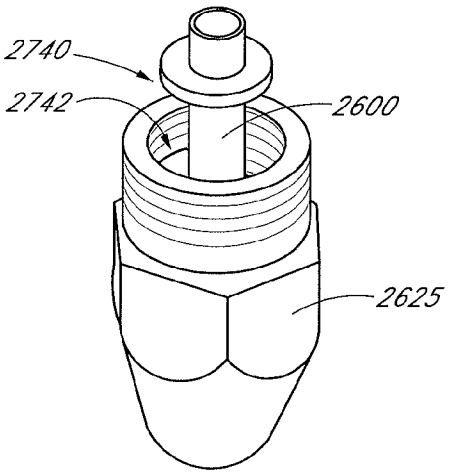
FIG. 37 is a perspective view of the nozzle members of FIGS. 35 and 36 in a coupled configuration.

With reference to FIG. 37, in certain embodiments, the first and second nozzle members 2600, 2625 define a gap 2740 through which fuel can flow. In some embodiments, fuel can flow through the gap 2740 and through an outer flow path 2742, which can be defined by an outer surface of the first nozzle member 2600 and an inner surface of the second nozzle member 2625. In some embodiments, fuel flows through the gap 2740 and the outer flow path 2742 when the valve assembly 2500 is in the first operational configuration.

Figure 38A:
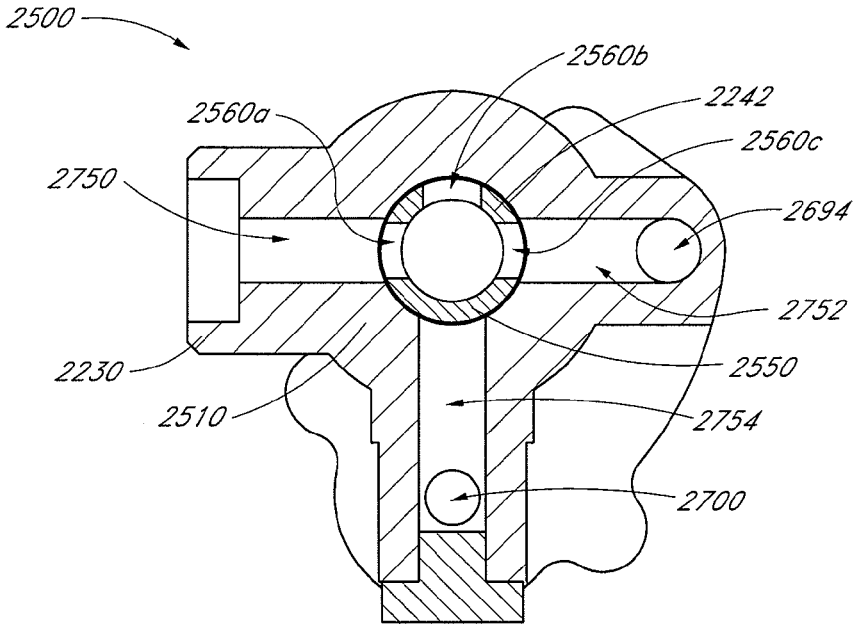
FIG. 38A is a cross-sectional view of the valve assembly of FIG. 31 taken along the view line 38A-38A showing the valve assembly in a first operational configuration.

FIG. 38A illustrates an embodiment of the valve assembly 2500 comprising a housing 2510 that defines an input flow path 2750, a first egress flow path 2752, and a second egress flow path 2754. In the illustrated embodiment, the valve assembly is in the first operational configuration. In the first configuration, the valve body 2550 is oriented in a first position such that the ports 2560*a*, 2560*c* provide fluid communication between the input flow path 2750 and the first egress flow path 2752. In some embodiments, the port 2560*b* is directed toward the inner sidewall 2242 of the housing 2510, which can substantially prevent fluid flow out of the port 2560*b*. Additionally, the valve body 2550 can substantially block the second egress flow path 2754, thereby substantially preventing fluid flow through the second egress flow path 2754.

Accordingly, in certain embodiments, in the first operational configuration, the valve assembly 2500 can accept fuel via the burner input 2230, can direct the fuel along the input flow path 2750, through the valve body 2550, through the first egress flow path 2752 and out the first egress aperture 2694. As described above, fuel flowing through the first egress aperture 2694 can progress through the passage defined by the recess 2688 and the cover 2605. The fuel can flow through the gap 2740 and the outer flow path 2742 defined by the first and second nozzle members 2600, 2625, and can be dispensed via the output 2734 of the second nozzle member 2625.

In certain embodiments, when the valve assembly 2500 is in the first operational configuration, the valve body 2550 is oriented such that the port 2555*a* (see FIG. 33C) is in fluid communication with the pilot input 2220 and the port 2555*b* (see FIG. 33C) is in fluid communication with the first pilot output 2222. The valve body 2550 can thus function similarly to the valve body 2550, and can direct fuel from the pilot input 2220 to the first pilot output 2222.

Figure 38B:
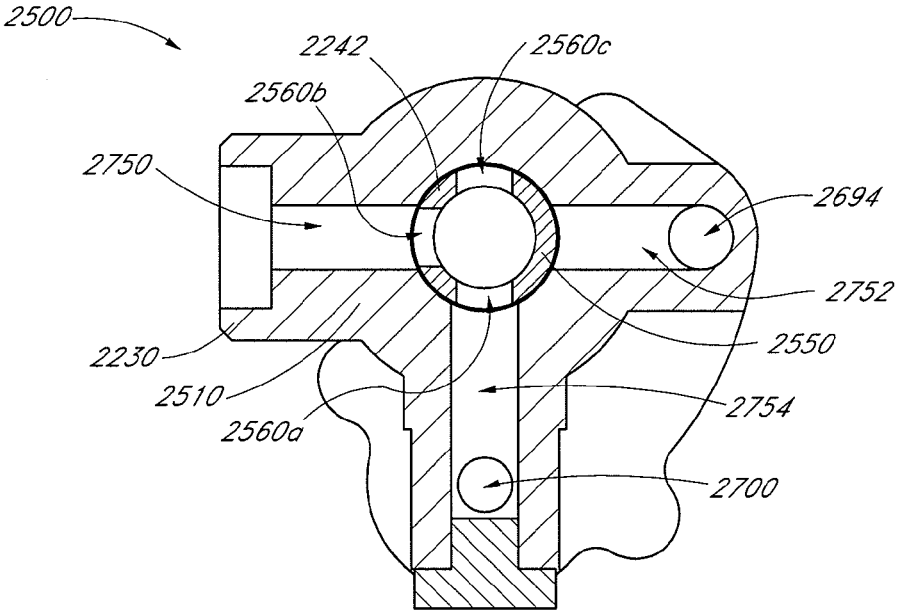
FIG. 38B is a cross-sectional view of the valve assembly of FIG. 31 similar to the view depicted in FIG. 38A showing the valve assembly in a second operational configuration.

FIG. 38B illustrates an embodiment of the valve assembly 2500 in the second operational configuration. In the second configuration, the valve body 2550 is oriented in a second position such that the ports 2560*a*, 2560*b* provide fluid communication between the input flow path 2750 and the second egress flow path 2754. In some embodiments, the port 2560*c* is directed toward the inner sidewall 2242 of the housing 2510, which can substantially prevent fluid flow out of the port 2560*c*. Additionally, the valve body 2550 can substantially block the first egress flow path 2752, thereby substantially preventing fluid flow through the first egress flow path 2752.

Accordingly, in certain embodiments, in the second operational configuration, the valve assembly 2500 can accept fuel via the burner input 2230, can direct the fuel along the input flow path 2750, through the valve body 2550, through the second egress flow path 2754 and out the second egress aperture 2700. Fuel flowing through the second egress aperture 2700 can progress through the first nozzle member 2600 and can be dispensed by the output 2717.

In certain embodiments, when the valve assembly 2500 is in the second operational configuration, the valve body 2550 is oriented such that the port 2555*b* (see FIG. 33C) is in fluid communication with the pilot input 2220 and the port 2555*a* (see FIG. 33C) is in fluid communication with the second pilot output 2224. The valve body 2550 can thus function similarly to the valve body 2250, and can direct fuel from the pilot input 2220 to the second pilot output 2224.

Figure 39A:
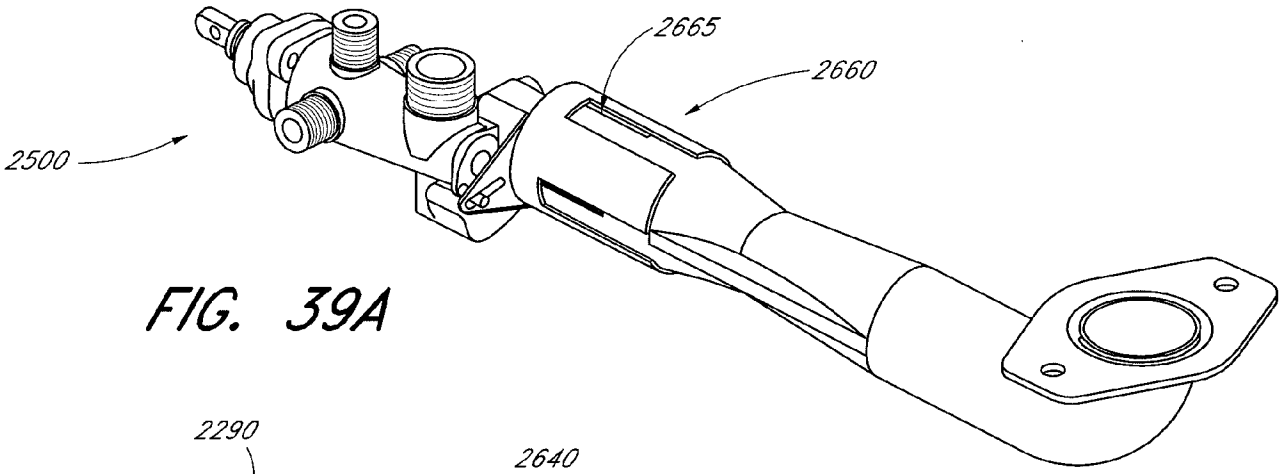
FIG. 39A is a perspective view of the valve assembly of FIG. 31 coupled with an embodiment of a fuel delivery line showing the valve assembly in the first operational configuration.

With reference to FIG. 39A, in certain embodiments, the first and second nozzle members 2600, 2625 are positioned to deliver fuel to the mixing compartment 2660. In the illustrated embodiment, the valve assembly 2500 is in the first configuration such that fuel can be dispensed via the second nozzle member 2625. The flow channels or windows 2665 are relatively small and allow a relatively small amount and/or a relatively low flow rate of air therethrough. In some embodiments, as fuel is dispensed from the second nozzle member 2625, air is drawn through the windows 2665. In some embodiments, the size of the windows 2665 is such that the amount of air drawn into the mixing compartment 2660 is adequate to form an air-fuel mixture that combusts as a substantially yellow flame (e.g., a flame of which a substantial portion is yellow) at the burner 2135. In some embodiments, the valve assembly 2500 is configured to dispense natural gas at a first pressure so as to produce a substantially yellow flame at the burner 2135.

Figure 39B:
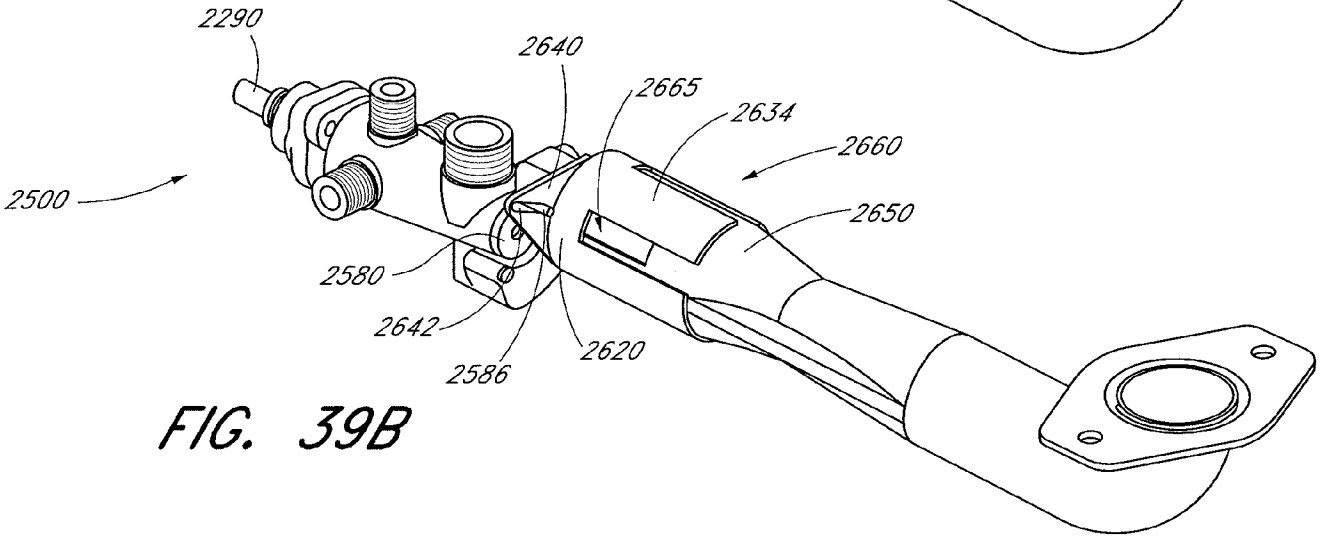
FIG. 39B is a perspective view of the valve assembly of FIG. 31 coupled with a fuel delivery line showing the valve assembly in the second operational configuration.

With reference to FIG. 39B, the valve assembly 2500 can be configured to transition to the second operational configuration. In certain embodiments, the shaft 2290 is rotated, thereby rotating the valve body 2550, which rotates the cam 2580. In some embodiments, rotation of the cam 2580 translates the rod 2586 within the slot 2642 defined by the extension 2640, thereby imparting rotational movement to the cover 2620. Movement of the cover 2620 can rotate the screens 2634 relative to openings in the conduit 2650, thereby adjusting the size of the windows 2665. For example, prior to rotation of the screens 2634, the windows 2665 can define a first flow area, and subsequent to rotation of the screens 2634, the windows 2665 can define a second flow area which varies from the first flow area. Accordingly, in some embodiments, the effective flow area defined by the windows 2665 changes due to movement of the cover 2620 and/or the conduit 2650.

In some embodiments, when the valve assembly 2500 is in the second operating configuration, the windows 2665 are relatively larger than they are when the valve assembly 2500 is in the first configuration. In some embodiments, the size of the windows 2665 changes by a predetermined amount between the first and second configurations.

In some embodiments, the size of the windows 2665 is such that, when the valve assembly 2500 is in the second configuration, the amount of air drawn into the mixing compartment 2660 is adequate to form an air-fuel mixture that combusts as a substantially yellow flame at the burner 2135. In some embodiments, the valve assembly 2500 is configured to dispense liquid propane at a second pressure so as to produce a substantially yellow flame at the burner 2135. In some embodiments, the second pressure at which liquid propane is dispensed is larger than the first pressure at which natural gas is dispensed when the valve assembly is in the first configuration.

The valve assembly 2500 can transition from the second operational configuration to the first operational configuration. In certain embodiments, the screens 2634 occlude a larger portion of the openings defined by the conduit 2650 when the valve assembly 2500 transitions from the second operational configuration to the first operational configuration, thus reducing the size of the windows 2665. Advantageously, the valve assembly 2500 can transition between the first and second operating configurations as desired with relative ease. Accordingly, a user can select whichever configuration is appropriate for the fuel source with which the valve assembly 2500, and more generally, the heating device 2010, is to be used.

Figure 40:
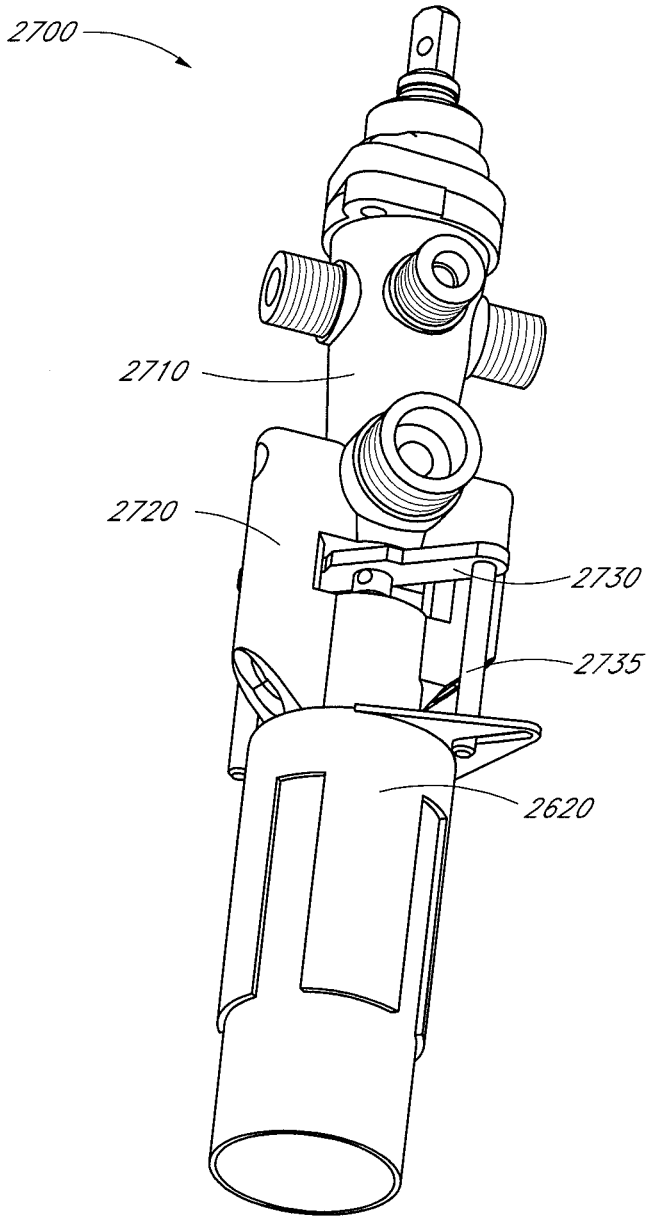
FIG. 40 is a perspective view of another embodiment of a valve assembly compatible with, for example, certain embodiments of the heating device of FIG. 28.

FIG. 40 illustrates another embodiment of a valve assembly 2700 similar to the valve assembly 2500. The valve assembly 2700 can include a housing 2710 that defines a channel housing 2720. The valve assembly 2700 can include a cam 2730 from which a rod 2735 extends to interact with the cover 2620.

Figure 41:
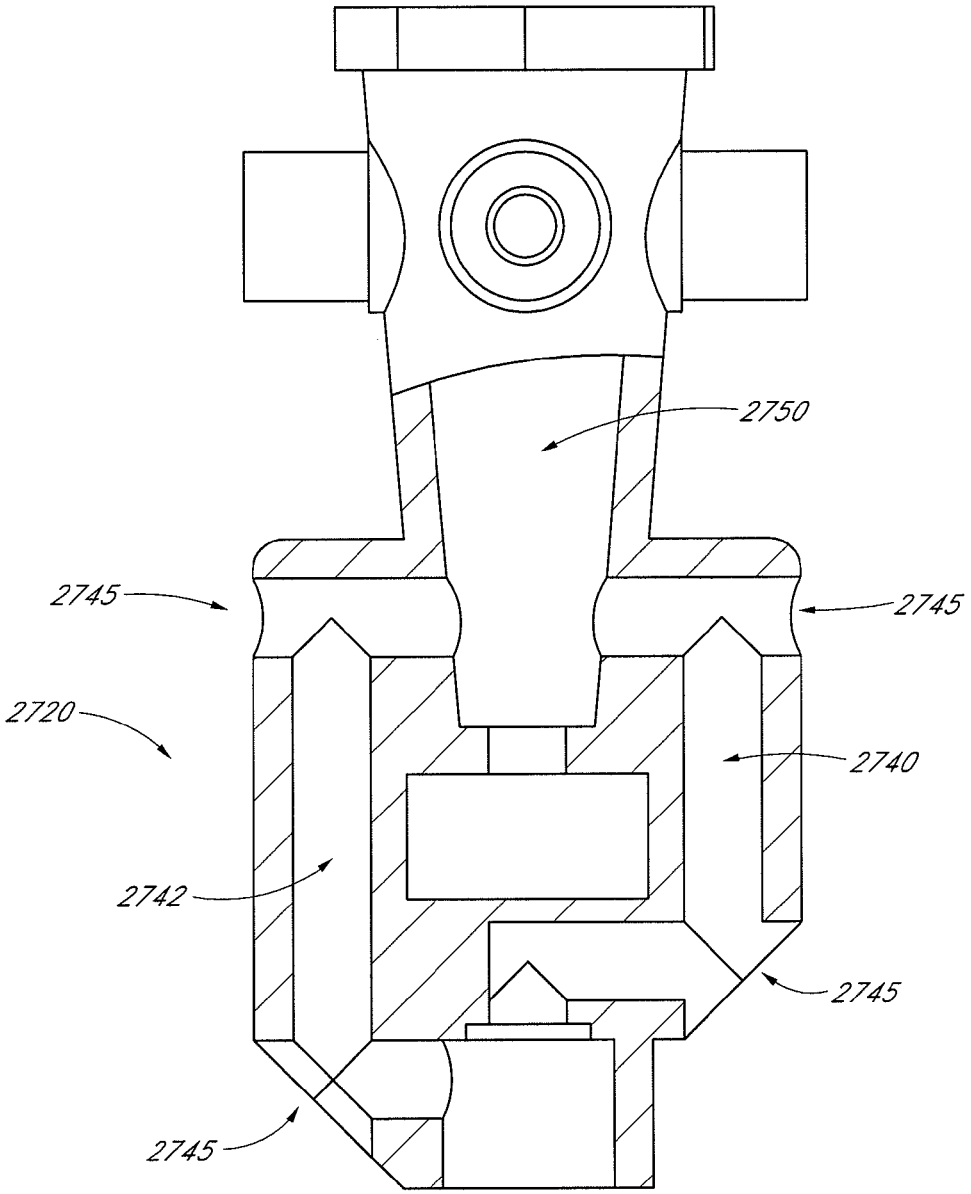
FIG. 41 is a partial cross-sectional view of a housing compatible with the valve assembly of FIG. 40.

With reference to FIG. 41, in certain embodiments, the channel housing 2720, can define a first channel 2740 configured to direct fuel to the first nozzle member 2600, and can define a second channel 2742 configured to direct fuel to the second nozzle member 2625. In some embodiments, the first and second channels 2740, 2742 are formed via multiple drillings, and access holes 2745 formed during the drillings are subsequently plugged. In some embodiments, the first and second channels 2740, 2742 extend from substantially opposite sides of a chamber 2750.

Figure 42A:
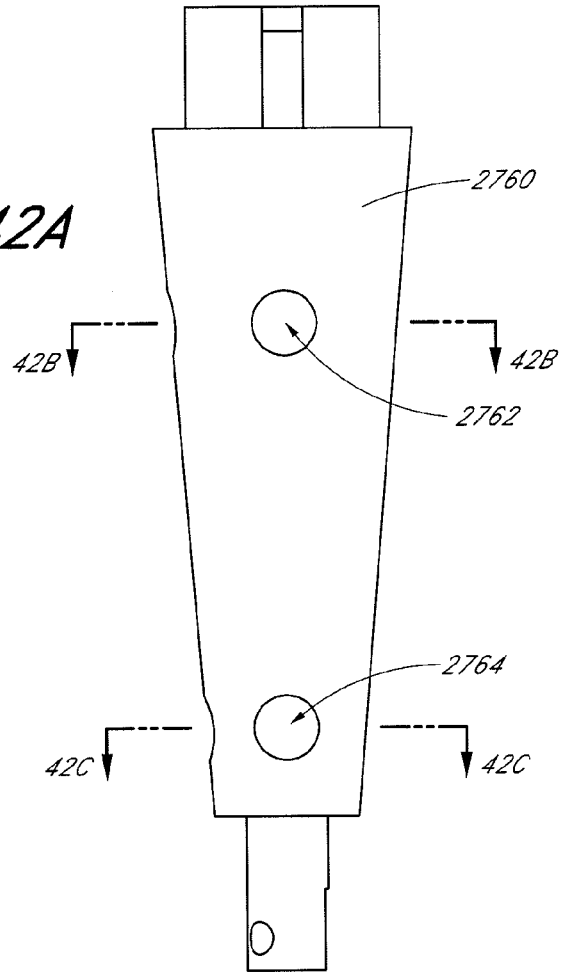
FIG. 42A is a front plan view of an embodiment of a valve body compatible with the valve assembly of FIG. 40.
Figure 42B:
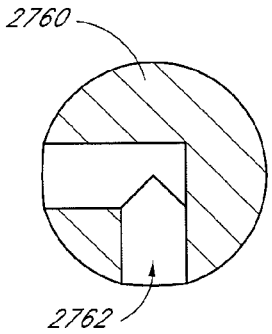
FIG. 42B is a cross-sectional view of the valve body of FIG. 42A taken along the view line 42B-42B.
Figure 42C:
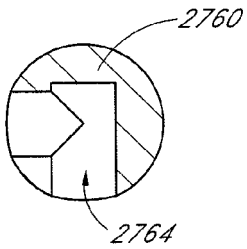
FIG. 42C is a cross-sectional view of the valve body of FIG. 42A taken along the view line 42C-42C.

With reference to FIGS. 42A-C, in some embodiments, a valve member or valve body 2760 compatible with embodiments of the valve assembly 2700 defines an upper flow channel 2762 and a lower flow channel 2764 that are similarly shaped, and can be formed by drilling into a body of the valve body 2760. Each flow channel 2762, 2764 can redirect fluid flow at an angle of about 90 degrees. Other angles are possible. In some embodiments, respective ingress ports and egress ports of the flow channels 2762, 2764 are substantially coplanar along a plane running through a longitudinal axis of the valve body 2760. The ingress and/or egress ports can also be offset from each other.

Figure 43:
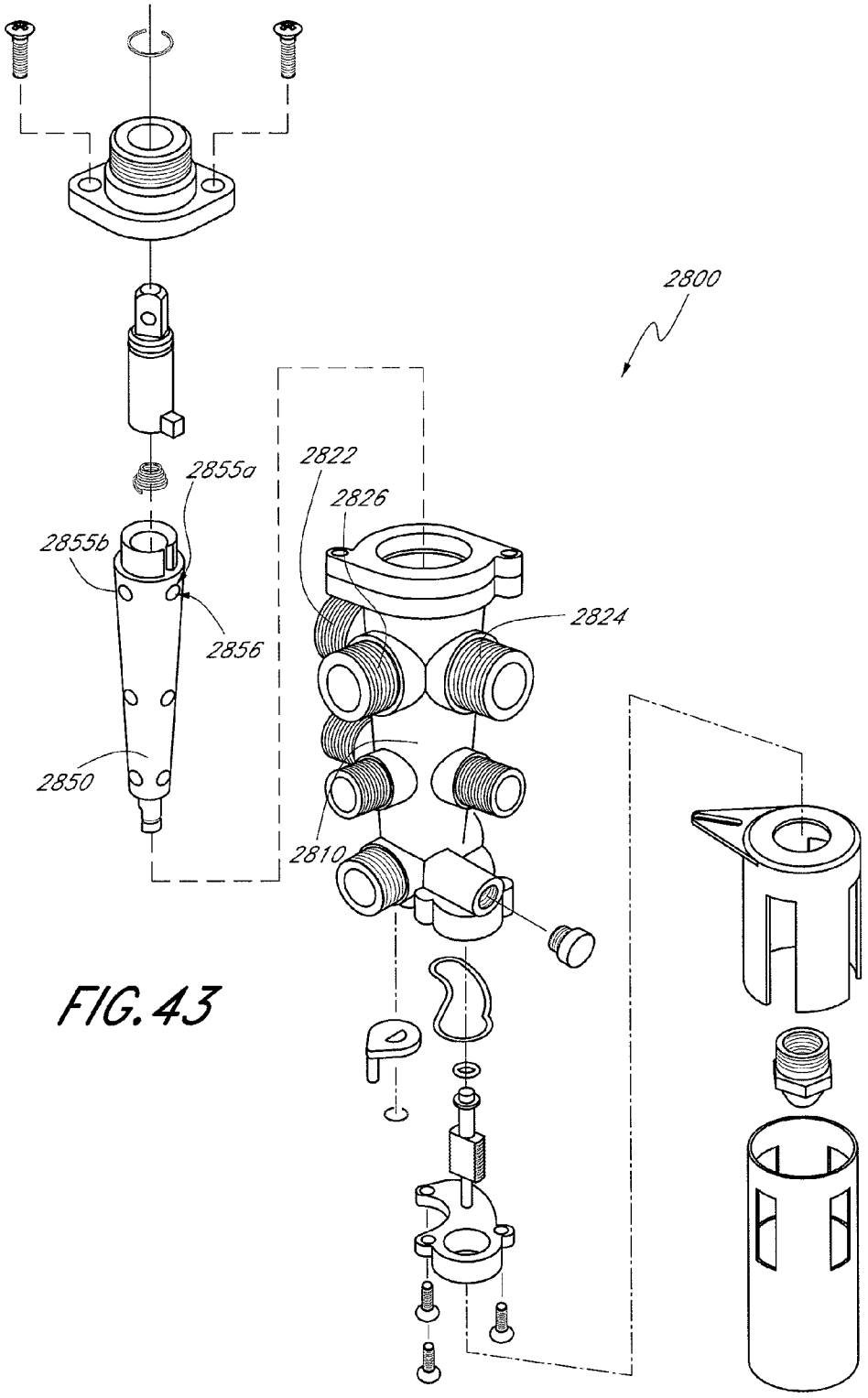
FIG. 43 is an exploded perspective view of an embodiment of a valve assembly compatible with, for example, the heating device of FIG. 28.

FIG. 43 illustrates another embodiment of a valve assembly 2800 compatible with certain embodiments of the heating device 2010. In certain embodiments, the valve assembly 2800 resembles the valve assemblies 1140, 1540, 2500, and 2700 in many respects, and can differ in manners such as those described hereafter.

In certain embodiments, the valve assembly 2800 includes a housing 2810 such as the housing 2510, but further comprising a first system supply input 2822, a second system supply input 2824, and a system supply output 2826. The system supply inputs 2822, 2824 and the system supply output 2826 can resemble the system supply inputs 1622, 1624 and the system supply output 1626 of the housing 1610.

In some embodiments, the valve assembly 2800 includes a valve body 2850 such as the valve body 2550, but further comprising a first top aperture 2855*a* and a second top aperture 2855*b*, and defining a top channel 2856. The top apertures 2855*a, b* can resemble the top apertures 1655*a, b* of the valve body 1650, and the top channel 2856 can resemble the top channel 1706 of the valve body 1650.

In certain embodiments, the valve assembly 2800 can be included in the heating device 2010. For example, in some embodiments, the regulators 1521, 1522 replace the regulator 2120. In further embodiments, the regulator 1521 is coupled with the first system supply input 2822 of the valve assembly 2800 via the first preliminary conduit 1531, and the regulator 1522 is coupled with the second supply input 2824 via the second preliminary conduit 1532. The system supply output 2826 of the valve assembly 2800 can be coupled with the source line 2125 of the heating device 2010. In other embodiments, the valve assembly 1540 can be included in the heating device 2010 in a similar manner.

Figure 44:
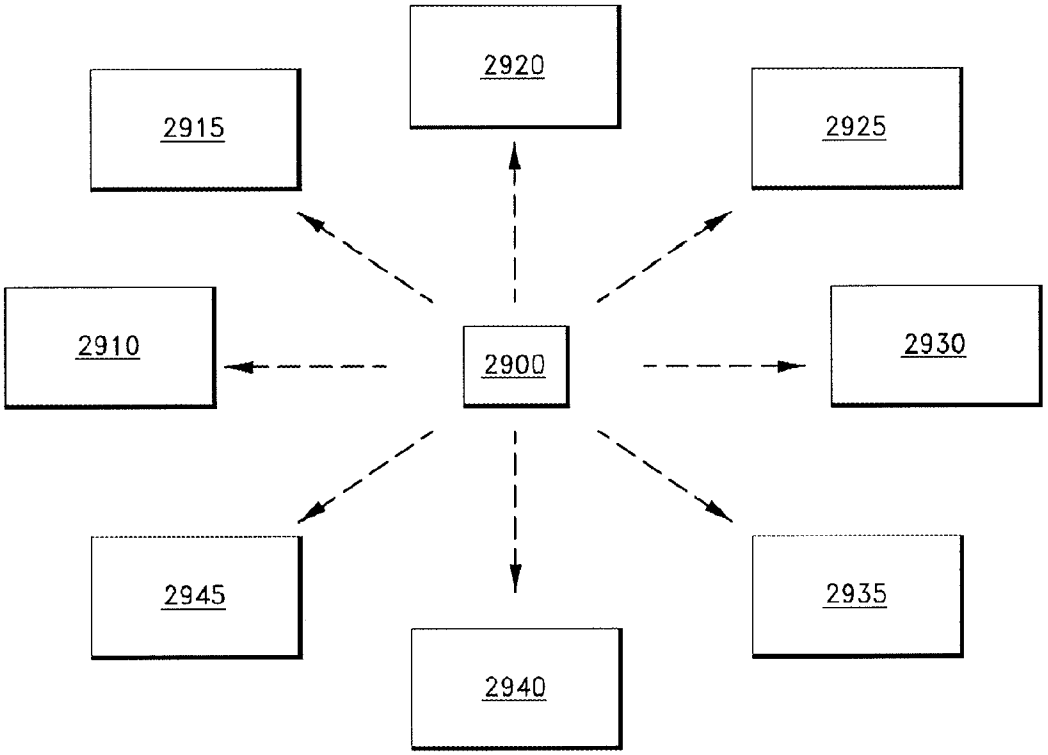
FIG. 44 is a schematic illustration showing a variety of fluid-fueled units in which embodiments of the valve assemblies of FIGS. 16, 27A, 31, 40, and 43 can be included.

FIG. 44 schematically illustrates a valve assembly 2900, which can include any suitable combination of the valve assemblies 1140, 1540, 2500, 2700, and 2800; features or components of the valve assemblies 1140, 1540, 2500, 2700, and 2800; and/or subcomponents of the valve assemblies 1140, 1540, 2500, 2700, and 2800. As illustrated by dashed arrows, the valve assembly 2900 can be included in any of a variety of fireplaces 2910, fireplace inserts 2915, gas logs 2920, heating stoves 2925, cooking stoves 2930, barbecue grills 2935, water heaters 2940, or devices 2945 configured to produce a flame and/or operate using a fluid fuel source.

Figure 46:
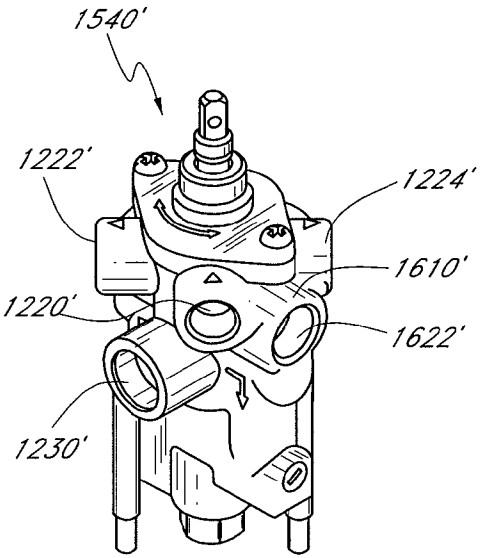
FIG. 46 illustrates a perspective view of the valve assembly of FIG. 45.
Figure 45A:
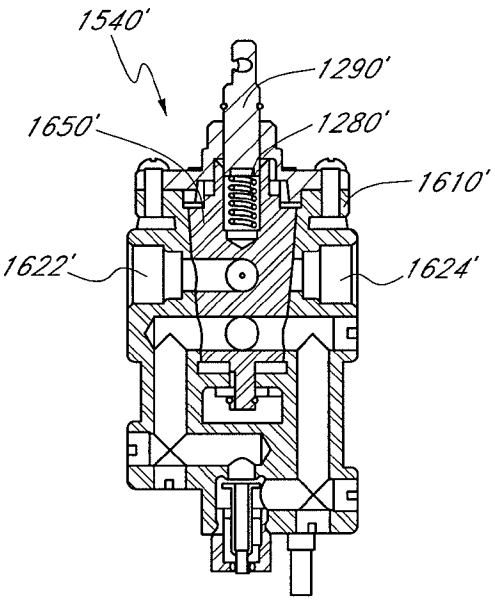
FIG. 45A illustrates a cross-sectional view of the valve assembly of FIG. 45 taken across line 45A-45A.
Figure 45:
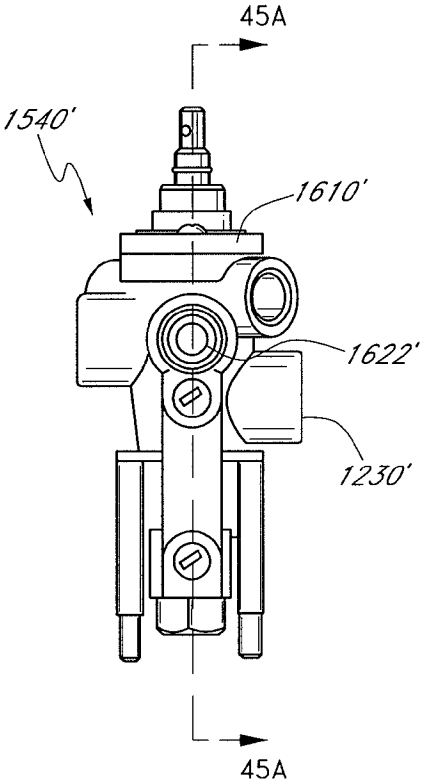
FIG. 45 illustrates a side view of an embodiment of a valve assembly compatible with, for example, the heater of FIG. 26.

With respect to the Heater 1510 illustrated in FIGS. 26 and 26A, in some embodiments, an embodiment of valve assembly 1540' is illustrated in FIGS. 45-47. In certain embodiments, the valve assembly 1540' can be coupled with the first and second preliminary conduits 1531, 1532, the intake pipe 122, the fuel supply pipe 124, the ODS pipe 126, the first ODS line 143, and the second ODS line 144 in a similar fashion as discussed with the valve assembly 1540 of FIG. 27 (FIGS. 26, 26A). As further described below, in some embodiments, the valve assembly 1540' can be configured to direct fuel received from either the first preliminary conduit 1531 or the second preliminary conduit 1532 to the intake pipe 122, to direct fuel received from the ODS pipe 126 to either the first ODS line 143 or the second ODS line 144, and to direct fuel received from the fuel supply pipe 124 along different flow paths into the burner 190. In some embodiments, the valve assembly 1540' is coupled with a knob, which can transition the valve assembly 1540' between a first and a second operational state.

As with other embodiments of valve assembly described herein 1140, 1540, in certain embodiments, the valve assembly 1540' is configured to operate in a first operational state or in a second operational state. In certain embodiments, when the valve assembly 1540' is in the first operational state, fuel can be delivered from the first pressure regulator 1521 to the control valve. In certain embodiments, the first pressure regulator 1521 delivers fuel to the valve assembly 1540 via the first preliminary conduit 1531. As further described below, in certain embodiments, the valve assembly 1540 directs fuel flow from the first preliminary conduit 1531 to the intake pipe 122 and toward the control valve. In some embodiments, when in the first operational state, the valve assembly 1540 further directs fuel received from the control valve via the fuel supply pipe 124 along a first flow path into the burner 190, and directs fuel received from the control valve via the ODS pipe 126 to the ODS 180 via the first ODS line 143.

In certain embodiments, when the valve assembly 1540' is in the second operational state, fuel can be delivered from the second pressure regulator 1522 to the control valve. In certain embodiments, the second pressure regulator 1522 delivers fuel to the valve assembly 1540' via the second preliminary conduit 1532. As further described below, in certain embodiments, the valve assembly 1540' directs fuel flow from the second preliminary conduit 1532 to the intake pipe 1522 and toward the control valve. In some embodiments, when in the second operational state, the valve assembly 1540' further directs fuel received from the control valve via the fuel supply pipe 124 along a second flow path into the burner 190, and directs fuel received from the control valve via the ODS pipe 126 to the ODS 180 via the second ODS line 144.

With reference to FIGS. 45, 45A, 46, and 47A, in certain embodiments, the valve assembly 1540' includes a housing 1610'. The housing 1610' can comprise a unitary piece of material, or can comprise multiple pieces joined in any suitable manner. In some embodiments, the housing 1610' defines a first system supply input 1622' configured to couple with the first preliminary conduit 1531 and to receive fuel therefrom, and defines a second system supply input 1624' configured to couple with the second preliminary conduit 1532 and to receive fuel therefrom. The housing 1610' can define a system supply output 1626' configured to couple with the intake pipe 122 and to deliver fuel thereto.

In some embodiments, the housing 1610' defines an ODS input 1220' configured to couple with the ODS pipe 126 and to receive fuel therefrom. The housing 1610' can define a first ODS output 1222' configured to couple with the first ODS line 143 and to deliver fuel thereto, and can define a second ODS output 1224' configured to couple with the second ODS line 144 and to deliver fuel thereto. In certain embodiments, the housing 1610' defines a burner input 1230' configured to couple with the fuel supply pipe 124 and to receive fuel therefrom. As with the housing 1210, the housing 1610' can further define and/or partially define a first fuel path and a second fuel path via which fuel received via the burner input 1230' can be directed to the burner 190.

In certain embodiments, the housing 1610' defines a chamber or cavity configured to receive a valve body 1650'. The housing 1610' and/or the valve body 1650' can be coupled with a biasing member 1280' and a shaft 1290', and a cap for example, via one or more fasteners and a split washer, as described above. In some embodiments, the housing 1610' can be coupled with a plug.

The valve body 1650' can resemble the valve body 1250 and the valve body 1650 in certain respects and/or can include different features. In some embodiments, the valve body 1650' defines a set of top apertures 1655*a*', 1655*b*', a set of intermediate apertures 1657*a*', 1657*b*', and a set of bottom apertures 1659*a*', 1659*b*', 1659*c*', which are described more fully below.

In certain embodiments, the housing 1610' is configured to be coupled with a nozzle comprising a first nozzle member and/or a second nozzle member, as described above. In some embodiments, with the valve assembly in the first operational state, fluid can flow through the first nozzle member, and in the second operational state, fluid can flow through the second nozzle. In other embodiments, with the valve assembly in the first operational state, fluid can flow through the first nozzle and in the second operational state, fluid can flow through the first nozzle and the second nozzle. In some embodiments, the housing 1610' is further coupled with a cover, a gasket, and/or fasteners in a manner such as described above.

Figure 47A:
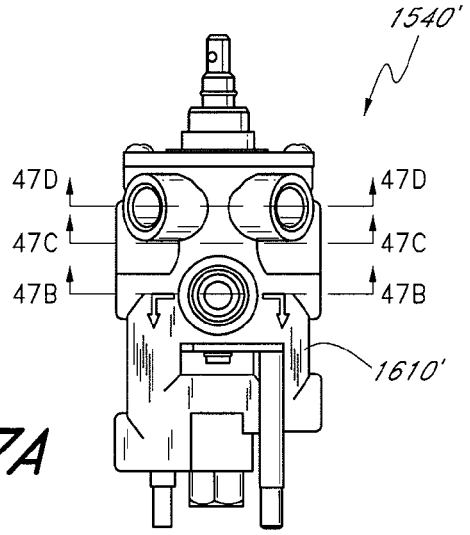
FIG. 47A is a front view of an embodiment of the valve assembly of FIG. 45.
Figure 47B:
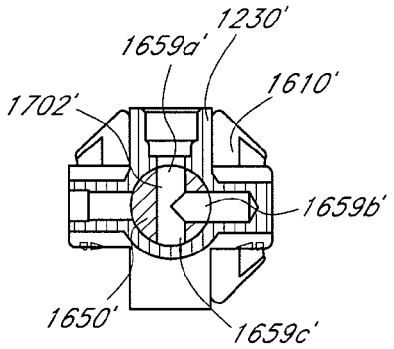
FIG. 47B is a cross-sectional view of the valve assembly of FIG. 47A taken along the view line 47B-47B.
Figure 47C:
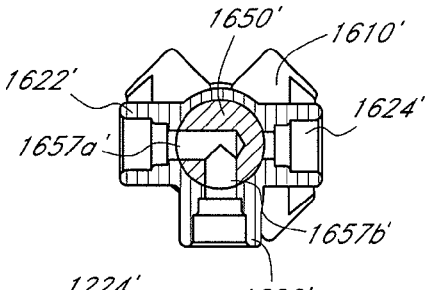
FIG. 47C is a cross-sectional view of the valve assembly of FIG. 47A taken along the view line 47C-47C in FIG. 47A.
Figure 47D:
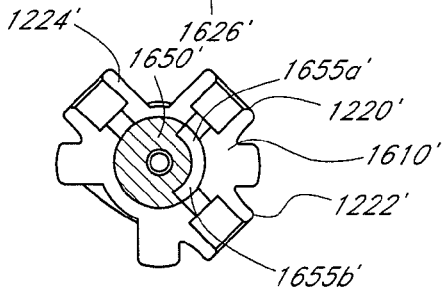
FIG. 47D is a cross-sectional view of the valve assembly of FIG. 47B taken along the view line 47D-47D in FIG. 47A.

With reference to FIGS. 47B-47D, in certain embodiments, the valve member 1650' defines a series of bottom apertures 1659*a*', 1659*b*', 1659*c*', intermediate apertures 1657*a*', 1657*b*', and top apertures 1655*a*', 1655*b*'. In some embodiments, the apertures 1659*a', b', c'*, 1657*a', b'*, and 1655*a', b'* are formed by drilling or boring a bottom flow channel 1702', an intermediate flow channel, and a top flow channel into a solid portion of the valve body 1650'. Other configurations are also possible.

In certain embodiments, the apertures 1659*a', b', c'* and the bottom flow channel 1702' operate in a manner similar to the ports 1262*a, b, c* and associated flow channel of the valve body 1250, as described above with respect to FIGS. 24A and 25A. Accordingly, in some embodiments, when the valve body 1650' is in the first state, the apertures 1659*a', b'* and flow channel 1702' are configured to direct fuel flow from the fuel supply pipe 124 along a first flow path through the nozzle to the burner 190. In some embodiments, fuel enters the aperture 1659*a*' and exits the aperture 1659*b*', as viewed from the perspective shown in FIG. 47B. In some embodiments, when in the first state, the valve body 1650 substantially prevents fluid communication between the fuel supply pipe 124 and a second flow path.

In some embodiments, when the valve body 1650' is in the second state (i.e., the valve body 1650' is rotated counterclockwise 90 degrees with respect to the housing 1610' from the view shown in FIG. 47B), the apertures 1659*a', b', c'* and the bottom flow channel 1702' are configured to direct fuel flow from the fuel supply pipe 124 along the second flow path to the burner 190. In some embodiments, fuel enters the aperture 1659*b*' and exits the apertures 1659*a*' and 1659*c*', and thus propagates in a substantially "T-shaped" fashion through the valve body 1650', as viewed from the perspective shown in FIG. 47B. Thus, in the illustrated embodiment, in the second position, fluid can flow through two apertures, and thus, two nozzles of a two-nozzle assembly. In other embodiments, when in the second state, the valve body 1650' can substantially prevents fluid communication between the fuel supply pipe 124 and the first flow path through the one of the nozzle members.

With reference to FIG. 47D, in certain embodiments, the apertures 1655*a*', 1655*b*' and the top flow channel can operate in a manner similar to the channel 1260 of the valve body 1250, as described above with respect to FIGS. 24B and 25B, and the channel 1704 of the valve body 1650 as described above with respect to FIGS. 27A and 27C. Accordingly, in some embodiments, when the valve body 1650' is in the first state, the apertures 1655*a', b'* are configured to direct fuel flow from the ODS pipe 126 to the first ODS line 143. In some embodiments, fuel enters the aperture 1655*a*' and exits the aperture 1655*b*', and thus propagates in a substantially clockwise direction through the valve body 1650', as viewed from the perspective shown in FIG. 47D. In some embodiments, when in the first state, the valve body 1650' substantially prevents fluid communication between the ODS pipe 126 and the second ODS line 144.

In some embodiments, when the valve body 1650' is in the second state, the apertures 1655*a', b'* and the intermediate flow channel are configured to direct fuel flow from the ODS pipe 126 to the second ODS line 144. In some embodiments, fuel enters the aperture 1655*b*' and exits the aperture 1655*a*', and thus propagates in a substantially counterclockwise direction through the valve body 1650, as viewed from the perspective shown in FIG. 47D. In some embodiments, when in the second state, the valve body 1650' substantially prevents fluid communication between the ODS pipe 126 and the first ODS line 143.

With reference to FIG. 47C, in certain embodiments, the apertures 1657*a', b'* and the intermediate flow channel operate in a manner similar to the apertures 1655*a', b'* and the top flow channel, but conduct fuel in an opposite direction. Accordingly, in some embodiments, when the valve body 1650' is in the first state, the apertures 1657*a', b'* and the intermediate channel direct fuel flow from the first preliminary conduit 1531 to the intake pipe 122. In some embodiments, fuel enters the aperture 1657*a*' and exits the aperture 1657*b*', and thus propagates in a substantially counterclockwise direction through the valve body 1650', as viewed from the perspective shown in FIG. 47C. In some embodiments, when in the first state, the valve body 1650' substantially prevents fluid communication between the second preliminary conduit 1532 and the intake pipe 122. For example, in some embodiments, the valve body 1650' cooperates with the housing 1610' to prevent fuel from entering the cavity via the second preliminary conduit 1532.

In some embodiments, when the valve body 1650' is in the second state (i.e., the valve body 1650' is rotated counterclockwise 90 degrees with respect to the housing 1610' from the view shown in FIG. 47C), the apertures 1657*a', b'* and the intermediate channel are configured to direct fuel flow from the second preliminary conduit 1532 to the intake pipe 122. In some embodiments, fuel enters the aperture 1657*b*' and exits the aperture 1657*a*', and thus propagates in a substantially clockwise direction through the valve body 1650', as viewed from the perspective shown in FIG. 47C. In some embodiments, when in the second state, the valve body 1650' substantially prevents fluid communication between the first preliminary conduit 1530 and the intake pipe 122. For example, in some embodiments, the valve body 1650' cooperates with the housing 1610' to prevent fuel from entering the cavity via the first preliminary conduit 1530.

As can be appreciated from the foregoing discussion, in certain advantageous embodiments, the valve assembly 1540' is configured to transition the mode of the heater 1510 via a single actuator (e.g., the knob 920). Transition from one mode to another can thus be accomplished with relative ease. In some embodiments, the heater 1510 can be transitioned from a functional mode in which the heater 1510 is operable with a first fuel source (e.g., natural gas) to a mode in which the heater 1510 is operable with a second fuel source (e.g., propane), or vice versa.

Further, in some embodiments, the valve assembly 1540' can prevent a first variety of fuel from entering the heater 1510 and/or various components thereof when the heater 1510 is configured to be used with a second variety of fuel. For example, in certain embodiments, the first regulator 1521 is configured for use with propane gas and the second regulator 1522 is configured for use with natural gas. In some embodiments, if the first regulator 1521 is coupled with a propane gas source, but the valve assembly 1540' is oriented in a state for accepting natural gas via the regulator 1522, the valve assembly 1540' will substantially prevent any propane gas from entering the heater 1510 and/or various components thereof.

Any suitable combination of the valve assemblies 1140, 1540, 2500, 2700, and 2800; features or components of the valve assemblies 1140, 1540, 1540', 2500, 2700, and 2800; and/or subcomponents of the valve assemblies 1140, 1540, 1540', 2500, 2700, and 2800 is possible. Further, although various embodiments described herein are discussed in the context of two-fuel systems, it is appreciated that various features described can be adapted to operate with more than two fuels. Accordingly, certain embodiments that have two operational configurations can be adapted for additional operational configurations. For example, certain embodiments may have at least two operational states (e.g., a first operational state, a second operational state, and a third operational state). Therefore, use herein of such terms as "either," "both," or the like should not be construed as limiting, unless otherwise indicated.

Although the inventions have been disclosed in the context of certain preferred embodiments and examples, it will be understood by those skilled in the art that the inventions extend beyond the specifically disclosed embodiments to other alternative embodiments and/or uses and obvious modifications and equivalents thereof. The skilled artisan will appreciate, in view of the present disclosure, that certain advantages, features and aspects of certain features disclosed herein may be realized in a variety of other applications, many of which have been noted above. Additionally, it is contemplated that various aspects and features of the inventions described can be practiced separately, combined together, or substituted for one another, and that a variety of combinations and sub-combinations of the features and aspects can be made and still fall within the scope of the inventions. Thus, it is intended that the scope of the inventions herein disclosed should not be limited by the particular embodiments described above.

In the foregoing description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A gas-fueled heater comprising:

a housing having a plurality of holes passim therethrough and having positioned therein:

a first fluid pressure regulator configured to receive a first fluid from a fluid source;

a second fluid pressure regulator configured to receive a second fluid from a fluid source;

a fluid selection valve having a first inlet fluidly coupled to the first fluid pressure regulator and a second inlet fluidly coupled to the second fluid pressure regulator and configurable between a first state in which the fluid selection valve receives a flow of fluid from the first pressure regulator and a second state in which the fluid selection valve receives a flow of fluid from the second pressure regulator;

a control valve fluidly coupled to the fluid selection valve and configured to receive a flow of fluid therefrom and return a flow of fluid to the fluid selection valve; and a burner fluidly coupled to the fuel selection valve downstream of the control valve;

wherein a first hole of the plurality of holes is adjacent a bottom of the housing, the first hole configured to allow a fuel source to connect to one of the first and the second pressure regulators;

a first knob, wherein a second hole of the plurality of holes is adjacent a top of the housing, the first knob coupled to the control valve and configured to adjust a state of the control valve;

a second knob, wherein a third hole of the plurality of holes is at a back of the housing, the second knob coupled to the fluid selection valve and configured to adjust the fluid selection valve between the first state and the second state.

2. The gas-fueled heater of claim 1, wherein the fuel selection valve further comprises a first outlet fluidly coupled to the control valve.

3. The gas-fueled heater of claim 1, wherein the control valve comprises a fuel supply outlet, the fuel selection valve comprises a fuel selection inlet, and the appliance comprises a fuel supply conduit fluidly coupling the fuel supply outlet of the control valve to the fuel supply inlet of the fuel selection valve.

4. The gas-fueled heater of claim 1, wherein the wherein the control valve comprises an oxygen depletion sensor outlet, the fuel selection valve comprises a oxygen depletion sensor inlet, and the appliance comprises an oxygen depletion sensor conduit fluidly couples the oxygen depletion sensor outlet of the control valve to the oxygen depletion sensor inlet of the fuel selection valve.

5. The gas-fueled heater of claim 1, further comprising a first oxygen depletion sensor configured to receive the first fluid and a second oxygen depletion sensor configured to receive the second fluid.

6. The gas-fueled heater of claim 1, wherein the burner comprises a first nozzle and a second nozzle.

7. The gas-fueled heater of claim 6, wherein the first nozzle is arranged coaxially within the second nozzle.

8. The gas-fueled heater of claim 6, wherein the burner is configured such that the first nozzle is configured to receive the first fluid and the second nozzle is configured to receive the second fluid.

9. The gas-fueled heater of claim 6, wherein the burner is configured such that the first fluid flows through the first nozzle and the second fluid flows through the first and second nozzles.

10. The gas-fueled heater of claim 1, further comprising an igniter positioned adjacent the control valve, the igniter positioned at a fourth hole of the plurality of holes adjacent the top of the housing.

11. The gas-fueled heater of claim 1, wherein the second knob is configured to rotate no less than 90 degrees to move the fluid selection valve between the first state and the second state.

* * * * *